US006546815B2

(12) United States Patent
Yamada et al.

(10) Patent No.: US 6,546,815 B2
(45) Date of Patent: Apr. 15, 2003

(54) READING METHOD OF SCREW ROTATION ANGLE OF HAND-HELD IMPACT WRENCH, HAND-VIBRATION DETECTION METHOD, TIGHTENING EVALUATION METHOD AND CONTROL METHOD OF HAND-HELD POWER SCREW LOOSENING TOOL

(75) Inventors: Masakazu Yamada, Habikino (JP); Ryoichi Shibata, Habikino (JP); Yoshihiko Nagare, Habikino (JP)

(73) Assignee: Kuken Co., Ltd., Osaka (JP)

( * ) Notice: Subject to any disclaimer, the term of this patent is extended or adjusted under 35 U.S.C. 154(b) by 33 days.

(21) Appl. No.: 09/936,520

(22) PCT Filed: Mar. 13, 2001

(86) PCT No.: PCT/JP00/01515

§ 371 (c)(1),
(2), (4) Date: Sep. 14, 2001

(87) PCT Pub. No.: WO00/54939

PCT Pub. Date: Sep. 21, 2000

(65) Prior Publication Data

US 2002/0134172 A1 Sep. 26, 2002

(30) Foreign Application Priority Data

Mar. 16, 1999 (JP) ..... 11-070344
Aug. 13, 1999 (JP) ..... 11-229277

(51) Int. Cl.[7] ..... B25B 23/14
(52) U.S. Cl. ..... 73/862.21
(58) Field of Search ..... 73/862.21, 862.191, 73/862.23, 862.24, 862.08

(56) References Cited

U.S. PATENT DOCUMENTS 4,357,121 A * 11/1982 Wirschal ..... 405/100
4,436,004 A * 3/1984 Chang ..... 81/128
5,315,501 A * 5/1994 Whitehouse ..... 173/176
5,476,014 A * 12/1995 Lampe et al. ..... 73/862.21

FOREIGN PATENT DOCUMENTS

| | | |
|---|---|---|
| JP | 62-130184 | 6/1987 |
| JP | 63-185584 | 8/1988 |
| JP | 63-256376 | 10/1988 |
| JP | 10-71576 | 3/1998 |
| JP | 10-80828 | 3/1998 |

* cited by examiner

*Primary Examiner*—Max Noori
(74) *Attorney, Agent, or Firm*—Wenderoth, Lind & Ponack, L.L.P.

(57) ABSTRACT

A hand-held powered screw tightening tool has a detecting device to detect a rotation angle of a rotary member in a clockwise direction and a counterclockwise direction. In screw tightening, an angle obtained by subtracting a cumulative total of the rotation angle of the rotary member with rebound, if any, in a counterclockwise direction from a cumulative total of the rotation angle of the rotary member in the clockwise direction is detected and accumulated as a total rotation angle (P) and a rotation angle formed during the deceleration at the hammering is detected as ΔH and accumulated, and a preset design angle Pd for hammering is accumulated. A wobbling angle is calculated from Equation: A wobbling angle=P−a cumulative total of Pd−a cumulative total of ΔH (where Pd is a design value of the impact wrench, indicating an angle corresponding to 360°/m for the case of the m number of hammerings per rotation of the rotary member). When the cumulative total of the rotation angle ΔH reaches the predetermined design angle for screw tightening, the rotation of the rotary member is stopped. In screw loosening, the rotary member is rotated in the opposite direction, so that when the rotation angle of the rotary member reaches a predetermined number of rotations in the loosening direction similarly, the rotation of the rotary member is stopped.

15 Claims, 42 Drawing Sheets

TORQUE DETECTION SYSTEM

ROTATION ANGLE DETECTION SYSTEM

TORQUE DETECTION SYSTEM

ROTATION ANGLE DETECTION SYSTEM

READING METHOD OF SCREW ROTATION ANGLE OF HAND-HELD IMPACT WRENCH, HAND-VIBRATION DETECTION METHOD, TIGHTENING EVALUATION METHOD AND CONTROL METHOD OF HAND-HELD POWER SCREW LOOSENING TOOL

TECHNICAL FIELD

The present invention relates to a method of controlling tools designed to provided a torque to a screw member such as a bolt and a nut, including hand-held powered wrenches, such as an impact wrench and an impulse wrench, and hand-held nut runners, when tightening or loosening the bolt and nut by use of the tool.

BACKGROUND ART

In general, when a screw tightening work for tightening a number of screw members such as bolts and nuts is performed in an automobile factory and the like, there is a need for tightening all screw members with a uniform screw torque. To meet this need, a hand-held powered wrench was developed, as described by Japanese Patent Publication No. Hei 6-16990, which is structured so that a rotary member that rotates with a driving shaft is driven to rotate around a driven shaft so that a torque of the rotary member can be transmitted to the driven shaft through a hammer to tighten a screw member. Further, a screw tightening angle (a screwing angle) of the screw member is detected by a rotary detecting member to rotate together with the driving shaft and a detecting sensor disposed at a non-revolving part of a wrench body.

In this type of hand-held powered wrench, in order to detect the screw tightening angle of the screw member via the rotary detecting member and the detecting sensor, a number of pulses $R_1$ generated when the rotary member rebounds in the opposite rotation direction after colliding with the driven shaft through the hammer and a number of pulses $F_1$ generated during the time during which the rotary member runs freely in the normal rotation direction after the rebound until it collides with the driven shaft again to apply a hammering force to it are detected. From these numbers of pulses $R_1$ and F, a number of pulses$\theta_1$ equivalent to the screwing angle at a hammering is determined. For an impact wrench wherein the rotary member provides one hammering per rotation of the same, the number of pulses$\theta_1$ is calculated from the following Equation:

$$\theta_1 = F_1 - (\text{the number of pulses equivalent to } 360^\circ) - R_1 \qquad \text{(Eq. 1).}$$

Then, the number of pulses equivalent to the screwing angle is calculated and converted into an angle every time the hammering is provided. When the cumulative total of angles reaches a predetermined screw tightening angle, the driving shaft is stopped.

On the other hand, in order to reduce a hammering sound that is one of the problems of the impact wrench of the type mentioned above, an impulse wrench was developed as a type of hand-held powered wrench, which is structured so that the torque of the rotary member is transmitted to the driven shaft by means of oil.

However, in the method for controlling the screw tightening of the hand-held powered wrench of the conventional type mentioned above, since the number of pulses at the rebound and the number of pulses at the normal rotation are detected and then the number of pulses$\theta_1$ equivalent to the screwing angle is determined from Equation (1) by using the detected number of pulses, if a wobbling, as will be mentioned later, is caused by a worker operating the impact wrench in the course of tightening the screw member seated on a bearing surface to a predetermined screw tightening angle, then the wobbling angle is detected and considered as a large error in screw tightening angle by the detecting sensor arranged at the wrench body side. Because of this, the method of controlling the screw tightening by using the hand-held powered wrench did not come into wide use.

It should be noted that the term "wobbling" referred to in the specification is intended to cover the following three different types of movements:

1. The movement of the thread center of the screw member not moving or moving linearly and the powered wrench turning with respect to the thread center;
2. The movement of the screw member turning around a point different from the thread center of the screw member (e.g. a fastening bolt of a car wheel), and as such, causing the powered wrench to infectiously move in parallel; and
3. The movement of the screw member turning around a point different from the thread center of the screw member and the powered wrench turning with respect to the thread center.

However, the movement of the thread center of the screw member moving linearly, and as such, causing the powered wrench to infectiously move in parallel is not included in the definition of the wobbling in the specification.

It should also be noted that no adequate ways of controlling the loosening, as well as the tightening have been proposed. This can cause following problems. For example, when a nut is loosened excessively in the loosening direction, the nut can fall down to the floor or ground from the bolt and allowing grit in the nut, so that when the nut is tightened at a later time, it cannot be tightened properly. In addition, when the nut is not loosened enough with a power tool to be loosened further by hand, some tool must again be used to loosen the nut, thus presenting poor workability. Further, when the nut is loosened excessively at an overhead location, the nut can fall from the bolt and put a person under that location in danger.

The inventors have gained knowledge in that since the time for the impact to be actually provided is very short (in the order of a millisecond), an angle of the wobbling that can be produced within such a very short time cannot help but be very limited or minute. As a result, and they have derived from this knowledge the method of the present invention for enabling a screwing angle to be measured with necessary and sufficient accuracy even when some wobbling is caused. Also, through the use of this method, the inventors have devised a method on the screw tightening control and on the screw loosening control.

Further, the inventors propose herein the technique of examining the degree of error included in measurement results caused by the wobbling, to evaluate the screw tightening on the basis of the degree of the wobbling.

SUMMARY OF THE INVENTION

The present invention provides a method for reading a screwing angle of a hand-held powered wrench comprising a rotary member which, after running freely, starts decelerating when it provides a hammering force or torque to a driven shaft side and, after the end of deceleration, rebounds and runs freely again, wherein a rotation angle formed throughout deceleration of the rotary member in a tightening direction from the start of deceleration to the end of deceleration is accumulated, so that when a sum total of the accumulated rotation angle reaches a preset angle, a controlled stoppage of tightening can be provided.

The present invention provides a method for reading a screwing angle of a hand-held powered wrench comprising a rotary member which, after running freely, starts decelerating when it provides a hammering force or torque to a driven shaft side and, after the end of deceleration, runs freely again, wherein an angle obtained by subtracting a certain angle from a rotation angle formed throughout deceleration of the rotary member in the tightening direction from the start of deceleration to the end of deceleration is accumulated, so that when a sum total of the accumulated angle reaches a preset angle, a controlled stoppage of tightening can be provided.

Also, the present invention provides a method for controlling a hand-held powered wrench comprising a rotary member which, after running freely, starts decelerating when it provides a hammering force or torque to a driven shaft side and, after the end of deceleration, rebounds and runs freely again, wherein there is provided detecting means to detect variation in rotation velocity or rotational frequency of the rotary member and a rotation angle of the same, wherein on the basis of the variation in the rotation velocity and the rotation angle detected by the detecting means, an angle obtained by subtracting a cumulative total of the rotation angle in the rebounding direction from a cumulative total of the rotation angle in the tightening direction is detected and accumulated as a total rotation angle (P). Further, a rotation angle formed at the hammering in the course of the deceleration is detected as ΔH and accumulated, and a preset design angle Pd for hammering corresponding to the number of hammerings provided until the end of the tightening work is accumulated, and wherein a wobbling angle is calculated from the following Equation:

A wobbling angle=*P*−a cumulative total of *Pd*−a cumulative total of ΔH, where Pd is a design value of the powered wrench, indicating an angle corresponding to 360°/m for the case of the m number of hammerings per rotation of the rotary member.

In addition, the present invention provides a method for detecting a wobbling in a controlled tightening of a hand-held powered wrench comprising a rotary member which, after running freely, starts decelerating when it provides a hammering force to a driven shaft side and, after the end of deceleration, runs freely again without rebounding, wherein there is provided detecting means to detect variation in rotation velocity of the rotary member and a rotation angle of the same, wherein on the basis of the variation in the rotation velocity and the rotation angle detected by the detecting means, a cumulative total of the rotation angle in the tightening direction is detected and accumulated as a total rotation angle (P) and an angle obtained by subtracting a certain angle from a rotation angle formed throughout the deceleration is detected as ΔG and accumulated, and a preset design angle Pd for hammering corresponding to the number of hammerings provided until the end of tightening work is accumulated, and wherein a wobbling angle is calculated from the following Equation:

A wobbling angle=*P*−a cumulative total of *Pd*−a cumulative total of ΔG, where Pd is a design value of the powered wrench, indicating an angle corresponding to 360°/m for the case of the m number of hammerings per rotation of the rotary member.

The present invention provides a method of evaluating reliability of a tightening of the hand-held powered wrench by comparing a wobbling angle calculated by the wobbling detecting method mentioned above with a preset allowable angle.

The present invention provides a method for controlling a hand-held powered screw loosening tool comprising a rotary member which, after running freely in a screw loosening direction, starts decelerating when it provides a hammering force to a driven shaft side and, after the end of deceleration, starts running freely again in the loosening direction after or without rebounding, wherein a rotation angle of the driven shaft in the loosening direction in a screw loosening work is accumulated, so that when a sum total of the accumulated rotation angle reaches a preset angle, the rotation of the driven shaft in the loosening direction can be controllably stopped.

Also, the present invention provides a method for controlling a hand-held powered screw loosening tool comprising a rotary member which, after running freely in a screw loosening direction, starts decelerating when it provides a hammering force to a driven shaft side and, after the end of deceleration, starts running freely again in the loosening direction after or without rebounding. Detecting means is provided to detect variation in rotation velocity of the rotary member and a rotation angle of the rotary member, wherein on the basis of the variation in the rotation velocity and the rotation angle detected by the detecting means, a rotation angle of the rotary member in the loosening direction formed during the deceleration from the start to the end thereof or an angle obtained by subtracting a certain angle from the rotation angle formed throughout the deceleration of the rotary member is accumulated, so that when a sum total of the accumulated angle reaches a preset angle, the rotation of the driven shaft in the loosening direction can be controllably stopped.

In addition, the present invention provides a method for controlling a hand-held powered screw loosening tool comprising a rotary member which, after running freely in a screw loosening direction, starts decelerating when it provides a hammering force to a driven shaft side and, after the end of deceleration, starts running freely again in the loosening direction after or without rebounding. Detecting means is provided to detect variation in rotation velocity of the rotary member and a rotation angle of the rotary member, wherein a generation of the hammering is detected by the detecting means, so that in the case of a hand-held powered screw loosening tool wherein the rebound is generated after the end of deceleration, when the rotary member starts running freely again without rebounding after the generation of the hammering is detected or when the rotary member starts running freely again without its rotation velocity reducing to zero, the rotation of the driven shaft in the loosening direction can be controllably stopped when the rotary member rotates continuously at or over a predetermined screw loosening angle. On the other hand, in the case of a hand-held powered screw loosening tool wherein the rebound is not generated after the end of deceleration, the rotation of the driven shaft in the loosening direction can be controllably stopped when the rotary member rotates continuously at or over a predetermined preset screw loosening angle without its rotation velocity in the loosening direction after the end of deceleration reducing below a threshold value after the generation of the hammering is detected.

Further, the present invention provides a method for controlling a hand-held powered screw loosening tool wherein a torque generated by torque generating means is applied to a driven shaft through a torque transmission mechanism to rotate the driven shaft in a screw loosening direction, so as to loosen a screw member. Torque detecting means is provided to detect a rotative load torque for the driven shaft to be rotated in the screw loosening direction, so that when the rotative load torque detected by the torque detecting means comes to be below a predetermined torque, the rotation of the driven shaft in the loosening direction can be controllably stopped.

It should be noted that the torque transmission mechanisms that may be used include a mechanism for instantaneously transmitting the torque with impact, a mechanism for statically transmitting the torque, such as a nut runner using at least a single reduction mechanism (including a planetary gear train, a bevel gear, a worm gear, and other reduction mechanism), and one having both of the above-mentioned transmission mechanism using impact and the mechanism for statically transmitting the torque.

The hand-held powered screw loosening tools that may be used include a tool used for the screw loosening, as well as for the screw tightening, and the tool exclusively used for the screw loosening.

The process of accumulating the rotation angle of the driven shaft includes the process of accumulating the rotation angle in the torque transmission mechanism when the driven shaft is rotating, as well as the process of accumulating the rotation angle in the torque generating means.

Also, the process of stopping the driven shaft includes the process of stopping the torque transmission mechanism, as well as the process of stopping the torque generating means.

BEST MODE FOR CARRYING OUT THE INVENTION

In the following, a hand-held powered wrench used in an embodiment of the present invention will be described in detail with reference to the accompanying drawings.

Figure 1:
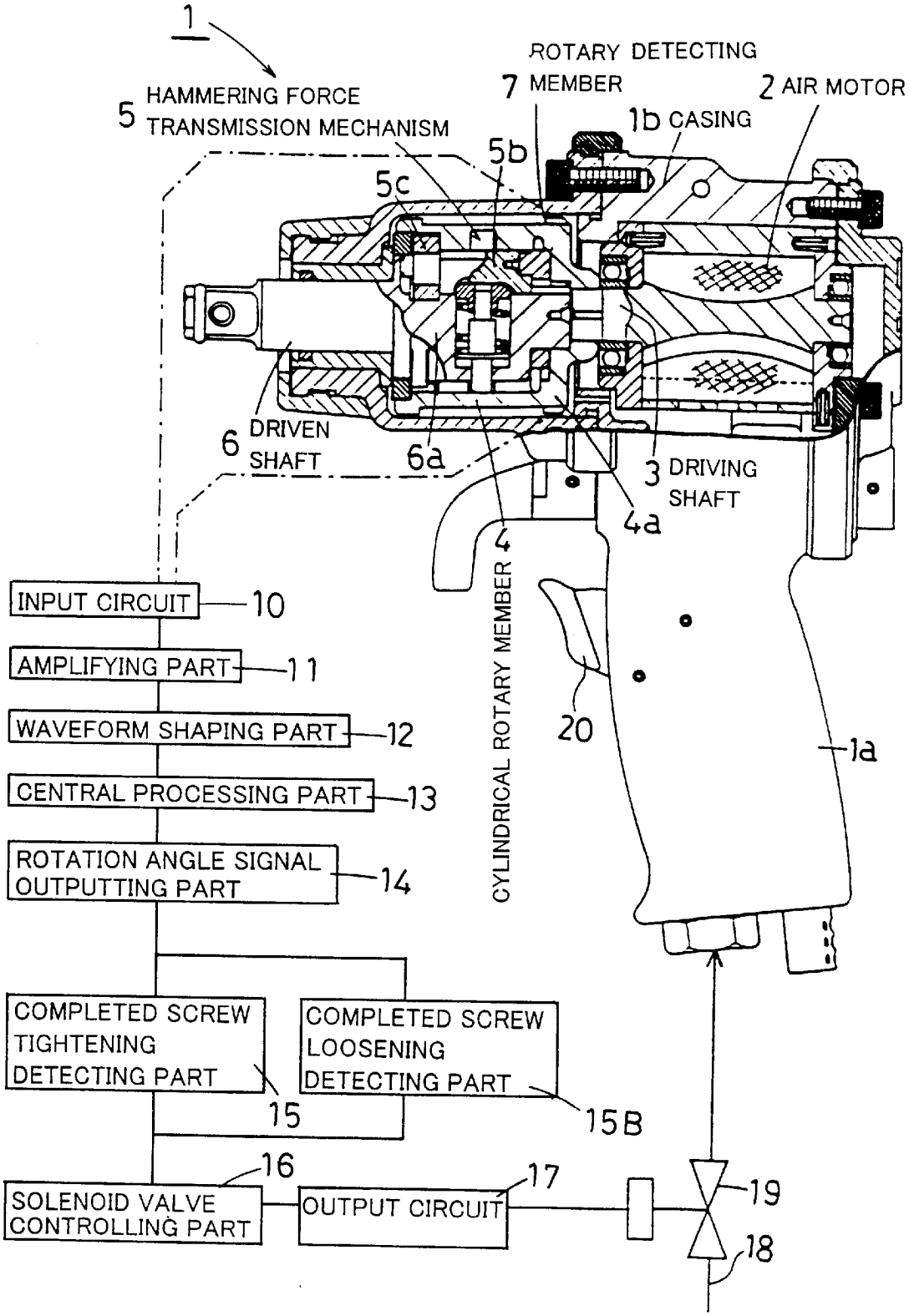
FIG. 1 is a vertically sectioned side view of an impact wrench used in an of the present invention.

FIG. 1 is a vertically sectioned side view of a principal part of an powered wrench designed to produce rebound on impact, which is an example of a hand-held powered wrench used in the present invention. It is to be noted that all powered wrenches and nut runners mentioned below, including an impact wrench and an impulse wrench, means those of the hand-held type.

In the FIG., 1 denotes an impact wrench used in the present invention. 2 denotes an air motor disposed in an interior of a casing 1*b* of a gripping portion 1*a* of a rear part of the impact wrench 1 at the bottom. 3 denotes a driving shaft of the air motor 2. 4 denotes a cylindrical rotary member integrally coupled with a front end of the driving shaft 3. A disk-like rear wall panel 4*a* of the cylindrical rotary member 4 is integrally coupled with the driving shaft 3 at the center thereof via a fitted structure comprising a quadrangular projection and a complementary depression.

The impact wrench 1 is one embodied form of the hand-held impact wrench and is a tool designed for both screw tightening and screw loosening. The air motor 2 is one embodied form of the torque generating means. The cylindrical rotary member 4 is one embodied form of the rotary member.

The air motor 2 is structured to revolve at high velocity in a clockwise direction or counterclockwise direction by compressed air fed thereto from outside through an air feed passage (not shown) arranged in the gripping portion 1 a by a switching operation of a control lever 20 and a selector valve (not shown), as already known. The torque of the cylindrical rotary member 4, which is driven to rotate together with the driving shaft 3 of the air motor 2, is transmitted, through a hammering force transmission mechanism 5 mentioned later, to a driven shaft 6 called an anvil block having a front end projecting forward from a front end of the casing 1*b* and, in turn, to a socket (not shown) attached to the front end of the driven shaft 6, so as to tighten a screw member fitted to the socket in a known manner.

A rear portion of the driven shaft 6 is formed into a trunk 6*a* of the body having a large diameter, and the trunk 6*a* is mounted to the center of the cylindrical rotary member 4. The cylindrical rotary member 4 is rotated around the trunk 6*a* of the driven shaft 6, and the torque is transmitted to the driven shaft 6 through a hammering force transmission mechanism 5, as mentioned above.

Figure 3:
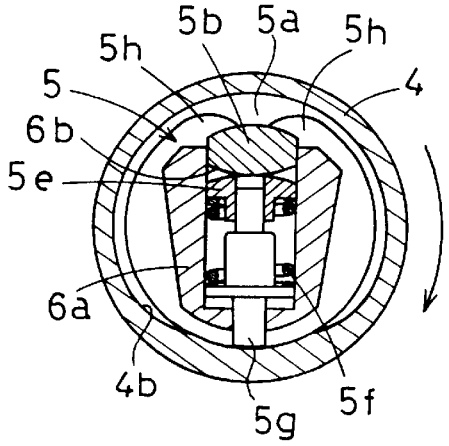
FIG. 3 is a vertically sectioned front view of a hammering force transmission mechanism having a hammering boss and an anvil block.

The hammering force transmission mechanism 5 comprises, as shown in FIGS. 1 and 3, a hammering boss 5*a* projecting inward from a proper location of an inner periphery of the cylindrical rotary member 4 and the anvil block 5*b*, which is supported in a semicircular support groove 6*b* formed on the trunk 6*a* of the driven shaft 6 in such a manner as to freely sway from side to side. The anvil block 5*b* is put in a state in which it is inclined with respect to a horizontal direction and then the hammering boss 5*a* is collided with one upswept end face of the anvil block 5*b*, so as to transmit the torque of the cylindrical rotary member 4 to the driven shaft 6 side. The hammering force transmission mechanism 5 is one embodied form of the torque transmission mechanism.

Figure 4:
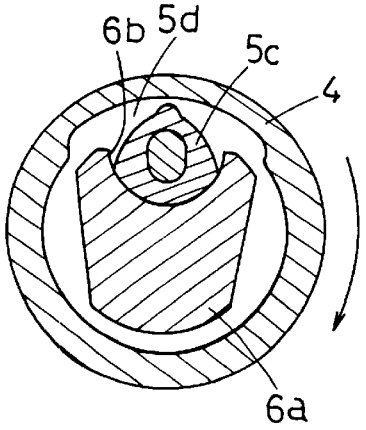
FIG. 4 is a vertically sectioned front view of a cam plate part to activate the anvil block.

As shown in FIG. 4, when a cam plate 5*c* at a front end of the anvil block 5*b* is positioned within a concave portion 5*d* having a given circular length circumferentially formed in the inner periphery of the cylindrical rotary member 4 at the front end thereof, the anvil block is kept in its neutral position in which it is not allowed to engage with the hammering boss 5*a*. When the cam plate comes out from the concave portion 5*d* and moves in contact with the inner periphery of the cylindrical rotary member 4, the anvil block takes an inclined position to collide with the hammering boss 5*a*. The anvil block 5*b* is under pressure in the direction for the anvil block 5*b* to always be kept in the neutral position from an anvil block pressing member 5*e*, a spring 5*f* and a spring receiving member 5*g* which are provided in the trunk 6*a* of the driven shaft 6. The spring receiving member 5*g* is in contact with an inner cam surface 4*b* of the cylindrical rotary member 4. Further, a concave portion 5*h* for allowing the anvil block 5*b* to be inclined is formed in the inner periphery of the cylindrical rotary member 4 at both sides of the hammering boss 5*a*. As this structure of the impact wrench is already known, the detailed description thereon is omitted.

While in the embodiment of the present invention, the hammering is produced once for each rotation of the cylindrical rotary member 4, it is needless to say that the present invention is also applicable to the hand-held powered wrench designed to produce the hammering two or three times or more for each rotation of the cylindrical rotary member.

Figure 2:
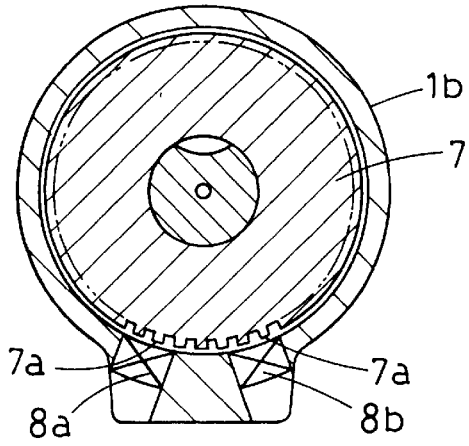
FIG. 2 is a vertically sectioned front view of a principal part of FIG. 1.

A rotary detecting member 7 comprising a gear having a predetermined number of teeth 7*a* around its outer periphery is fixedly mounted to the cylindrical rotary member 4 at the rear end thereof to be integral therewith, as shown in FIG. 2. On the other hand, a pair of detecting sensors 8*a*, 8*b* comprising semi-conducting magneto-resistive elements are mounted around an inner periphery of the non-revolving casing 1*b* so as to confront the rotary detecting member 7, leaving a given circumferential space therebetween. The rotation of the rotary detecting member 7 is detected by the detecting sensors 8*a*, 8*b*, and the output signals are input to an input circuit 10 electrically connected to the detecting sensors 8*a*, 8*b*. The input circuit 10 is connected to a solenoid valve 19 arranged in a compressed air supply hose 18 through an amplifying part 11, a waveform shaping part 12, a central processing part 13, a rotation angle signal outputting part 14, a completed screw tightening detecting part 15, a solenoid valve controlling part 16 and an output circuit 17.

It is noted here that a completed screw loosening detecting part 15B shown in FIG. 1 is used to make screw loosening control of the impact wrench 1.

The rotary detecting member 7 and the detecting sensors 8*a*, 8*b* form one embodied form of the detecting means.

In the arrangement mentioned above, electric components provided between the input circuit 10 and the output circuit 17 are disposed in a controller (not shown) located at the outside of the impact wrench. The controller and the solenoid valve 19 can be housed in the impact wrench. The solenoid valve 19 and the solenoid valve controlling part 16 can be substituted by a compressed air supply shut-down device and an adequate controlling part.

Now, the method of reading a rotation angle of screw member, such as a bolt and nut, in the impact wrench thus constructed will be described below.

First, a screw member 9 to be tightened is fitted to the socket mounted on the front end portion of the driven shaft 6 and a predetermined screw tightening angle is previously input to the completed screw tightening detecting part 15. Then, when the solenoid valve 19 is opened and the control lever 20 of the impact wrench is pressed to feed compressed air to the impact wrench, so as to rotate the air motor 2 in the screw tightening direction (in the clockwise direction for the right-hand screw member), the driving shaft 3 and the cylindrical rotary member 4 are then rotated together. This rotation causes the cam plate 5*c* to shift from the concave portion 5*d*, while contacting with the inner periphery of the cylindrical rotary member 4, so that the anvil block 5*b* is tilted. The frictional resistance between the spring receiving member 5*g* and the inner cam surface 4*b* causes the cylindrical rotary member 4 and the driven shaft 6 to rotate together, so as to rotatively propel the screw member 9 at high velocity in the tightening direction until the screw member is seated.

While the screw member 9 is rotatively propelled, in other words, before the screw member 9 seats on a bearing surface, little load is applied to the driven shaft 6 side, so that the rotary detecting member 7 comprising the gear that rotates together with the cylindrical rotary member 4 revolves at high velocity in the direction of tightening the screw member 9 and the teeth 7*a* run through over the detecting sensors 8*a*, 8*b* continuously. Then, pulse signals of waveform of out-of-phase are generated by the detecting sensors 8*a*, 8*b*, but the pulse signals are not used for arithmetical operation to detect the rotation angle of the screw member until the screw member is seated.

The driven shaft 6 is driven to revolve together with the cylindrical rotary member 4 at high velocity through the hammering force transmission mechanism 5 comprising the hammering boss 5*a* and the anvil block 5*b*. When the screw member 9 is seated on the bearing surface, a resistance torque (load) generates in the driven shaft 6 and the rotation of the driven shaft 6 slows down to nearly standstill rapidly. Then, the hammering boss 5*a* and the anvil block 5*b* come into collision with each other to start hammering. After the end of the hammering, an elastic force of the spring 5*f* pressing the anvil block 5*b* overcomes a force to bring the hammering boss 5*a* and the anvil block 5*b* into engagement, so that the engagement therebetween is released and the cylindrical rotary member 4 is allowed to run freely around the trunk 6*a* of the driven shaft 6.

Figure 5:
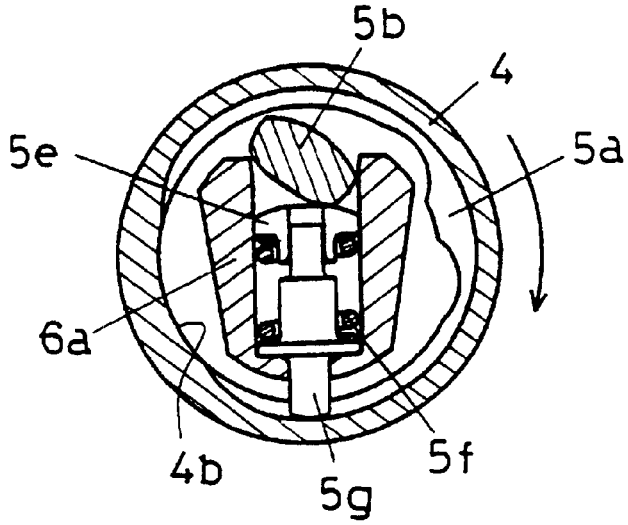
FIG. 5 is a vertically sectioned front view of the hammering force transmission mechanism that is in the free running state.
Figure 6:
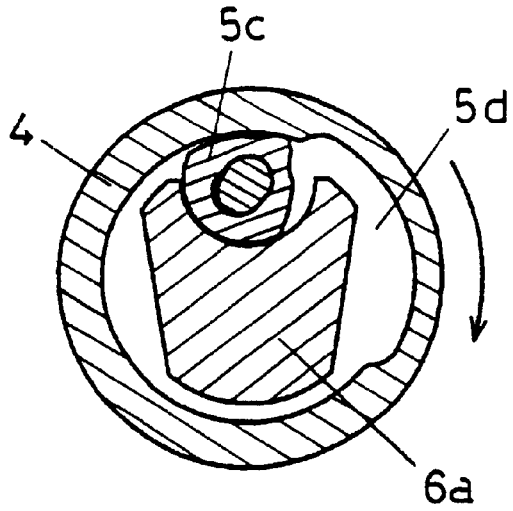
FIG. 6 is a diagram illustrating an operative state of the cam plate.
Figure 7:
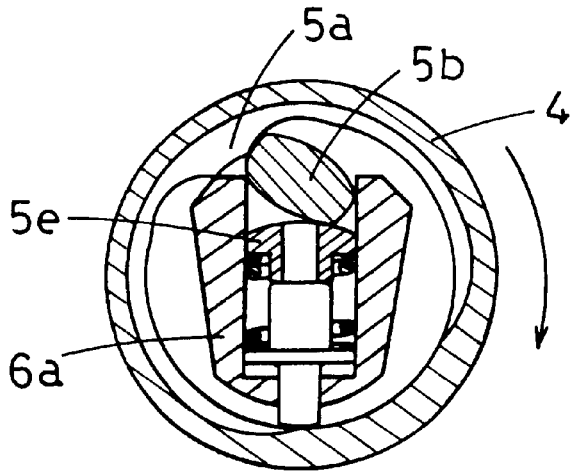
FIG. 7 is a vertically sectioned front view of the hammering force transmission mechanism at the time of hammering.

While the cylindrical rotary member 4 is running freely, the cylindrical rotary member 4 is accelerated by the driving torque of the air motor 2, while on the other hand, the cam plate 5*c* is brought into contact with the inner periphery of the cylindrical rotary member 4, so that the anvil block 5*b* is tilted, as shown in FIGS. 5 and 6. After the end of the free running of the cylindrical rotary member 4, the hammering boss 5*a* is brought into engagement with the anvil block 5*b* with impact, as shown in FIG. 7. This hammering causes the torque of the cylindrical rotary member 4 to be transmitted to the driven shaft 6 so as to rotate the driven shaft 6 in the tightening direction by a certain angle only. Then, the screw tightening angle is detected by the rotary detecting member 7 and the detecting sensors 8*a*, 8*b* in a manner mentioned later.

Figure 8:
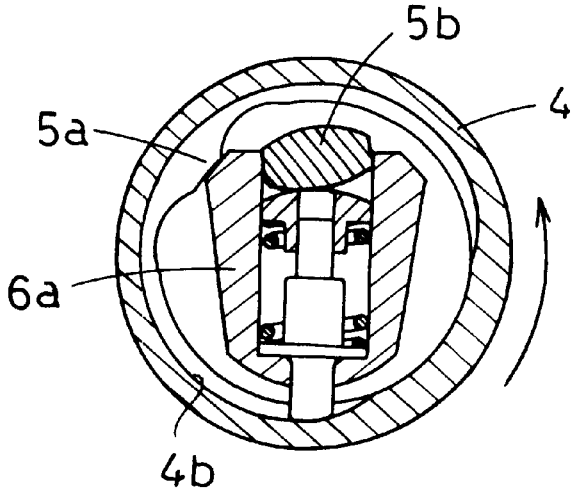
FIG. 8 is a vertically sectioned front view of the hammering force transmission mechanism at the time of rebounding.

When the screw member 9 is tightened up, a resistance force larger than the torque of the air motor 2 is generated at the driven shaft 6 side. At the moment when the driven shaft 6 is finished rotating by a certain angle in the tightening direction by the hammering force of the hammering boss 5*a*, the cylindrical rotary member 4 rebounds in the direction opposite to the tightening direction and then runs freely in the tightening direction through the driving torque of the air motor 2, as shown in FIG. 8. This brings the hammering boss 5*a* into engagement with the anvil block 5*b* again with impact in the same manner as above, so as to rotate the driven shaft 6 in the screw tightening direction further. The screw tightening angle at that time is read by the rotary detecting member 7 and the detecting sensors 8*a*, 8*b*. Subsequently, after the free running of the cylindrical rotary member 4, the screw tightening angle is detected every time the hammering boss 5*a* comes into collision with the anvil block 5*b*. When the cumulative total of screw tightening angle reaches a predetermined screw tightening angle, the feed of the compressed air is automatically stopped to complete the tightening of the screw member 9.

Figure 9A:
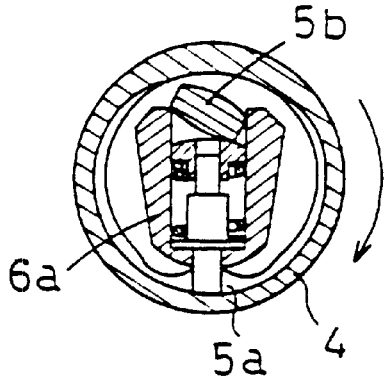
FIGS. 9(*a*)–(*c*) are illustrations illustrating a velocity of a cylindrical rotary member with a hammering boss that is in the free running state.
Figure 9B:
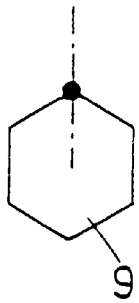
Figure 9C:
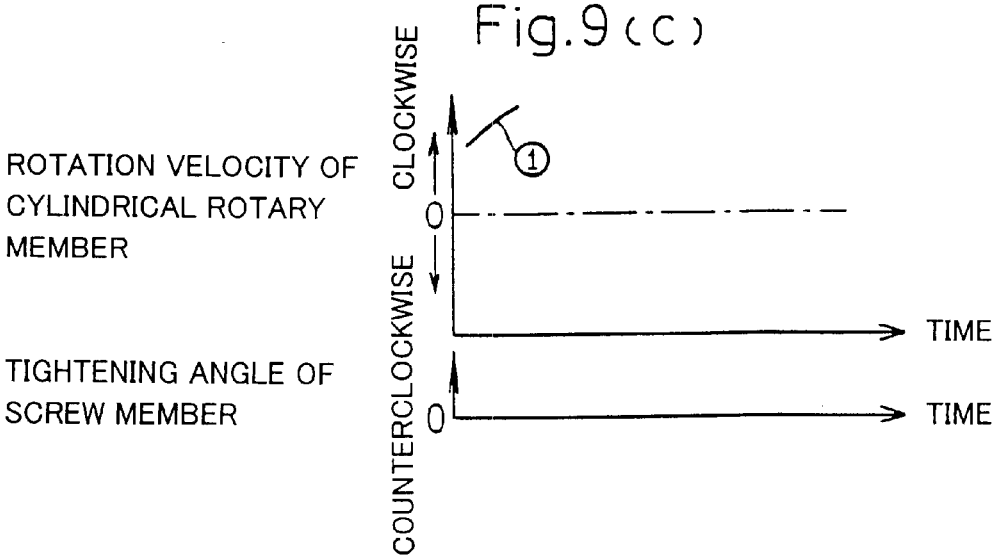

Referring now to FIGS. 9(*a*)–15, the method of detecting the screw tightening angle by use of the rotary detecting member 7 and the detecting sensors 8*a*, 8*b* will be described.

The detecting sensors 8*a*, 8*b* are structured so that when a tooth of the rotary detecting member 7 rotating together with the cylindrical rotary member 4 passes through the detecting sensors, the detecting sensors can detect one pulse and measure the velocity of the cylindrical rotary member 4 from the number of passing teeth per unit of time. In each of the FIGS. 9(*a*)–14(*c*) above, (*a*) shows the operative relations between the cylindrical rotary member 4 and the driven shaft 6, (*b*) illustrates a screw tightening angle of the screw member 9, and (*c*) plots a time shift in rotation velocity of the cylindrical rotary member 4 and screw tightening angle of the screwing member 9 every time the hammering is performed. It is noted that the screw member 9 used is a right-hand thread to be tightened in the clockwise direction.

FIGS. 9(*a*)–(*c*) are views showing the free running state of the cylindrical rotary member 4. In this state, the torque of the cylindrical rotary member 4 is not transmitted to the driven shaft 6 from the hammering force transmitting mechanism 5 comprising the hammering boss 5*a* and the anvil block 5*b*, so that the cylindrical rotary member 4 gradually accelerates, while freely running ① in the clockwise direction, as depicted by an upward-sloping line in FIG. 9(*c*) and FIG. 15.

Figure 15:
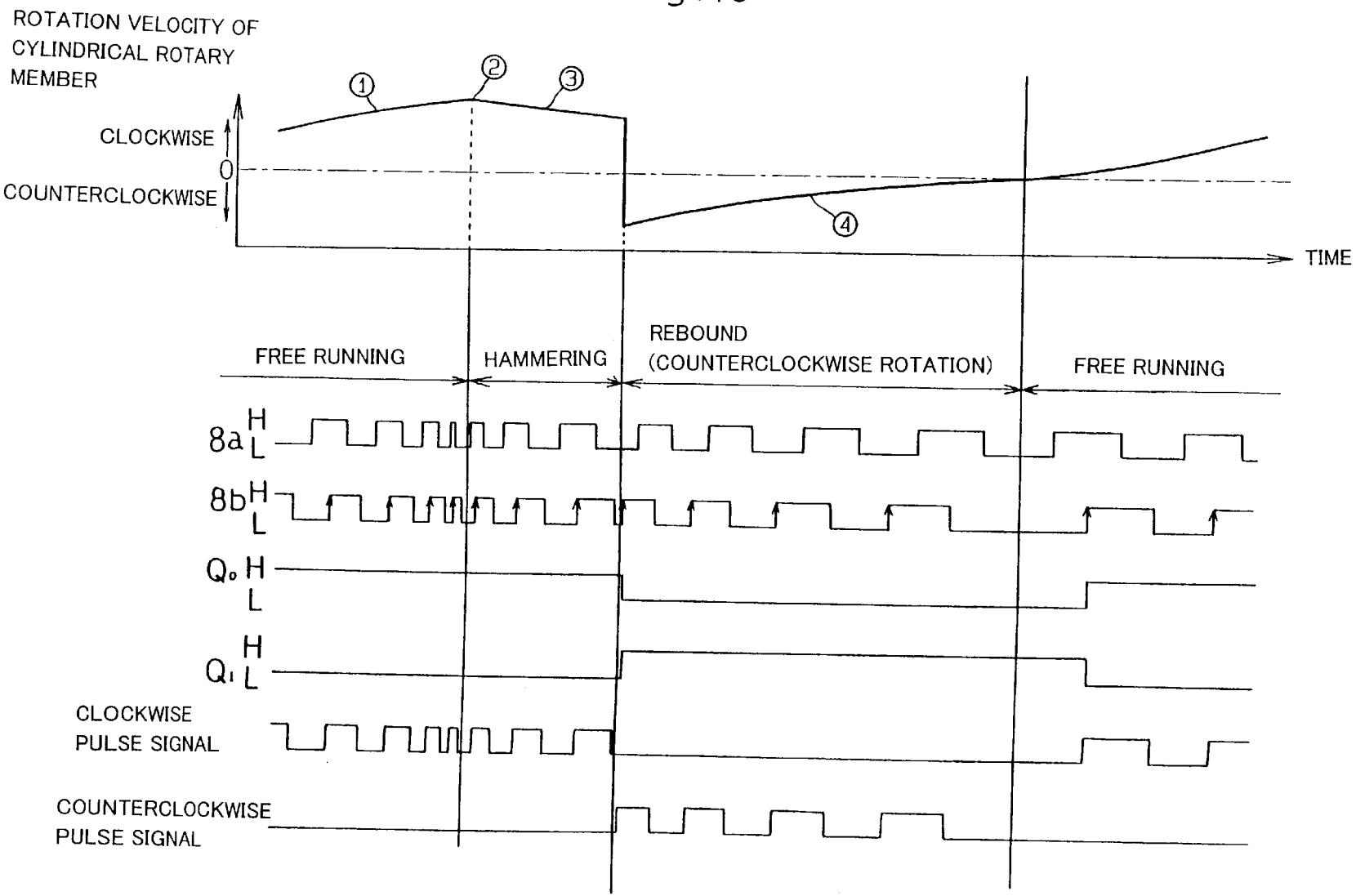
FIG. 15 is a plot of the relation between operation of the cylindrical rotary member and pulse signals.

The detecting sensors 8*a*, 8*b* are structured to output pulse signals differing in phase by 90 degrees from each other, as mentioned above. While the rotary detecting member 7 is rotating in the screw tightening direction (in the clockwise direction), the waveform of the pulse signal is output from one detecting sensor 8*a*, whose phase is 90 degrees more advanced than that of the other detecting sensor 8*b*, as shown in FIG. 15. On the other hand, when the hammering boss 5*a* collides with the anvil block 5*b*, for the hammering, and then the rotary detecting member 7 rebounds in the counterclockwise direction together with the cylindrical rotary member 4, the phases of the signals from the both detecting sensors 8*a*, 8*b* are reversed. In other words, the waveform of the pulse signal is output from the other detecting sensor 8*b*, whose phase is 90 degrees more advanced than that of the one detecting sensor 8*a*.

When the rotary detecting member 7 is rotating in the screw tightening direction (in the clockwise direction), the waveform from the one detecting sensor 8*a* comes to be at a high level (H) when the waveform from the other detecting sensor 8*b* is upended (↑). When the rotary detecting member 7 is rotating in the rebounding direction (in the counterclockwise direction), the waveform from the one detecting sensor 8*a* comes to be at a low level (L). $Q_0$ is the detection signal indicating the rotation direction. The waveform (H) or (L) is kept at the high level or at the low level until the rotation direction is changed. On the other hand, the signal $Q_1$ maintains exactly the opposite state to the signal $Q_0$. The central processing part 13 is constituted to discriminate between the tightening direction (clockwise direction) or the rebounding direction (counterclockwise direction) by the signal $Q_0$ or $Q_1$ and detect the respective directional pulse signal. Thus, the free running ① is detected by detecting the pulse signal in the normal rotation direction (clockwise pulse signal).

Figure 10A:
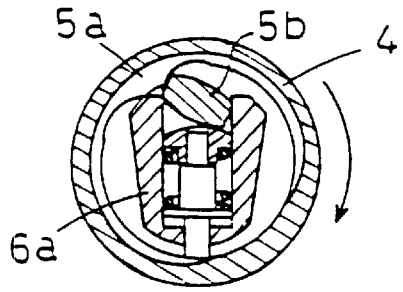
FIGS. 10(*a*)–(*c*) are illustrations illustrating the velocity of the cylindrical rotary member with the hammering boss at the moment of the start of hammering.
Figure 10B:
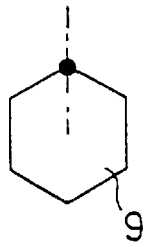
Figure 10C:
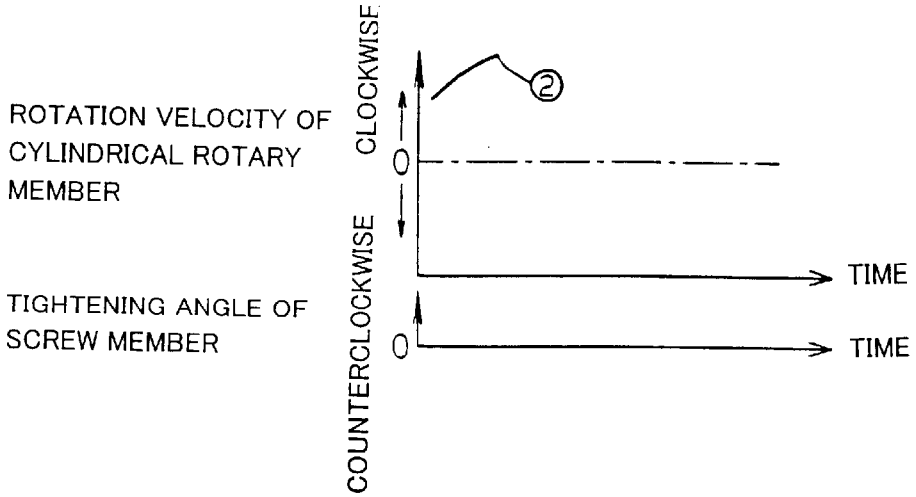
Figure 11A:
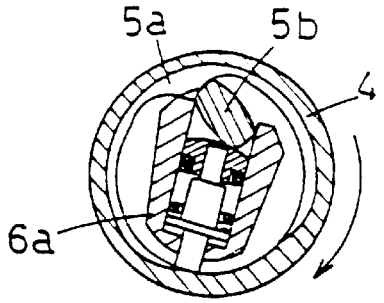
FIGS. 11(*a*)–(*c*) are illustrations illustrating the velocity of the cylindrical rotary member with the hammering boss at the time of tightening a screw member.
Figure 11B:
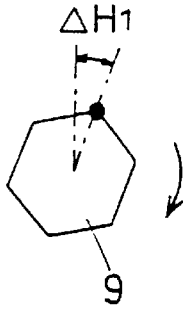
Figure 11C:
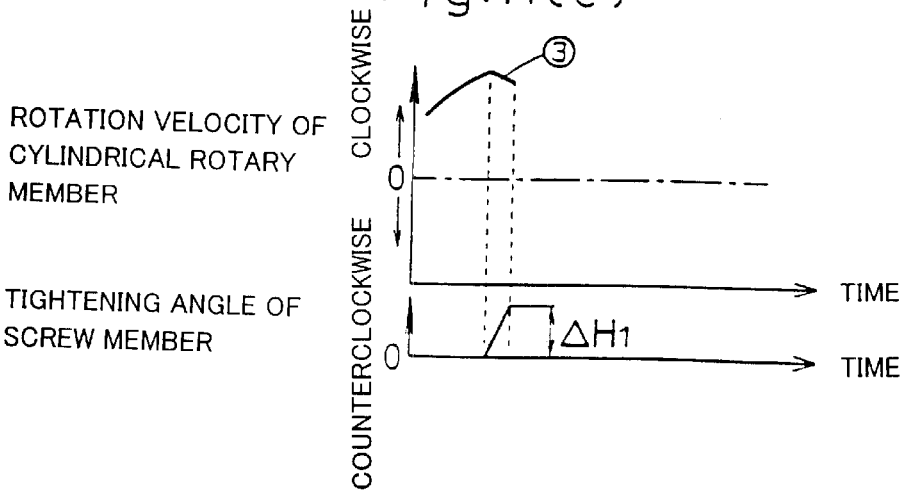

Then, at the moment at which the hammering boss 5*a* collides with the anvil block 5*b* after the free running of the cylindrical rotary member 4, the rotation velocity of the cylindrical rotary member 4 becomes maximum ②, as shown in FIG. 10(*c*). From this state, the tightening of the screw member 9 by the hammering is started. At this time of screw tightening, the driven shaft 6 rotated in the tightening direction via the hammering force transmission mechanism 5 consumes energy for tightening the screw member 9, so that when the first screw tightening is provided, the cylindrical rotary member 4 is decelerated ③ from the maximum velocity ②, as indicated by a downward-sloping line shown in FIG. 11(*c*) and FIG. 15. Thereafter, the cylindrical rotary member 4 rebounds ④ in the counterclockwise direction, as shown in FIG. 12(*c*).

A point of time at which the deceleration ③ is started from the maximum velocity ② is determined by detecting the state of rotation of the rotary detecting member 7 by use of the detecting sensors 8*a*, 8*b*, as shown in FIG. 15. Specifically, as the cylindrical rotary member 4 is accelerated in the free running, the widths of the pulse signals detected by the detecting sensors 8*a*, 8*b* gradually decrease, and at the moment at which the hammering boss 5*a* collides with the anvil block 5*b*, the widths of the pulse signals become minimum. Thereafter, during the time from after the start of deceleration of the cylindrical rotary member 4 to the end of hammering (the start of rebounding), the widths of the pulse signals in the clockwise direction increase gradually. These pulses of gradually decreasing widths and those of gradually increasing widths are output from the detecting sensors 8*a*, 8*b*. They are detected by the central processing part 13 as the clockwise pulse signals to judge the point of time at which the pulse widths are narrowed to minimum as the starting point of tightening of the screw member 9 by hammering (starting point of deceleration), as mentioned above.

Thus, after the detection of the starting point of deceleration of the cylindrical rotary member 4, the rotation angle of the rotary detecting member 7 is detected by the detecting sensors 8*a*, 8*b* throughout the deceleration ③ or during the period from the start of deceleration to the end of hammering. In other words, the screw tightening angle $\Delta H_1$ of the screw member 9 is determined from the number of pulses equivalent to the number of teeth of the rotary detecting member 7 passing through the detecting sensors 8*a*, 8*b* during the deceleration. Then, the cylindrical rotary member 4 rebounds ④ in the counterclockwise direction, as mentioned above. The pulses generated at the time of rebound ④ are used for determination of the starting point of control and for judgment of improper tightening, such as a unitary rotation of bolt and nut.

Figure 12A:
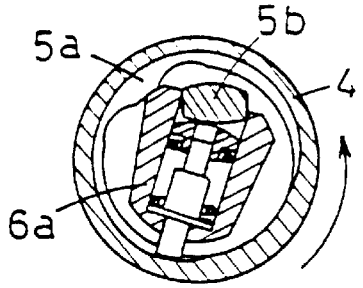
FIGS. 12(*a*)–(*a*) are illustrations illustrating the velocity of the cylindrical rotary member with the hammering boss at the time of rebounding.
Figure 12B:
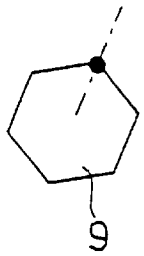
Figure 12C:
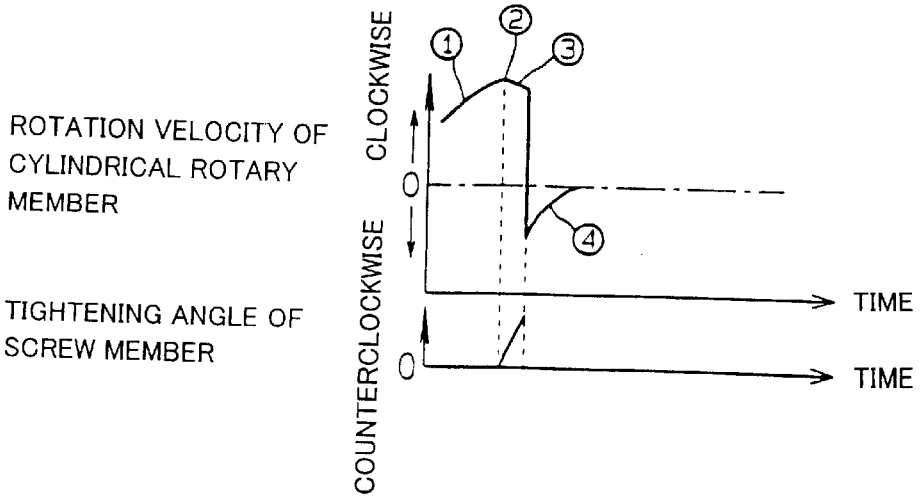
Figure 13A:
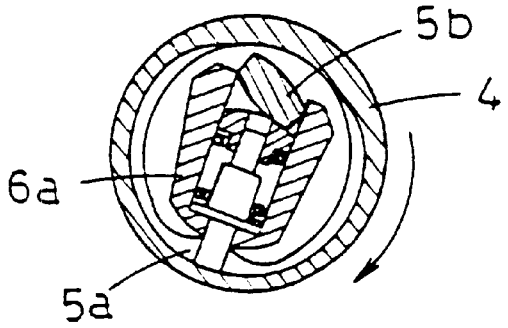
FIGS. 13(*a*)–(*c*) are illustrations illustrating the velocity of the cylindrical rotary member with the hammering boss at the time of free running again.
Figure 13B:
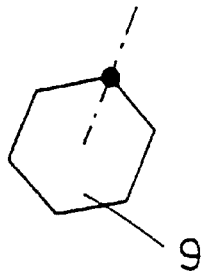
Figure 13C:
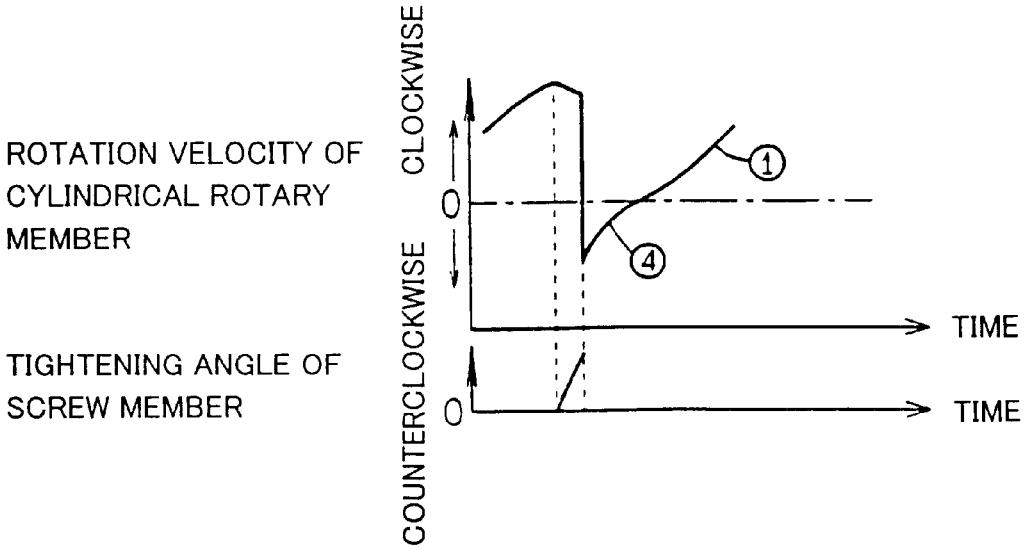
Figure 14A:
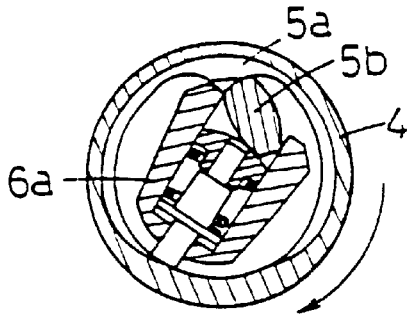
FIGS. 14(*a*)–(*c*) are illustrations illustrating the angle of the cylindrical rotary member with the hammering boss at the time of tightening the screw member.
Figure 14B:
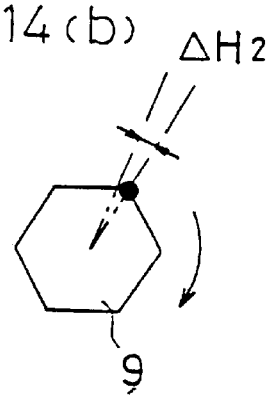
Figure 14C:
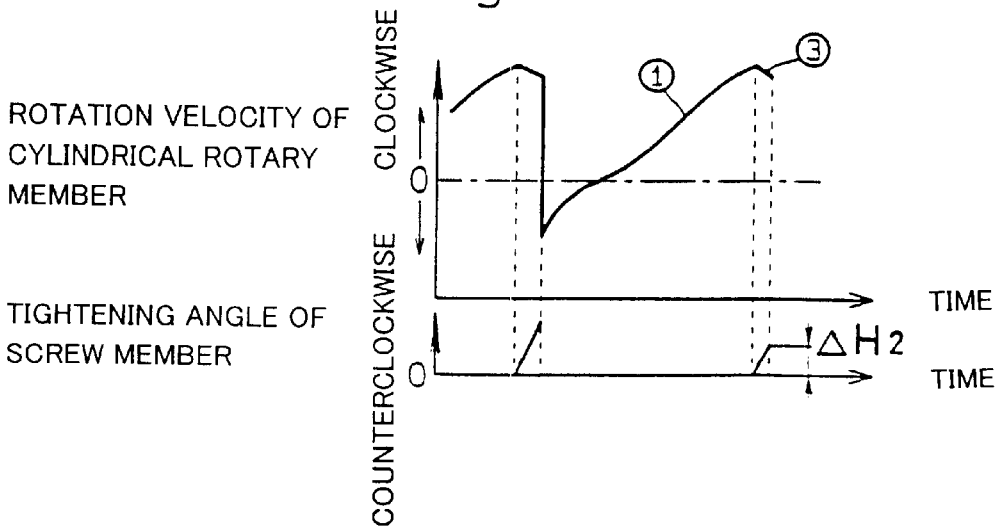

As shown in FIGS. 12(*a*)–(*c*), after the rebound ④ of the cylindrical rotary member 4 gradually decelerates to the stop, the cylindrical rotary member 4 runs free ① again with acceleration in the clockwise direction by the torque from the air motor 2, as shown in FIGS. 13(*a*)–(*c*). Then, the hammering boss 5*a* is brought into collision with the anvil block 5*b*, from the moment of which the rotation velocity of the cylindrical rotary member 4 is decelerated ③, as shown in FIGS. 14(*a*)–(*c*). The rotation angle of the rotary detecting member 7 or the screw tightening angle $\Delta H_2$ of the screw member 9 formed during the deceleration ③ from the start of deceleration to the end of hammering is detected by the rotary detecting member 7 and the detecting sensors 8*a*, 8*b* in the same manner as that mentioned above.

Thereafter, every time when the cylindrical rotary member 4 is decelerated ③ by the hammering after the free running ①, the screw tightening angles $\Delta H$ of the screw member 9 formed during the deceleration ③ from the start of deceleration to the end of hammering are integrated in sequence by the central processing part 13 in the same manner. Then, when the integrated angle of the screw tightening angles reaches a preset screw tightening angle of the screw member 9, the rotation angle signal outputting part 14 outputs signals to the solenoid valve controlling part 16 through the completed screw tightening detecting part 15, to stop the solenoid valve 19 via the output circuit 17. This operation can also be realized by use of a logical circuit or software.

Thus, the screw tightening angle of the screw member 9 is determined by detecting the deceleration of the cylindrical rotary member 4 after the hammering and the rotation angle of the rotary detecting member 7 formed during the time from the start of deceleration to the end of hammering (the start of rebound). For example, when the hammering is provided 20 times until a preset screw tightening angle (e.g. 50°) is formed; the working time from the start to the end is 1 sec.; and the average time for the cylindrical rotary member 4 to decelerate every time the hammering is provided is 0.001 sec., it follows that the total time for the screw member 9 to be tightened is 0.001×20=0.02 sec. It follows from this that even if a wobbling of e.g. 30° is caused in 1 second of screw tightening work, an angle error given to the screw tightening angle is 30°×0.02/1=0.6°, which is very limited (1.2%), as compared with the preset screw tightening angle (50°), and it can be said that the proportion of the error caused by the wobbling is very minute.

The rotation angle of the rotary detecting member 7 during the deceleration of the cylindrical rotary member 4 may be detected by a different method than the method mentioned above. Specifically, the rotation angle formed when the rotary detecting member 7 is rotated in the tightening direction only or the free running angle formed every time the cylindrical rotary member 4 rotates in the tightening direction, and the rotation angle formed when it rotates in the tightening direction until one screw tightening is completed, including the free running angle, are detected by the detecting sensors.

Figure 16:
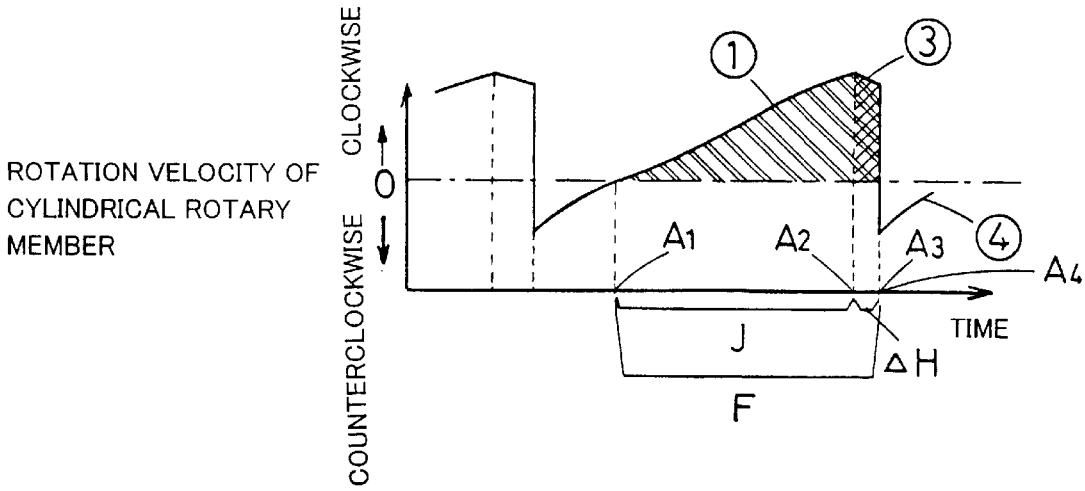
FIG. 16 is a plot of a velocity in another detecting method.
Figure 17:
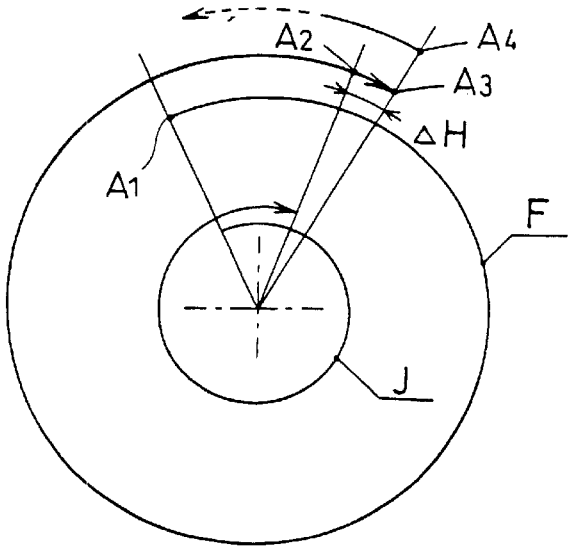
FIG. 17 is a diagram showing a rotational state of the cylindrical rotary member.

FIGS. 16 and 17 illustrate the alternative detecting method. After the cylindrical rotary member 4 gradually accelerates, while running free ① in the clockwise direction, as indicated by an upward-sloped line, the hammering boss 5*a* collides with the anvil block 5*b* and the cylindrical rotary member 4 decelerates ③, as indicated by a downward-sloped line, and rebounds ④. In this process, one screw tightening is provided. When $A_1$ is a starting point of the free running ①; $A_2$ is a point of time at which the hammering is performed (maximum velocity); $A_3$ is a point of time at which the tightening is completed; and $A_4$ is a point of time at which the rebound is started, the rotation of the cylindrical member 4 is represented as shown in FIG. 17.

From FIG. 17, the screw tightening angle (screwing angle) is given by:

$$\Delta H = F - J \qquad \text{Eq. 2}$$

where F is a clockwise rotation angle of the cylindrical rotary member 4 per rotation of the cylindrical rotary member 4, J is a clockwise free running angle of the same per rotation thereof, and ΔH is the screw tightening angle (screwing angle). The screw tightening angle can be calculated by detecting the clockwise rotation angle F and the clockwise free running angle J by use of the rotary detecting member 7 and the detecting sensors 8*a*, 8*b*. In other words the screw tightening angle is calculated by detecting the number of teeth of the rotary detecting member 7 passing through the detecting sensors 8*a*, 8*b*. In this method, even when a wobbling is caused in the course of the detection of the clockwise free running angle J and the clockwise rotation angle F, since the angle of the wobbling generated at a point of time within the free running from the point of time $A_1$ to the point of time $A_2$ is included in both of those angles, the angle of wobbling is balanced out in both of the angles. Thus, even when the wobbling occurs, since the influence is limited to only a very short time (from the point of time $A_2$ to the point of time $A_3$) during which the screw member 9 is tightened by the driven shaft 6, it is at a substantially negligible level, and as such, the screw tightening work can be performed with little error.

Next, an impulse wrench that is structured so that the rebound is not produced at the time of hammering or torque impulse will be described as another example of the hand-held powered wrench used in the present invention.

Figure 18:
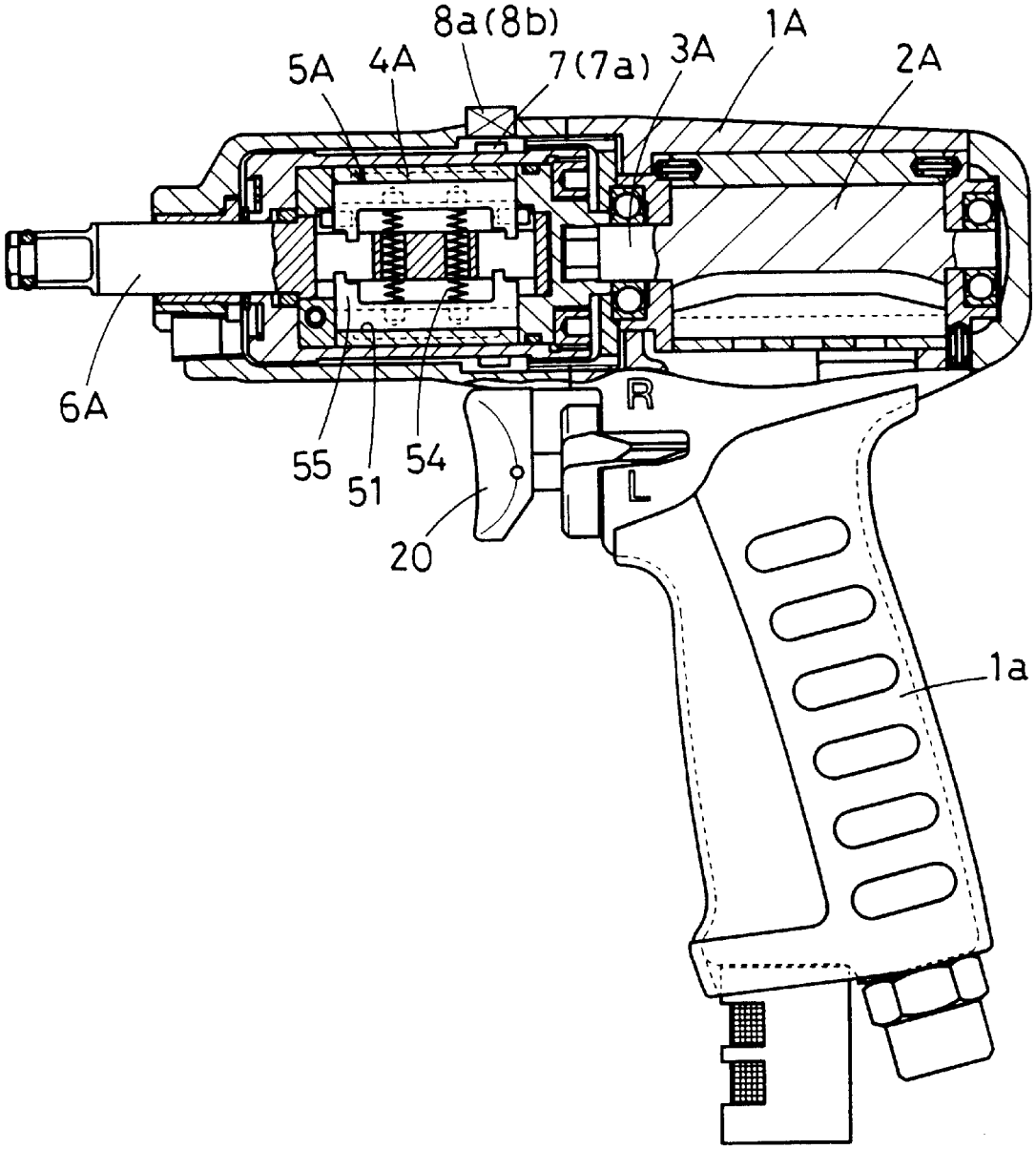
FIG. 18 is an illustration illustrating a structure of an impulse wrench used in an embodiment of the present invention.
Figure 19:
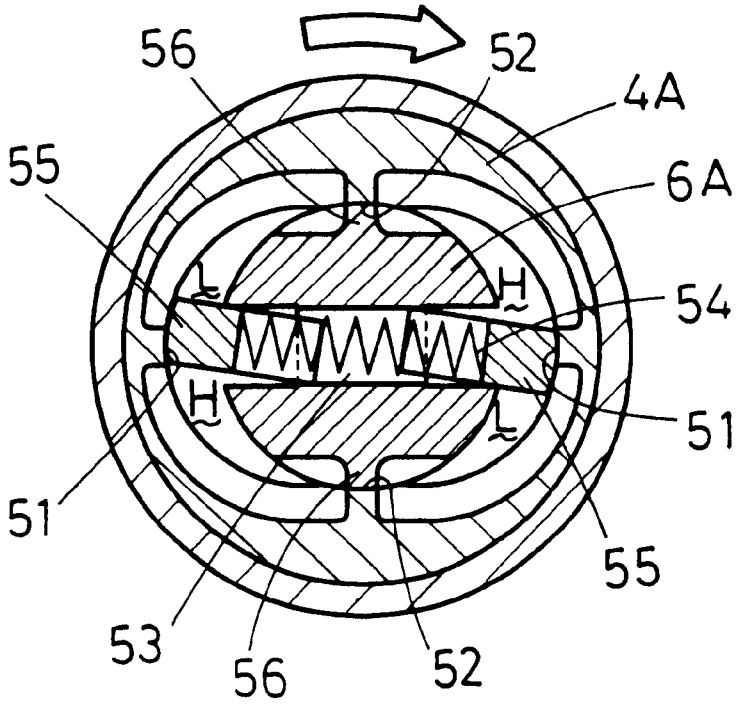
FIG. 19 is a sectional view of a principal part of the same impulse wrench.

Shown in FIGS. 18 and 19 is an embodied form of the impulse wrench. The impulse wrench is provided with an air motor 2A in an interior of a casing 1A at the rear portion thereof having an integrally provided grip portion 1*a* in the bottom. A center portion of a rear wall panel of an oil cylinder 4A is integrally coupled with a front end portion of a rotational driving shaft 3A of the air motor 2A via their fitted structure comprising a hexagonal projection and a complementary depression.

The impulse wrench is one embodied form of the hand-held powered wrench and is a tool designed for both screw tightening and screw loosening. The air motor 2A is one embodied form of the torque generating means. The oil cylinder 4A is one embodied form of the rotary member.

The air motor 2A is structured to revolve at high velocity in a clockwise direction or counterclockwise direction by compressed air fed thereto from outside through an air feed passage (not shown) arranged in the gripping portion 1*a* by a switching operation of a control lever 20 and a selector valve (not shown), as in the same manner as the impact wrench.

The torque of the oil cylinder 4A, which is rotated together with the driving shaft 3A of the air motor 2A, is transmitted to a driven shaft 6A having a front end projecting forward from a front end of the casing 1A and, in turn, to a socket (not shown) attached to the front end of the driven shaft 6A, through a hammering force transmission mechanism 5A arranged in the oil cylinder 4A, so as to tighten a screw member fitted to the socket.

The hammering force transmission mechanism 5A has sealing surfaces 51, 51, 52, 52 formed at a plurality of locations (four locations in the Figure) in the inner periphery of the oil cylinder 4A, as shown in FIG. 19. On the other hand, the driven shaft 6A side has a blade insertion groove 53 in which at least one blade 55 (two blades are shown in the diagram), which is always put in contact with the inner periphery of the oil cylinder 4A by an elastic force of a spring 54, is received in a radially retractable manner. The rotation of the oil cylinder 4A brings the blades 55 and projected portions 56, 56 projecting from the driven shaft 6A with different phases of 180° into close contact with their respective sealing surfaces 51, 52 in a oil-tight manner. When the oil cylinder 4A is rotated slightly from this state, a low pressure chamber L and a high pressure chamber H are produced by oil in the oil cylinder 4A between the neighboring sealing surfaces 51 and 52. The differential pressure therebetween permits the hammering torque to be transmitted to the driven shaft 6A side-through the both blades 55, 55, so as to generate the tightening force in the same rotation direction as that of the oil cylinder 4A.

The hammering force transmission mechanism 5A is one embodied form of the torque transmission mechanism. While in this example the high-pressure chamber H is formed once for each rotation of the oil cylinder 4A, it may be formed twice for each rotation of the oil cylinder 4A.

In the impulse wrench thus constructed, the rotary detecting member 7 comprising a gear having a predetermined number of teeth 7*a* is fixedly mounted to the outer periphery of the oil cylinder 4A so as to be integral therewith.

On the other hand, the pair of detecting sensors 8*a*, 8*b* comprising semi-conducting magneto-resistive elements are mounted around an inner periphery of the non-revolving casing 1A so as to confront the rotary detecting member 7, leaving a given circumferential space therebetween. As the control circuit for the signals generated by the rotation of the rotary detecting member 7 to be transmitted from the input circuit to the solenoid valve is identical to that of the impact wrench mentioned above, the description thereof is omitted.

Now, a description of the method of reading a rotation angle of a screw member, such as a bolt and nut, by the impulse wrench thus constructed will be given below. A screw member 9 to be tightened is fitted to the socket mounted on the front end portion of the driven shaft 6A and a predetermined screw tightening angle is previously input to the completed screw tightening detecting part 15. Then, when the control lever 20 is pressed to feed compressed air to the impulse wrench, so as to rotate the air motor 2A in the screw tightening direction (in the clockwise direction for the right-hand screw member), the driving shaft 3A and the oil cylinder 4A are rotated together. This rotation is transmitted to the driven shaft 6A through the hammering force transmission mechanism 5A to cause the oil cylinder 4A and the driven shaft 6A to rotate together, so as to rotatively propel the screw member 9 at high velocity in the screw tightening direction.

When the screw member 9 is seated on a bearing surface, a resistance torque (load) is generated at the driven shaft 6A, which causes rotation of the driven shaft 6A to decelerate rapidly to a near stop, while on the other hand, the oil cylinder 4A is rotated in the tightening direction at a accelerated rate by a driving torque from the air motor 2A side. After the blades 55 and the projected portions 56 are again brought into close contact with the sealing surfaces 51, 52 in the oil-tight manner, respectively, the high pressure chamber H is produced to transmit the rotational tightening force to the driven shaft 6A side with impact, so as to rotate the driven shaft 6A in the tightening direction by a certain angle.

At this time, the oil cylinder 4A starts decelerating through the oil-tight contact with the driven shaft side and, in the middle of deceleration, the rotation angle of the oil cylinder 4A, or the screw tightening angle of the screw member 9 through the driven shaft 6A, is detected by the rotary detecting member 7 and the detecting sensors 8*a*, 8*b*, as mentioned later.

Figure 20A:
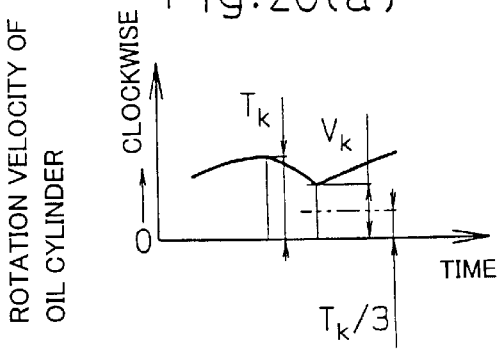
FIG. 20 is a plot illustrating the operation of the same impulse wrench.
Figure 20B:
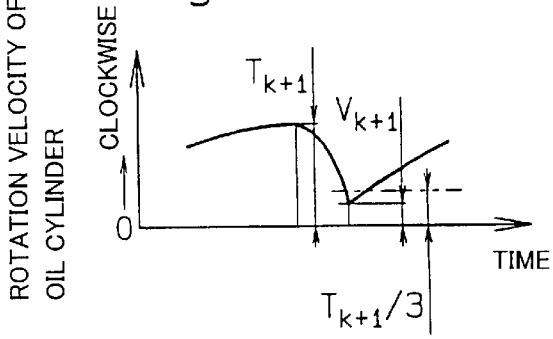

The screw tightening angle of the screw member 9 is measured in the middle of deceleration of the oil cylinder 4A. Though the deceleration is also caused before the screw member 9 is seated on the bearing surface, the deceleration of the oil cylinder 4A before the screw member 9 is seated is not included in the screw tightening angle of the screw member 9. The judgment on whether the screw member 9 is seated or not is performed in the manner as shown in FIGS. 20(*a*) and (*b*). Specifically, before the screw member 9 is seated, some acceleration and deceleration is generated in the rotation velocity of the oil cylinder 4A, as shown in FIG. 20(*a*). In the rotation of the oil cylinder 4A, a value $T_k$ obtained when the rotation velocity becomes maximum and a value $V_k$ obtained when the rotation velocity becomes subsequently minimum are detected.

When the minimum value $V_k$ of rotation velocity is over a preset lower limit (e.g. ⅓ of the maximum value $T_k$ of rotation velocity), in other words, when only a slight deceleration is generated, the screw member 9 is judged to not yet be seated, so that this slightly decelerated rotation of the oil cylinder 4A is not used for the calculation of the screw tightening angle of the screw member 9.

When the screw member 9 is seated, the difference between the maximum value $T_{k+1}$ and the subsequent minimum value $V_{k+1}$ of the rotation velocity of the oil cylinder 4A becomes significant, as shown in FIG. 20(*b*). When the minimum value $V_{k+1}$ is under a preset lower limit (e.g. ⅓ of the maximum value $T_{k+1}$ of rotation velocity), in other words, when a significant deceleration is generated, the screw member 9 is judged to be already seated, so that this significantly decelerated rotation of the oil cylinder 4A is used for the calculation of the screw tightening angle of the screw member 9.

A point of time when the rotation velocity becomes maximum is detected in the same manner as that described on FIG. 15. Also, a point of time when the rotation velocity becomes minimum is detected in the same manner as that described on FIG. 15. Specifically, in this embodiment, the width of the pulse signals detected by the detecting sensors 8*a*, 8*b* gradually broadens to the maximum and thereafter, gradually narrows. The point of time at which the width of the pulse signal became maximum before it starts gradually narrowing is judged as the point of time when the rotation velocity of the oil cylinder 4A became minimum.

The screw member is tightened when the oil cylinder 4A is in the middle of significant decelerating, as mentioned above. The detection and calculation of the screw tightening angle in the middle of that deceleration will be described below.

Figure 21A:
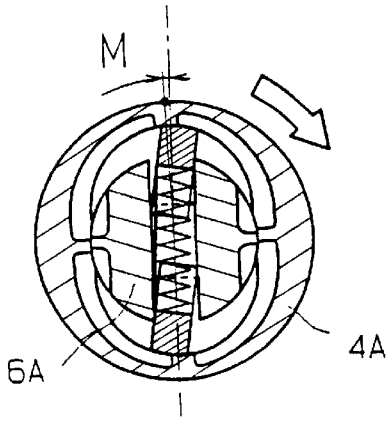
FIG. 21 is an illustration with a sectional view of a principal part of the same impulse wrench.
Figure 21B:
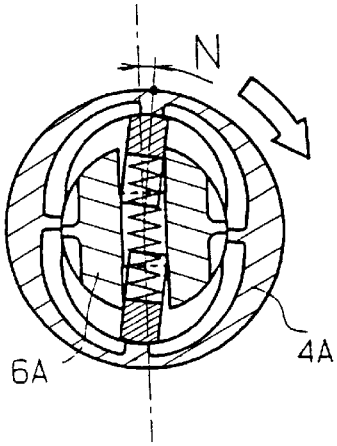

The oil-tight state is produced when the oil cylinder 4A inclines rearwards at a certain angle M to the driven shaft 6A, and the oil-tight state is released when the oil cylinder 4A inclines forward at a certain angle N thereto, as shown in FIGS. 21(*a*) and (*b*). These angles M, N are the angles determined in the design of the impulse wrench, and the interrelation between these angles is formed even when the oil cylinder 4A and the driven shaft 6A rotate together in the middle of the oil-tight state to tighten the screw member 9.

Figure 22:
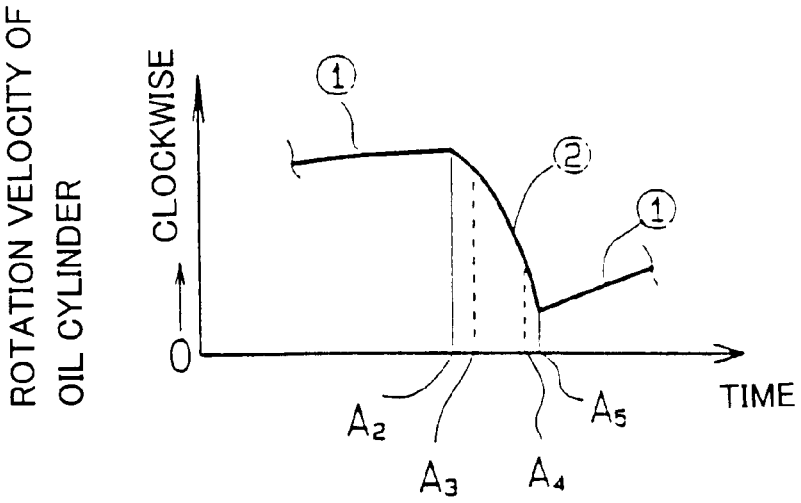
FIG. 22 is a plot illustrating the operation of the same impulse wrench.

Description of the rotation of the driven shaft 6A in the middle of the deceleration of the oil cylinder 4A will be given with reference to FIGS. 22 and 23.

At $A_2$, the oil-tight state is produced by the oil cylinder 4A and the driven shaft 6A, and the oil cylinder 4A starts decelerating. At this time, the driven shaft 6A is kept in its halted condition. From that point of time, the oil cylinder 4A starts compressing oil. When the oil cylinder rotates at the angle M to correspond in phase to the driven shaft 6A, first, and then rotates further at an angle $g_1$ to compress the oil, an impact torque exceeding the load torque of the driven shaft 6A is generated. From this point of time $A_3$, the oil cylinder 4A and the driven shaft 6A rotate together at an identical angle $\Delta G_1$, respectively, while keeping the angular phase difference $g_1$. A magnitude of the angular phase difference $g_1$ varies in accordance with the load torque of the driven shaft 6A side. The angle is small in an early stage of the seating of the screw member 9, and it increases as the tightening of the screw member 9 proceeds.

Figure 23:
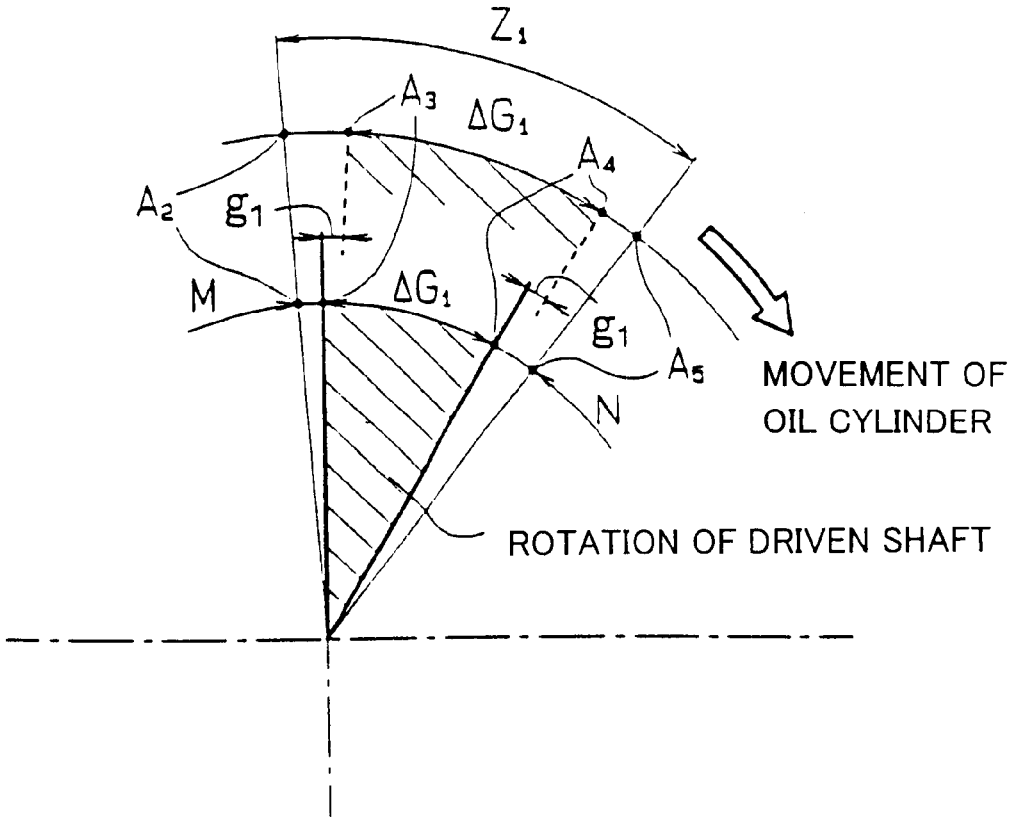
FIG. 23 is a diagram showing a rotational state of a driven shaft and an oil cylinder of the same impulse wrench.

While the angular phase difference $g_1$ is represented by an angle formed with respect to the screw tightening direction (clockwise rotation angle) in FIG. 23, there may be cases where the angle $g_1$ is zero or its absolute value is a negative value smaller than M.

In other words, there may be cases where at the point of time when or before the oil cylinder 4A and the driven shaft 6A correspond in phase to each other after the oil-tight state is produced, the oil cylinder 4A and the driven shaft 6A rotate together.

At the point of time $A_4$ when the load torque at the driven shaft 6A side increases so much so as to exceed the impact torque generated by the differential pressure between the high pressure chamber H and the low pressure chamber L produced in the interior of the oil chamber 4A, the driven shaft 6A stops rotating and the oil cylinder 4A remains rotating with deceleration until a point of time $A_5$ at which the oil-tight state is released.

At the point of time $A_4$, the oil cylinder 4A is in a phase that is advanced by the angle $g_1$ than that of the driven shaft 6A. Accordingly, the oil cylinder 4A is just required to rotate at an angle $(N-g_1)$ until a point of time $A_5$ at which the oil-tight state is released.

Thus, after rotating at an angle $(M+g_1)$ in the angle $Z_1$ ranging from the point of time $A_2$ to the point of time $A_5$ that can be detected by the above-mentioned method, the oil cylinder 4A is rotated together with the driven shaft 6A at the angle $\Delta G_1$. Thereafter, only the oil cylinder 4A is rotated further at the angle $(N-g_1)$.

A total sum of these angles is the rotation angle $Z_1$ of the oil cylinder 4A ranging from the point of time $A_2$ to the point of time $A_5$, which is expressed by:

$$Z_1=(M+g_1)+\Delta G_1+(N-g_1)=M+N+\Delta G_1 \quad \text{Eq. 3}$$

As mentioned above, the angles M and N are the values that can be determined in design. Where δ is the sum of these angles, the rotation angle of the driven shaft 6A from the point of time $A_2$ to the point of time $A_5$, in other words, the screw tightening angle $\Delta G_1$ of the screw member 9, can be determined by subtracting the sum of the angles δ from the rotation angle $Z_1$ of the oil cylinder 4A ranging from the point of time $A_2$ to the point of time $A_5$.

Figure 24A:
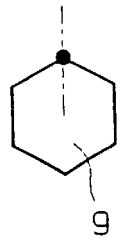
FIGS. 24(*a*) and (*b*) are illustrations illustrating detection of a screw tightening angle of the same impulse wrench.
Figure 24B:
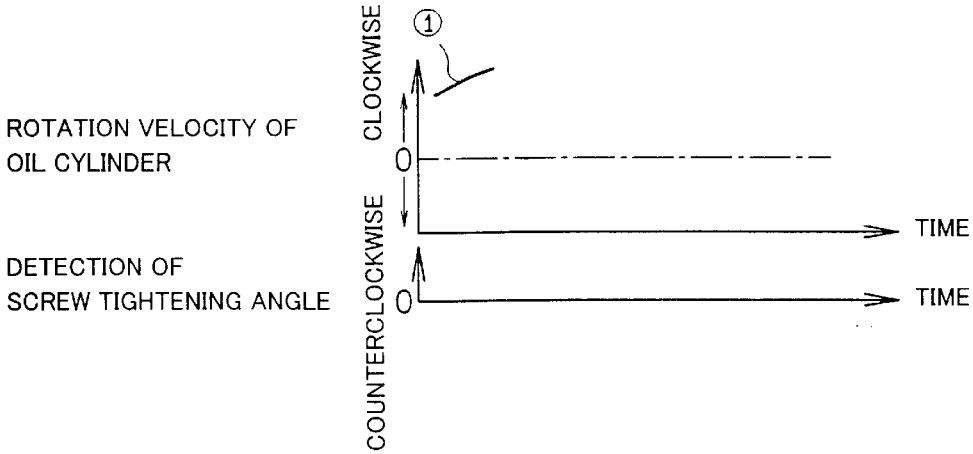

Referring now to FIGS. 24(*a*)–30(*b*), description will be given of the concrete method of detecting the screw tightening angle of the screw member 9 defined by the driven shaft 6A by use of the rotary detecting member 7 and the detecting sensors 8*a*, 8*b*.

In each of the FIGS. 24(*a*)–30(*b*), (*a*) is an illustration of the screw tightening angle of the screw member 9 and (*b*) is a diagram plotting a time shift in detecting the rotation velocity of the oil cylinder 4A and the screw tightening angle of the screwing member 9 every time the hammering is provided. The direction for the screw member 9 to be tightened illustrated in the diagrams is a clockwise direction.

Figure 25A:
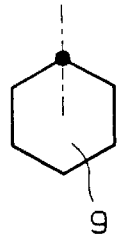
FIGS. 25(*a*) and (*b*) are illustrations illustrating the detection of the screw tightening angle of the same impulse-wrench.
Figure 25B:
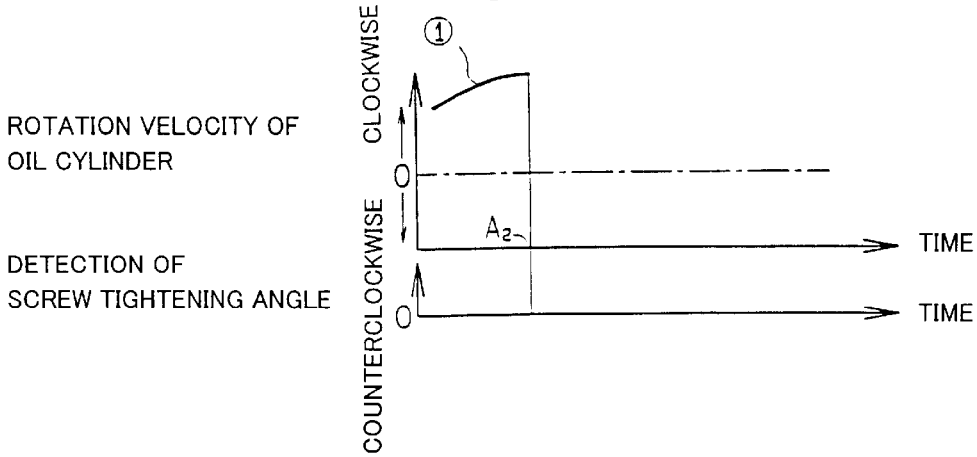

FIGS. 24(*a*) and (*b*) are diagrams showing the state in which the oil cylinder 4A runs freely with acceleration. In this state, the oil cylinder 4A rotates in the clockwise direction with acceleration, as depicted by an upward-sloping line in the diagram. After the oil cylinder 4A runs free, the blades 55 and the projected portions 56 come into close contact with the sealing surfaces 51, 52 in the oil-tight manner, respectively, at the moment at which the velocity of the free running becomes maximum, as shown in FIGS. 25(*a*) and (*b*). From that point of time $A_2$, compression of the oil is started.

Figure 26A:
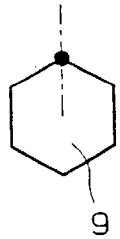
FIGS. 26(*a*) and (*b*) are illustrations illustrating the detection of the screw tightening angle of the same impulse wrench.
Figure 26B:
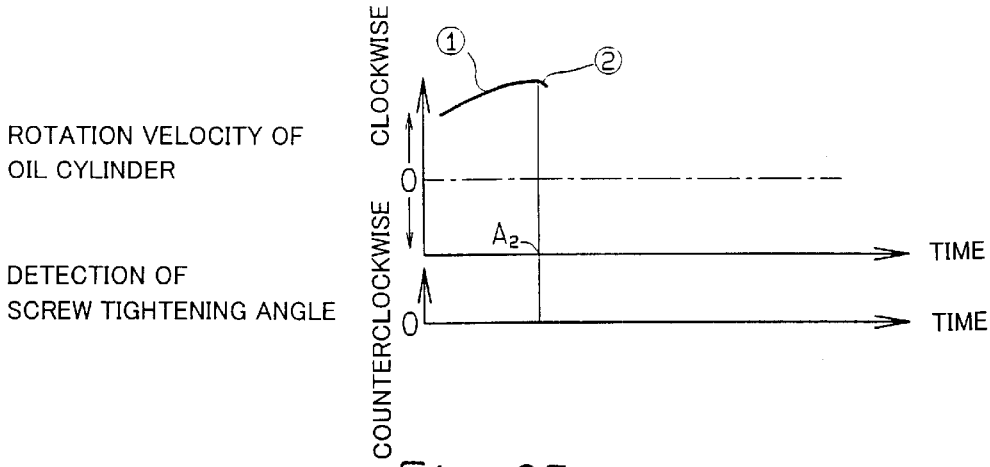

When the oil is compressed, the oil cylinder 4A is decelerated, as depicted by a downward-sloping line ② in FIGS. 26(*a*) and (*b*). In the early stage of the deceleration, the torque for urging the driven shaft 6A to rotate through the both blades 55, 55 by means of the differential pressure between the high pressure chamber H and the low pressure chamber L is smaller than the torque on the load side, so that the driven shaft 6A and the screw member 9 are kept in their stationary state.

Figure 27A:
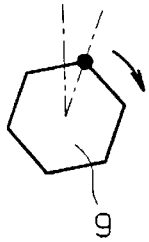
FIGS. 27(*a*) and (*b*) are illustrations illustrating the detection of the screw tightening angle of the same impulse wrench.
Figure 27B:
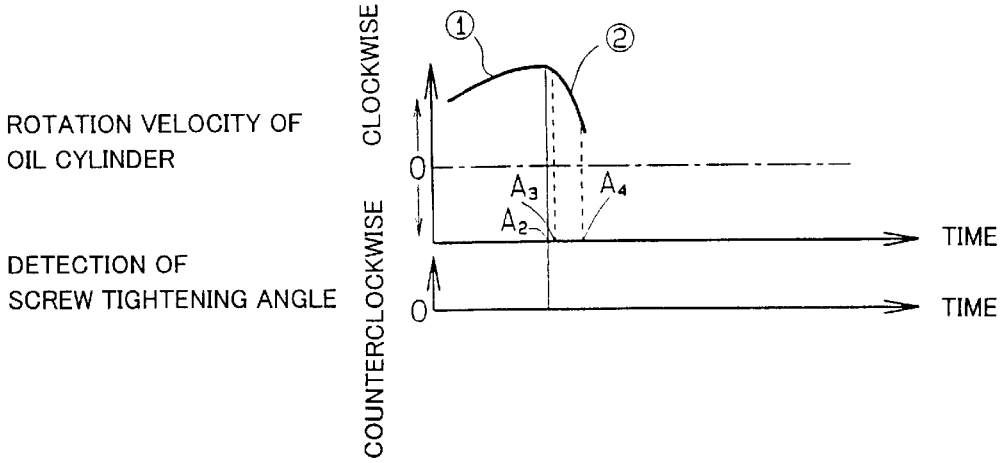
Figure 28A:
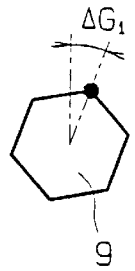
FIGS. 28(*a*) and (*b*) are illustrations illustrating the detection of the screw tightening angle of the same impulse wrench.
Figure 28B:
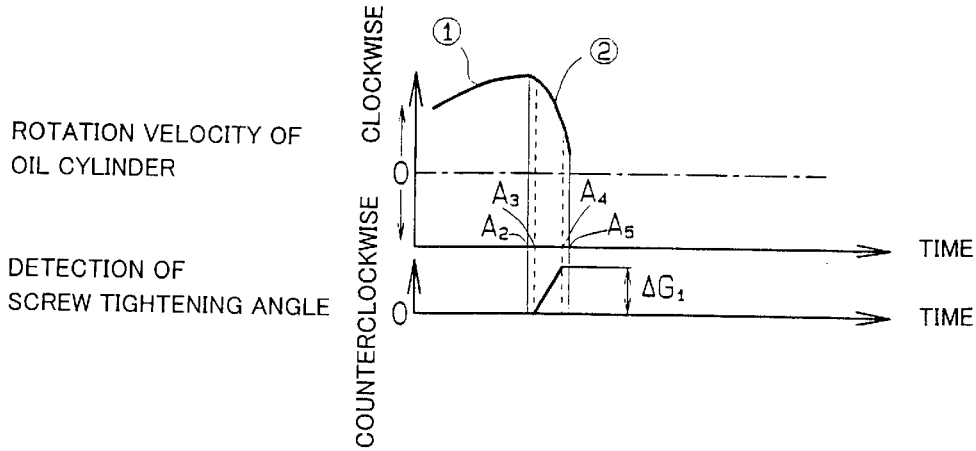

As shown in FIGS. 27(*a*) and (*b*), the oil cylinder 4A rotates further with deceleration, to compress the oil further, at a point of time $A_3$ of which the impact torque applied to the driven shaft 6A via the differential pressure between the high pressure chamber H and the low pressure chamber L exceeds the torque on the load side. From that point of time, the oil cylinder 4A and the driven shaft 6A cooperate to tighten the screw member 9 at a certain angle, while maintaining the phase difference in angle therebetween. After the screw member 9 is tightened up, the torque on the load side is higher than the impact torque applied to the driven shaft 6A via the differential pressure between the high pressure chamber H and the low pressure chamber L, so that the driven shaft 6A is stopped at a point of time $A_4$, while the oil cylinder 4A is rotated with deceleration to a point of time $A_5$ at which the oil-tight state is released, as shown in FIGS. 28(*a*) and (*b*).

Figure 29A:
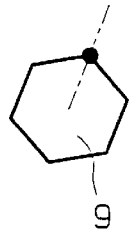
FIGS. 29(*a*) and (*b*) are illustrations illustrating the detection of the screw tightening angle of the same impulse wrench.
Figure 29B:
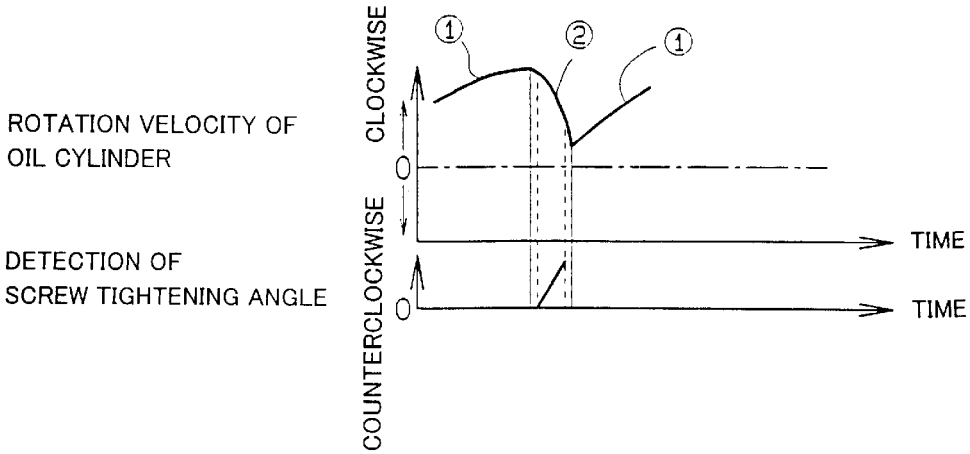
Figure 30A:
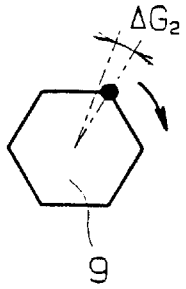
FIGS. 30(*a*) and (*b*) are illustrations illustrating the detection of the screw tightening angle of the same impulse wrench.
Figure 30B:
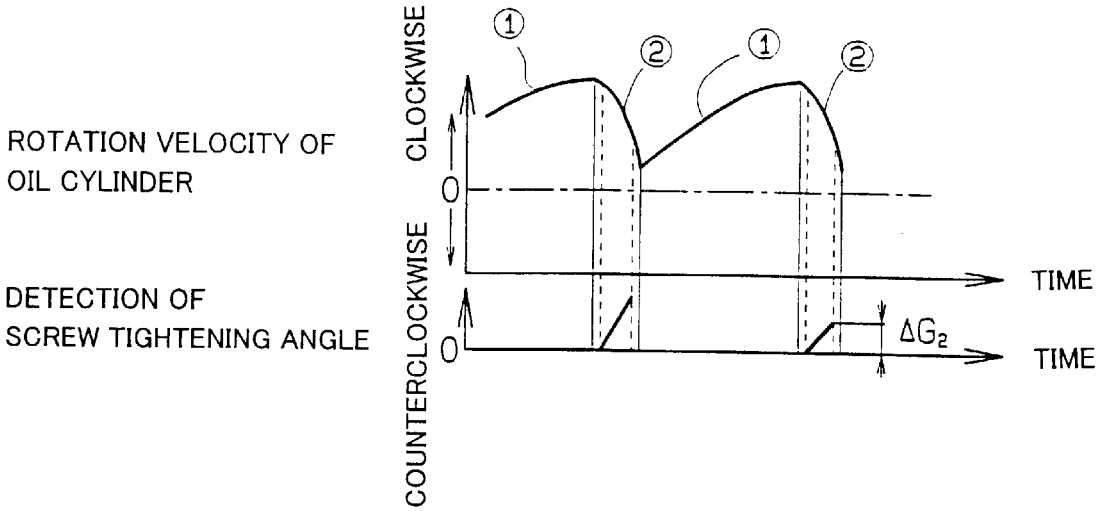

After a point of time of $A_5$, the oil-tight resistance is eliminated from the oil cylinder 4A, so that the oil cylinder restarts the free running ① with acceleration, as shown in FIGS. 29(*a*) and (*b*). Then, the oil cylinder 4A is put into the oil-tight contact with the driven shaft 6A again and is decelerated ②, as shown in FIGS. 30(*a*) and (*b*). In the middle of the deceleration, the oil cylinder 4A and the driven shaft 6A re-cooperate to tighten the screw member 9 at a certain angle, while maintaining the angular phase difference therebetween. Thereafter, the oil cylinder 4A is decelerated until the oil-tight state is released.

The rotation angle of the driven shaft 6A in the middle of deceleration of the oil cylinder 4A, i.e., the rotation angle of the screw member 9, is an angle formed in the period from the point of time $A_3$ to the point of time $A_4$. The screwing angle $\Delta G_1$ of the screw member 9 in this period is calculated as the angle $(Z_1-\delta)$ after the angle $Z_1$ is detected in the above-mentioned manner.

Subsequently, the same process is taken so that the oil cylinder 4A runs freely and decelerates, and the screw member 9 is tightened in the middle of the deceleration. The screw tightening angle ΔG formed in the middle of the deceleration is integrated by the central processing part 13. When the integrated value of the screw tightening angle reaches a preset screw tightening angle of the screw member 9, signals are output from the rotation angle signal outputting part 14 to the solenoid valve controlling part 16 through the completed screw tightening detecting part 15, to stop the solenoid valve 19 via the output circuit 17.

In addition to the method mentioned above, the detection of the rotation angle of the driven shaft 6A formed in the middle of deceleration of the oil cylinder 4A by use of the rotary detecting member 7 can be performed by another method where the free running angle formed every time the oil cylinder 4A rotated in the screw tightening direction and the rotation angle formed until the completion of each deceleration, including the free running angle, are detected by the detecting sensors.

Figure 31:
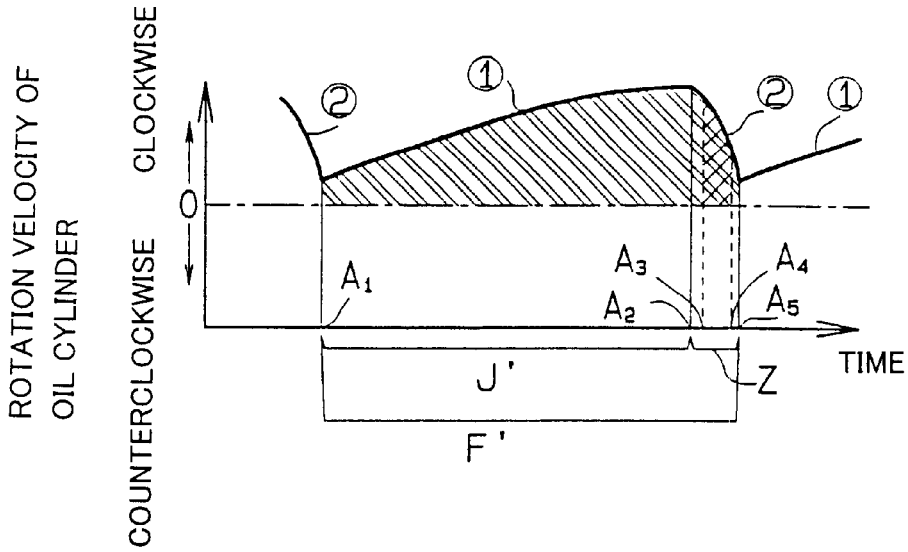
FIG. 31 is an illustration illustrating the detection of the screw tightening angle of the same impulse wrench in another method.
Figure 32:
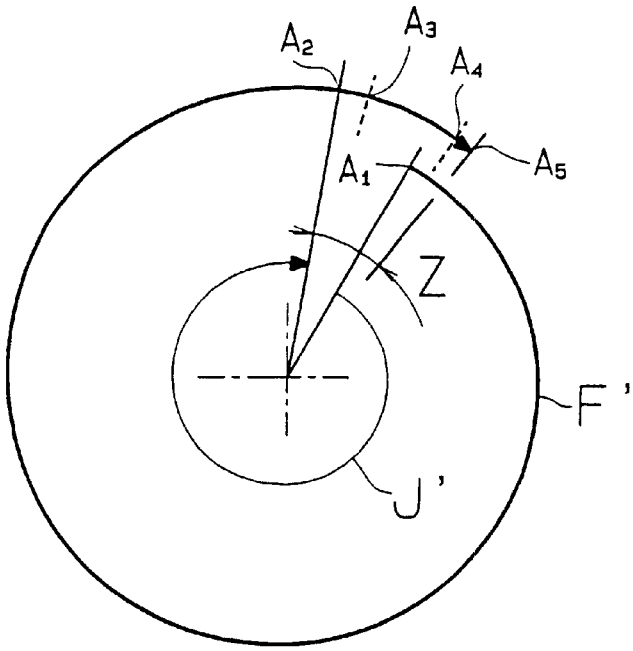
FIG. 32 is an illustration illustrating the detection of the screw tightening angle of the same impulse wrench in another method.

FIGS. 31, 32 are illustrations of the detecting method. After running free ① with acceleration, as indicated by an upward-sloped line, the oil cylinder 4A comes into the oil-tight state with the driven shaft 6A and decelerates ② to perform one screw tightening in the middle of the deceleration, as indicated by a downward-sloped line. The state of rotation of the oil cylinder 4A is represented as shown in FIG. 32, where $A_1$ is a starting point of the free running ①, $A_2$ is a point of time at which the oil-tight is produced (maximum velocity), $A_3$ is a point of time at which the screwing is started, $A_4$ is a point of time at which the screwing is stopped, and $A_5$ is a point of time at which the deceleration of the oil cylinder 4A is ended and the next acceleration is started.

From FIG. 32, the screw tightening angle (screwing angle) is given by:

$$\Delta G=Z-\delta=(F'-J')-\delta \quad \text{Eq. 4}$$

where F' is a clockwise rotation angle per cycle of the oil cylinder 4A, J' is a clockwise free running angle per rotation of the same, Z is a deceleration angle of the oil cylinder 4A, and ΔG is the screw tightening angle (screwing angle).

The screw tightening angle is calculated by detecting the clockwise rotation angle F' and the clockwise free running angle J' by use of the rotary detecting member 7 and the detecting sensors 8*a*, 8*b*. In this method, even when a wobbling is caused in the course of the detection of the clockwise free running angle J' and the clockwise rotation angle F', since the angle of the wobbling generated at a point of time within the free running from the point of time $A_1$ to the point of time $A_2$ is included in both of those angles, the angle of wobbling is balanced out by both of the angles. Thus, even when the wobbling occurs is, since the influence is limited to only a very short time (from the point of time $A_2$ to the point of time $A_5$) during which the oil cylinder 4A decelerates, it is a substantially negligible level, and as such, the screw tightening work can be performed with little error.

In the following, description will be given of the method of detecting the degree of generation of the wobbling, for the purpose of evaluating the tightening work.

For the study of an actual quality of the practical work, it is necessary to confirm reliability of the screw tightening work and accordingly it is necessary to grasp the degree of wobbling in the screw tightening work.

Reference will be first given to an impact wrench designed to generate the rebound.

Figure 33:
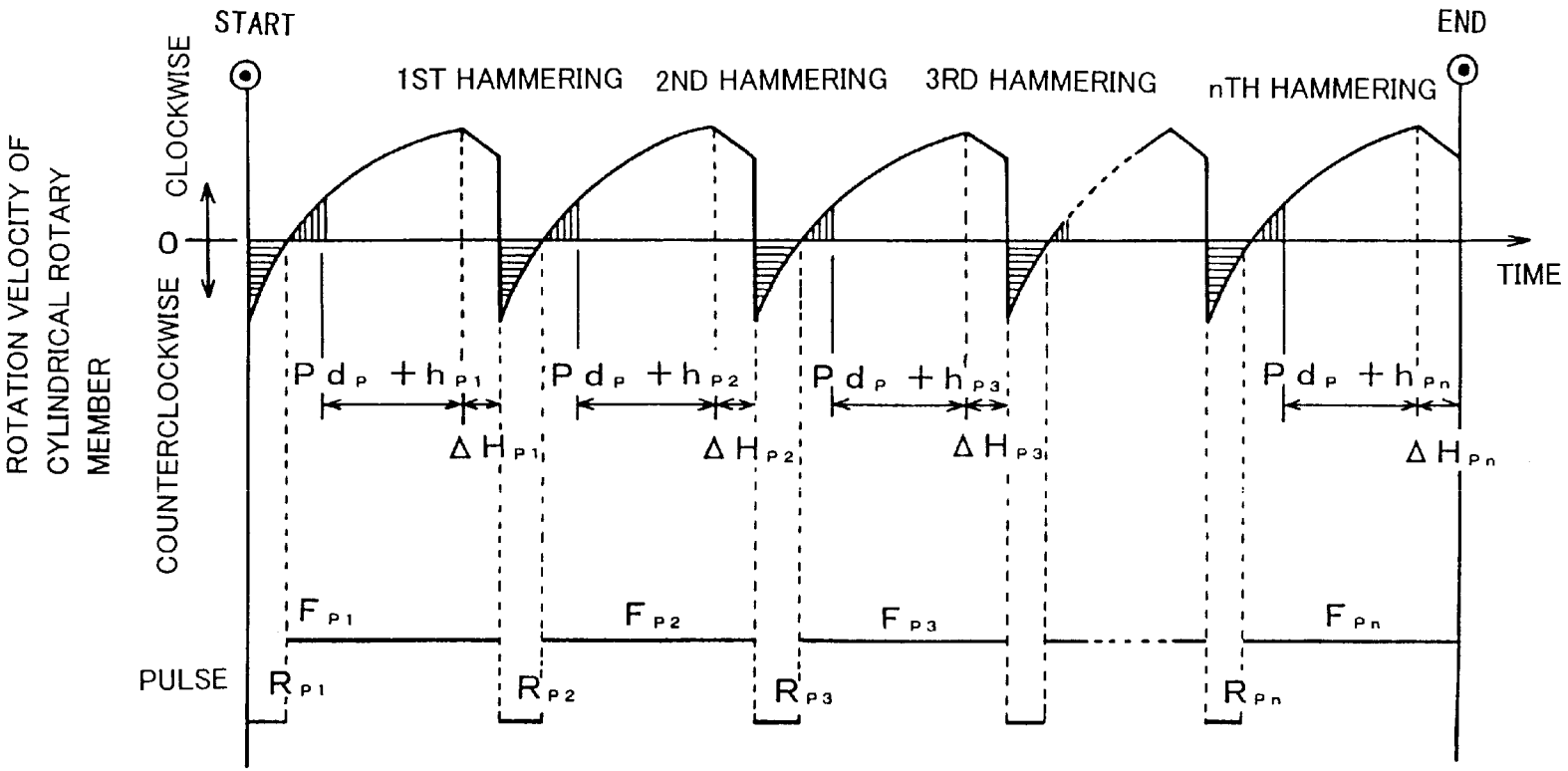
FIG. 33 is a plot of a velocity in the method of detecting a wobbling in the impact wrench.

In this type of impact wrench, as shown in FIG. 33, when the cylindrical rotary member 4 provides one hammering per rotation of the same, the number of pulses detected in accordance with and derived from the rotation angle in one cycle from one hammering to the next hammering, in other words, the number of pulses obtained by subtracting the number of pulses ($R_p$) corresponding to the rebound angle from the number of pulses ($F_p$) corresponding to the rotation angle in the tightening direction, are the sum of the number of pulses per rotation with no wobbling (which is expressed by $Pd_p$, the number of pulses corresponding to 360 degrees in this case), the number of pulses ($\Delta H_p$) corresponding to the tightening angle and the number of pulses ($h_p$) generated by the wobbling. The number of pulses ($h_p$) generated by the wobbling can take any one of a positive value, a negative value and zero, depending on the direction of the wobbling, as mentioned later.

The number of pulses detected and derived from the rotation of the cylindrical rotation member from the start to the end of the screw tightening work (which is called the total number of pulses, which is represented as a value obtained by subtracting the cumulative total number of pulses ($R_p$) of the opposite direction to the screw tightening direction from the cumulative total number of pulses ($F_p$) in the tightening direction) can be expressed as the sum of the cumulative total number of pulses corresponding to the actual screw tightening angle (which is represented as $\Delta H_p$, which is called the number of advance pulse angle), the cumulative total number of design pulses ($Pd_p$) preset under design corresponding to the number of hammerings until the end of work (=the number of design pulses×the number of hammering n), and the cumulative total number of wobbling pulses ($h_p$) corresponding to the wobbling angle until the end of work. The number of design pulses is a characteristic value prescribed for the concerned impact wrench. In a case of the wrench where the cylindrical rotary member provides the m number of hammerings per rotation of the same, the number of design pulses is the number of pulses corresponding to an angle of 360°/m. In a case of the wrench where the cylindrical rotary member 4 provides one hammering per rotation of the same, the number of design pulses is the number of pulses corresponding to the angle of 360°. In a case of the wrench where the cylindrical member provides two hammerings per rotation of the same, the number of design pulses is the number of pulses corresponding to the angle of 180°.

Total number of pulses=the cumulative total number of advance pulses+the cumulative total number of design pulse+the cumulative total of wobbling pulses. Eq. 5

Figure 34:
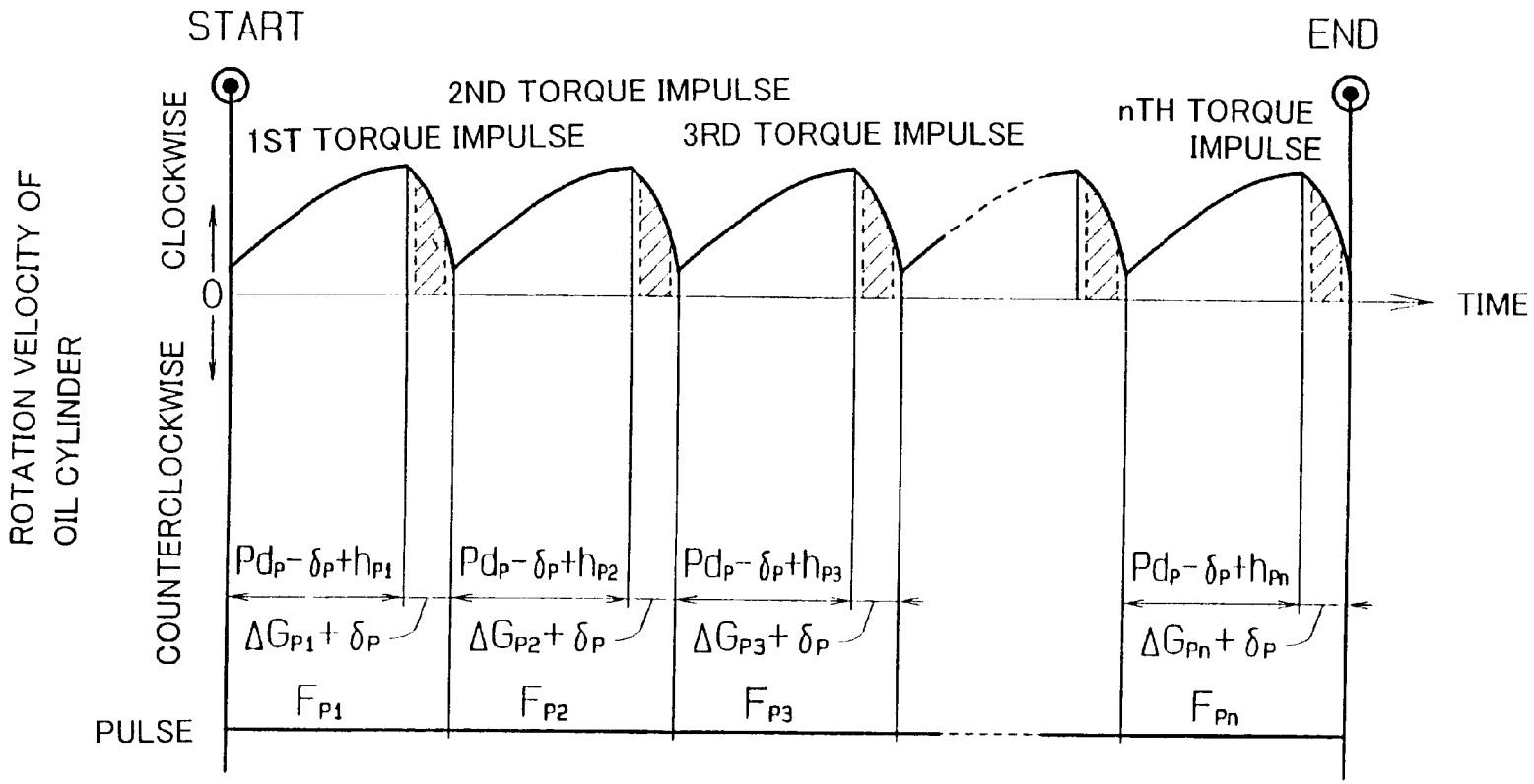
FIG. 34 is a plot of a velocity in the method of detecting a wobbling in the impulse wrench.

Second, reference is given to an impact wrench designed not to generate the rebound with reference to FIG. 34.

In the case of the wrench where the oil cylinder 4A provides one hammering per rotation of the same, the number of pulses detected in accordance with and derived from the rotation angle in one cycle from the starting point of acceleration of the oil cylinder 4A of rotary member to the end of deceleration is represented as the sum of the number of pulses obtained by subtracting the number of pulses corresponding to the angle δ (the sum of the angles M and N shown in FIG. 23) from the number of pulses per rotation without any wobbling (which is expressed by $Pd_p$, the number of pulses corresponding to 360° in this impact wrench case), the number of pulses generated by the wobbling, and the number of pulses detected at the deceleration of the oil cylinder 4A. The number of pulses detected at the deceleration of the oil cylinder 4A is the sum of the number of pulses corresponding to the screw tightening angle (which is called the number of advance pulses) and the number of pulses corresponding to the angle δ. In short, the number of pulses corresponding to the rotation angle in one cycle of the oil cylinder 4A can be represented by:

The number of pulses corresponding to the rotation angle in one cycle=($Pd_p$−the number of pulses corresponding to δ)+the number of wobbling pulses+(the number of advance pulses+the number of pulses corresponding to δ)=$Pd_p$+the number of wobbling pulses+the number of advance pulses Eq. 6

Thus, as shown in the following Equation 7, the number of pulses detected and derived from the rotation of the oil cylinder 4A during the period from the start to the end of the screw tightening work (which is called the total number of pulses) can be expressed as a total sum of the cumulative total number of pulses corresponding to the actual screw tightening angle, or of advance pulses, (which is represented as $\Delta G_p$), the cumulative total number of design pulses ($Pd_p$) preset under design corresponding to the number of hammerings until the end of work (=the number of design pulses×the number of hammering n), and the cumulative total number of wobbling pulses ($h_p$) corresponding to the wobbling angle until the end of work.

The number of design pulses indicates the same contents as that in the impact wrench case designed to generate the rebound. In the case of the wrench wherein the oil cylinder 4A provides the in number of hammerings for every one rotation of the same, the number of design pulses is the number of pulses corresponding to an angle of 360°/m.

Overall number of pulses=the cumulative total number of advance pulses+the cumulative total number of design pulses+the cumulative total number of wobbling pulses Eq. 7

The total number of pulses given by Eq. 5 in the rebound-provided impact wrench is the value obtained when the cumulative total number of pulses in the opposite direction to the screw tightening direction is subtracted from the cumulative total number of pulses in the screw tightening direction, as mentioned above. In the no-rebound-provided impact wrench, the overall number of pulses can be treated equally to the total number of pulses by zeroing the cumulative total number of pulses in the opposite direction to the screw tightening direction. Thus, Equation 7 is synonymous with Equation 5, so that the impact wrench with rebound and the impact wrench with no rebound are to be treated equally in respect of a cumulative total number of wobbling pulses and a wobbling rate, as mentioned later.

Since the cumulative total numbers of advance pulses and the total number of pulses are determined from Equation 5 by the rotary detecting member 7 and the detecting sensors 8*a*, 8*b*, as mentioned above, and the number of design pulses are preset, the cumulative total number of the wobbling pulses can be calculated by Equation 8.

Cumulative total number of wobbling pulses=a total number of pulses−a cumulative total number of advance pulses−a cumulative total number of design pulses Eq. 8

The cumulative total number of wobbling pulses takes any of a positive value, a negative value and zero. When the cumulative total number of wobbling pulses is a negative value, that indicates that any one of the following three different cases of wobbling is generated.

① $|\beta w\ (\text{positive})|>|\beta c\ (\text{positive})|$

② $|\beta w\ (\text{negative})|<|\beta c\ (\text{negative})|$

③ βw (positive) and βc (negative) (except the case of the both angles of βw and βc being zero.)

When the cumulative total number of wobbling pulses is a positive value, that indicates that any one of the following three different cases of wobbling is generated.

④ $|\beta w\ (\text{positive})|<|\beta c\ (\text{positive})|$

⑤ $|\beta w\ (\text{negative})|>|\beta c\ (\text{negative})|$

⑥ βw (negative) and βc (positive) (except the case of the both angles of βw and βc being zero.)

Here,

βw (positive): an angle at which the impact wrench including a like impact wrench rotates in the same direction as the screw tightening direction with respect to the thread center. It includes an angle of zero.

βw (negative): an angle at which the impact wrench including a like impact wrench rotates in the opposite direction to the screw tightening direction with respect to the thread center. It includes an angle of zero.

βc (positive): an angle at which the thread center rotates around a point different from its center in the same direction as the screw tightening direction. It includes an angle of zero.

βc (negative): an angle at which the thread center rotates around a point different from its center in the opposite direction to the screw tightening direction. It includes an angle of zero.

The percentage of the wobbling in the period from the start to the end of the screw tightening work (which is called a wobbling rate) can be calculated from the following Equation 9:

Wobbling rate=an absolute value of the cumulative total number of wobbling pulses/(the total number of pulses−the cumulative total number of advance pulses) Eq. 9

The wobbling rate can be used as an index indicating a quality of the screw tightening work. If the wobbling rate is large, then a warning may be sent out to prompt the worker to redo the screw tightening step. Also, the wobbling rate can be used for training in the screw tightening work.

By comparing the cumulative total number of wobbling pulses calculated from Equation 8 with a preset allowable number of pulses, the reliability of the screw tightening can be evaluated. If the cumulative total number of wobbling pulses is too large, then it can be evaluated that the wobbling angle is large and thus, the reliability of the screw tightening is low. On the other hand, if the cumulative total number of wobbling pulses is small, then it can be evaluated that the wobbling angle is small and thus, the reliability of the screw tightening is high.

Further, the wobbling rate calculated by Equation 9 can also be used to evaluate the reliability of the screw tightening. By comparing the wobbling rate calculated from Equation 9 with a preset allowable rate, the reliability of the screw tightening can be evaluated. If the wobbling rate is too large, then the reliability of the screw tightening can be evaluated to be law. On the other hand, if the wobbling rate is small, then the reliability of the screw tightening can be evaluated to be high.

Next, description will be given on the method of the present invention of controlling a hand-held powered screw loosening tool with an impact wrench as an example of the impact wrench having the above-mentioned constitution wherein the rebound is provided.

It is to be noted that the impact wrench described herein is a kind of the hand-held powered screw tightening tools which is usable for both screw tightening and screw loosening. When used for the screw loosening, the impact wrench is presented in the form of one embodiment of the hand-held powered screw loosening tool.

Figure 35:
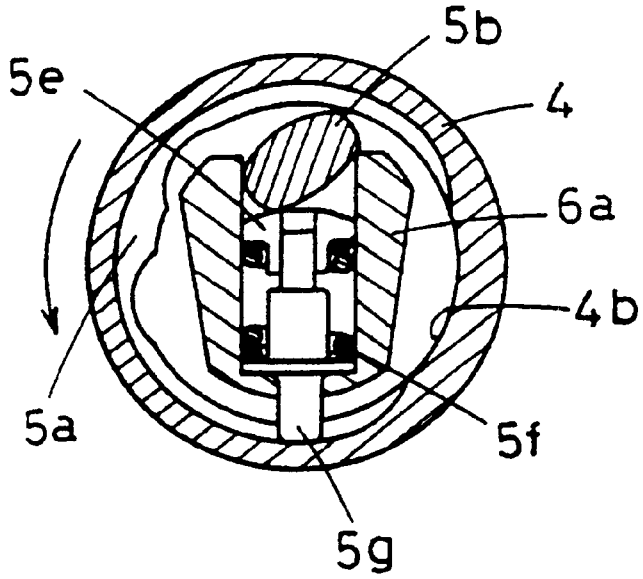
FIG. 35 is a vertically sectioned front view of the hammering force transmission mechanism of the impact wrench that is in the free running state.
Figure 36:
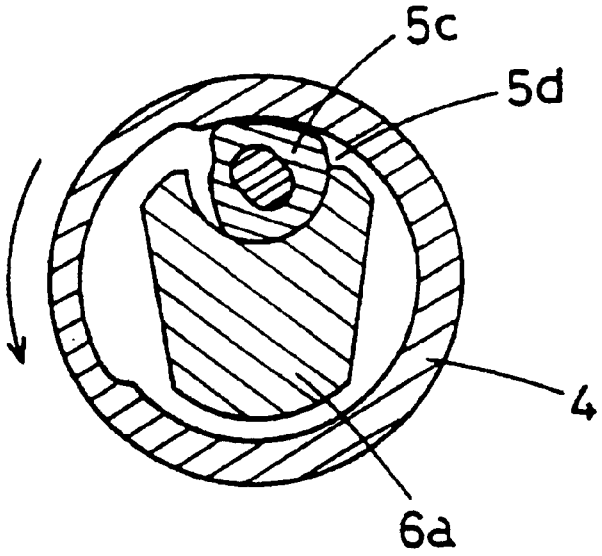
FIG. 36 is a diagram illustrating the operative state of the cam plate.
Figure 37:
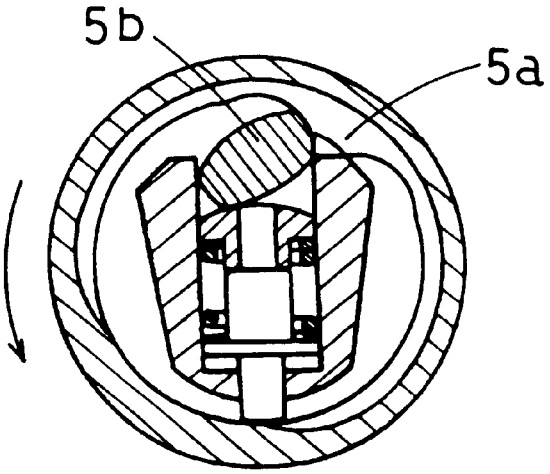
FIG. 37 is a vertically sectioned front view of the hammering force transmission mechanism at the time of hammering.

First, the socket fitted to the front end of the driven shaft 6 is fitted to a screw member 9 to be loosened and a predetermined screw loosening angle is previously input to the completed screw loosening detecting part 15B. Thereafter, the solenoid valve 19 is opened and the impact wrench switching valve is switched to the screw loosening side. Then, when the control lever 20 is operated to feed compressed air to the impact wrench, so as to rotate the air motor 2 in the screw loosening direction (in the counterclockwise direction for the right-hand screw member), the cylindrical rotary member 4 runs freely around the trunk 6*a* of the driven shaft 6. In the coarse of the free running, the cylindrical rotary member 4 is accelerated by the rotational driving power of the air motor 2 and the cam plate 5*c* is brought into contact with the inner periphery of the cylindrical rotary member 4, so as to tilt the anvil block 5*b*, as shown in FIGS. 35 and 36. The cylindrical rotary member 4 brings the hammering boss 5*a* into engagement with the anvil block 5*b* with impact, as shown in FIG. 37, so that the torque of the cylindrical rotary member 4 is transmitted to the driven shaft 6 via the hammering force, so as to rotate the driven shaft 6 in the loosening direction at only a certain angle. The loosening angle at that time is detected by the rotary detecting member 7 and the detecting sensors 8*a*, 8*b*, as mentioned later.

Figure 38:
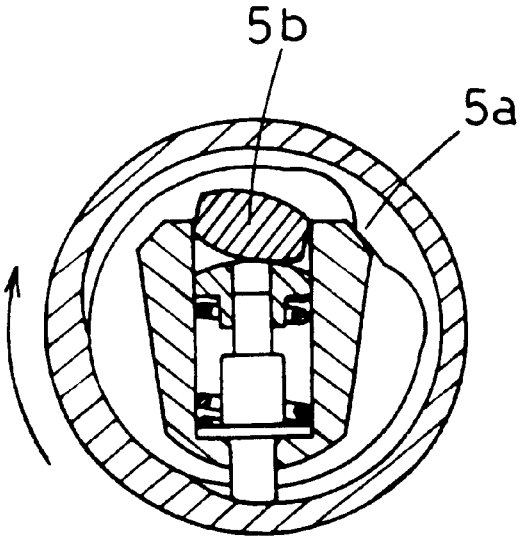
FIG. 38 is a vertically sectioned front view of the hammering force transmission mechanism at the time of rebounding.

When the screw member 9 is loosened, a resistance force larger than the torque of the air motor 2 is generated at the driven shaft 6 side. At the moment when the driven shaft 6 is finished rotating by a certain angle in the loosening direction by the hammering force of the hammering boss 5*a*, the cylindrical rotary member 4 rebounds in the opposite direction to the loosening direction and then runs freely in the loosening direction through the driving torque of the air motor 2, as shown in FIG. 38. This brings the hammering boss 5*a* into engagement with the anvil block 5*b* again with impact in the same manner, so as to rotate the driven shaft 6 in the screw loosening direction further. The screw loosening angle at that time is read by the rotary detecting member 7 and the detecting sensors 8*a*, 8*b*. Subsequently, after the free running of the cylindrical rotary member 4, the screw loosening angle is detected every time the hammering boss 5*a* comes into collision with the anvil block 5*b* . When the cumulative total of screw loosening angle reaches a predetermined preset screw loosening angle, the feed of the compressed air is automatically stopped to complete the loosening of the screw member 9.

Thus, the impact wrench is stopped under control of a preset screw loosening angle, and as such can eliminate the problem that the bolt or nut falls off.

The inventive method of detecting the screw loosening angle by means of the rotary detecting member 7 and the detecting sensors 8*a*, 8*b* uses the basic technique as that described with reference to FIGS. 9–15. For confirmation purpose, the screw loosening angle detecting method of the present invention will be described concretely with reference to FIGS. 39(*a*)–45.

The detecting sensors 8*a*, 8*b* are so structured that when a tooth of the rotary detecting member 7 rotating together with the cylindrical rotary member 4 passes through the detecting sensors, the detecting sensors can detect one pulse and measure the velocity of the cylindrical rotary member 4 from the number of passing teeth per unit of time. In each of FIGS. 39(*a*)–44(*c*), (*a*) shows the operative relation between the cylindrical rotary member 4 and the driven shaft 6, (*b*) illustrates a screw loosening angle of the screw member 9, and (*c*) plots a time shift in rotation velocity of the cylindrical rotary member 4 and screw loosening angle of the screwing member 9 every time the hammering is performed. It is to be noted that the direction for the screw member 9 to be loosened is counterclockwise.

Figure 39A:
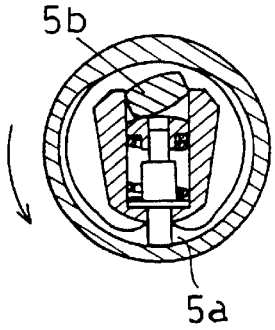
FIGS. 39(*a*)–(*c*) are illustrations illustrating the hammering force transmission mechanism that is in the free running state.
Figure 39B:
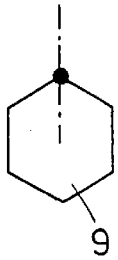
Figure 39C:
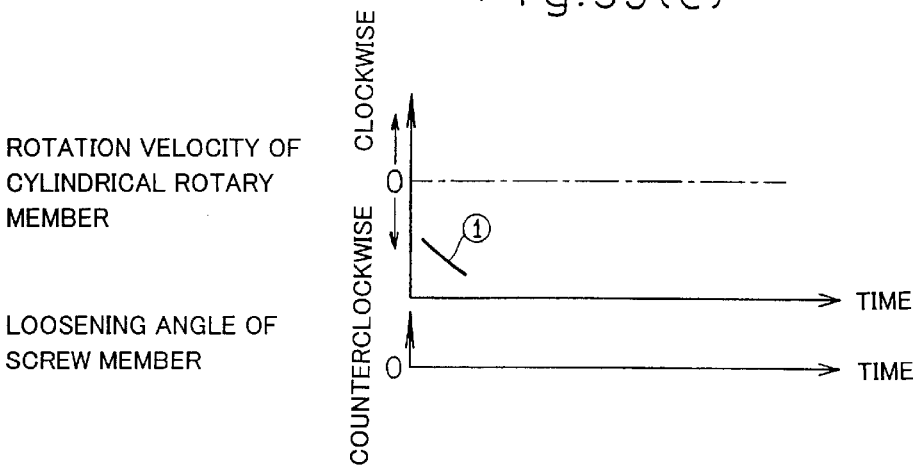

FIGS. 39(*a*)–(*c*) are views showing the free running state of the cylindrical rotary member 4. In this state, the torque of the cylindrical rotary member 4 is not transmitted to the driven shaft 6 from the hammering force transmitting mechanism 5 comprising the hammering boss 5*a* and the anvil block 5*b*, so that the cylindrical rotary member 4 gradually accelerates, while freely running ① in the counterclockwise direction, as depicted by an downward-sloping line in FIG. 39(*c*) and FIG. 45.

Figure 45:
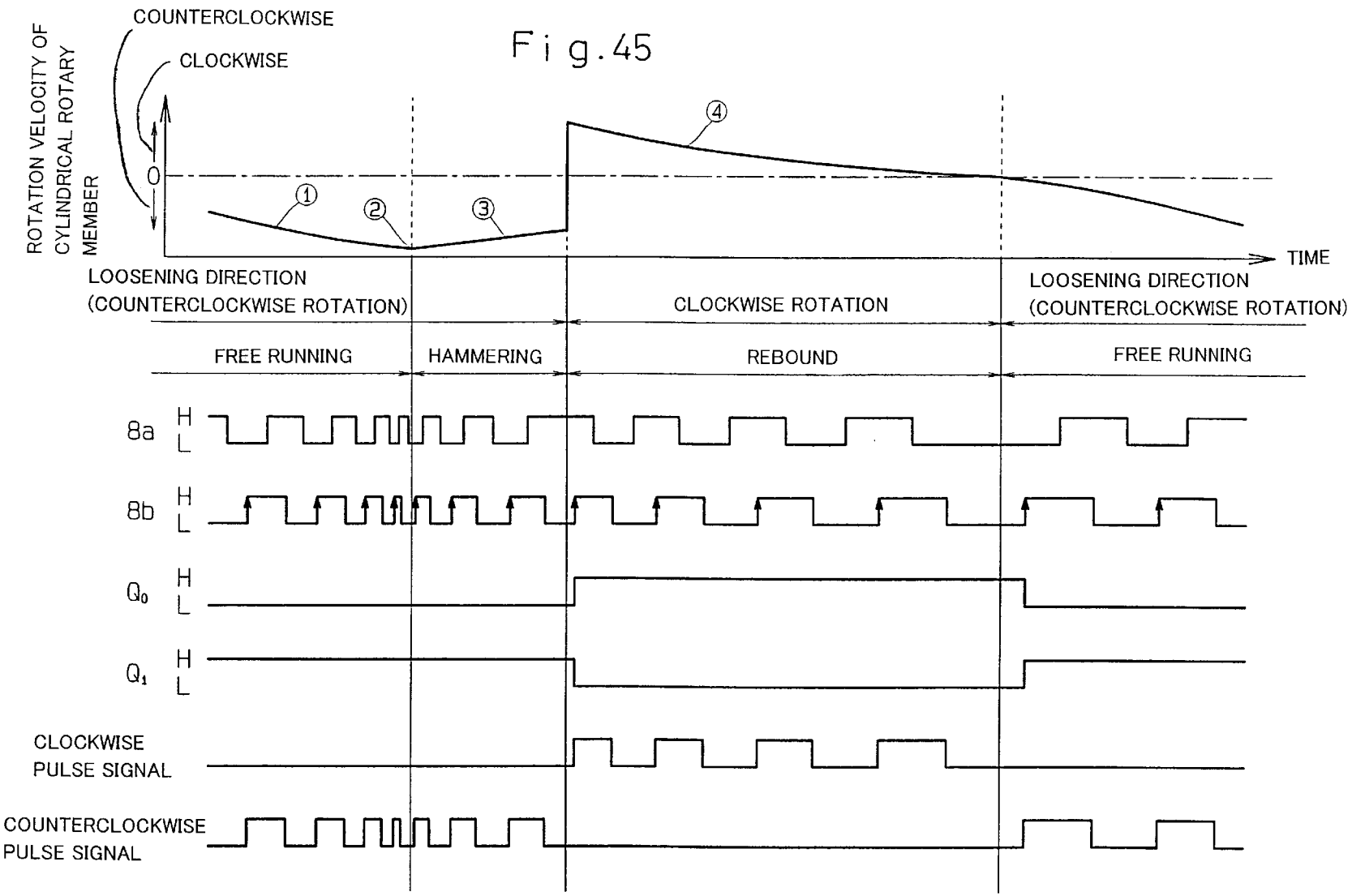
FIG. 45 is a plot of a relation between operation of the cylindrical rotary member and pulse signals in the screw loosening control.

The detecting sensors 8*a*, 8*b* are structured to output pulse signals that are different in phase by 90 degrees from each other, as mentioned above. While the rotary detecting member 7 is rotating in the screw loosening direction (in the counterclockwise direction), the waveform of the pulse signal is output from one detecting sensor 8*a*, whose phase is lagged by 90 degrees from that of the other detecting sensor 8*b*, as shown in FIG. 45. On the other hand, when the hammering boss 5*a* collides with the anvil block 5*b*, for the hammering, and then the rotary detecting member 7 rebounds in the clockwise direction together with the cylindrical rotary member 4, the phases of the signals from the both detecting sensors 8*a*, 8*b* are reversed. In other words, the waveform of the pulse signal is output from the other detecting sensor 8*b*, whose phase is lagged by 90 degrees from that of the one detecting sensor 8*a*.

When the rotary detecting member 7 is rotating in the screw loosening direction (in the counterclockwise direction), the waveform output from the one detecting sensor 8*a* comes to be at a low level (L) when the waveform output from the other detecting sensor 82*b* is upended (↑). When the rotary detecting member 7 is rotating in the rebounding direction (in the clockwise direction), the waveform from the one detecting sensor 8*a* comes to be at a high level (H). $Q_0$ is the detection signal indicating the rotation direction. The waveform (L) or (H) is kept at the low level or at the high level until the rotation direction is changed. On the other hand, the signal $Q_1$ maintains exactly the opposite state to the signal $Q_0$. The central processing part 13 discriminates between the loosening direction (counterclockwise direction) or the rebounding direction (clockwise direction) by the signal $Q_0$ or $Q_1$ and detects the respective directional pulse signal.

Figure 40A:
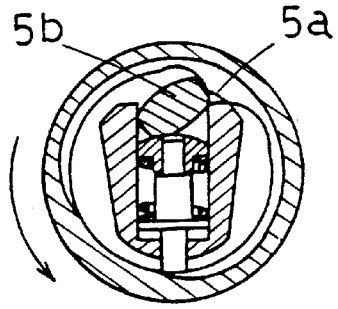
FIGS. 40(*a*)–(*c*) are illustrations illustrating the hammering force transmission mechanism at the moment of the start of hammering.
Figure 40B:
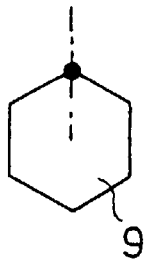
Figure 40C:
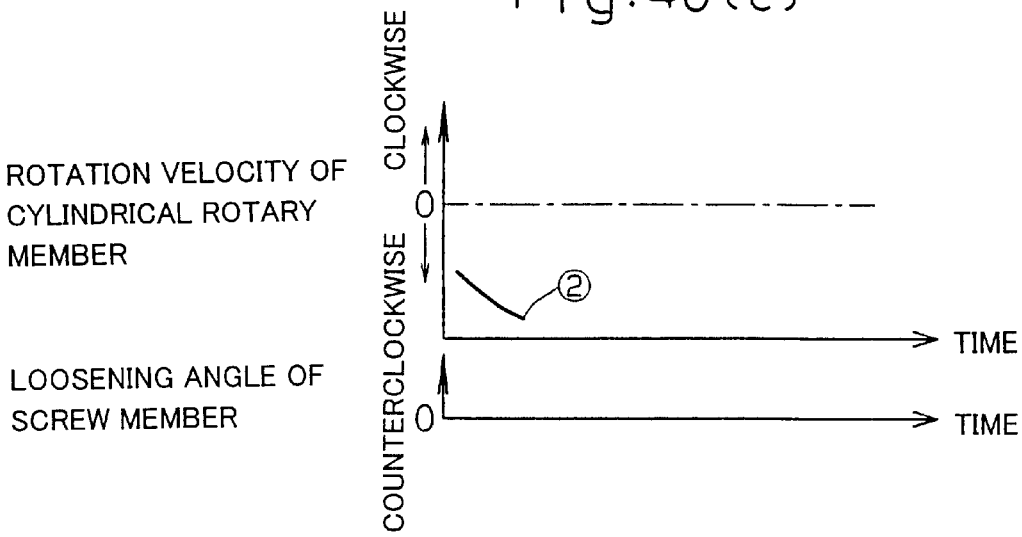
Figure 41A:
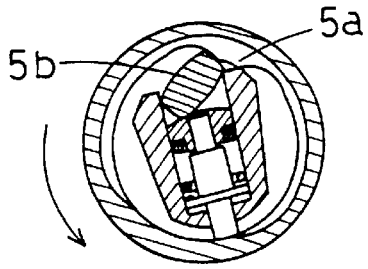
FIGS. 41 (*a*)–(*c*) are illustrations illustrating the hammering force transmission mechanism at the time of loosening the screw member.
Figure 41B:
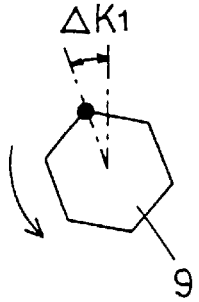
Figure 41C:
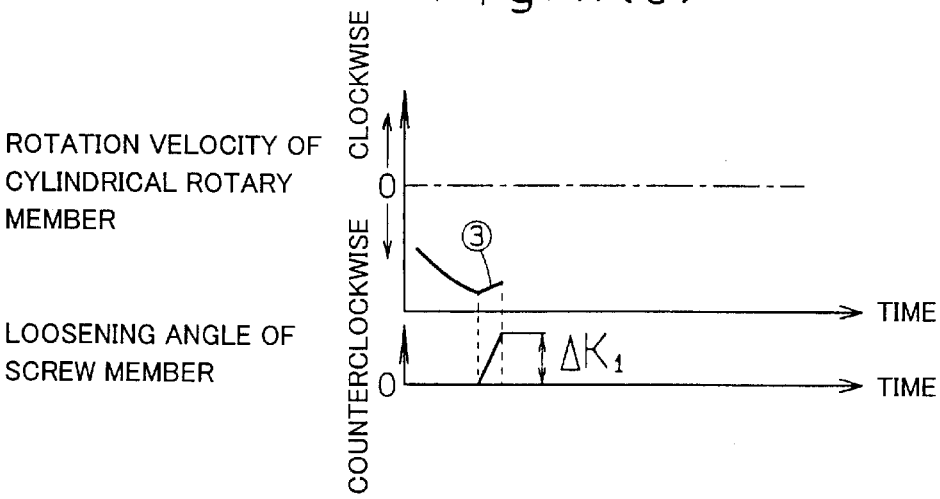
Figure 42A:
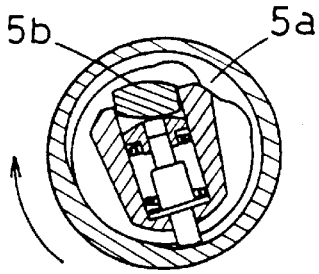
FIGS. 42(*a*)–(*c*) are illustrations illustrating the hammering force transmission mechanism at the time of rebounding.
Figure 42B:
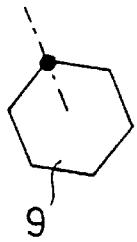
Figure 42C:
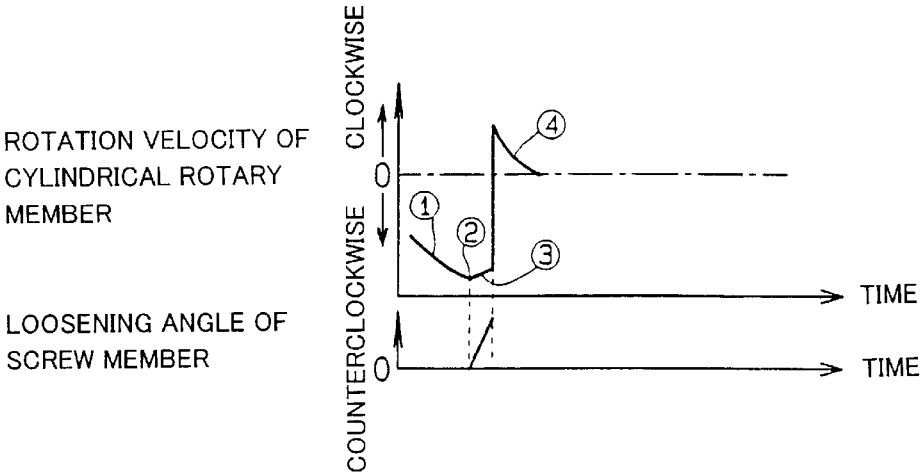

Then, at the moment at which the hammering boss 5*a* collides with the anvil block 5*b* after the free running of the cylindrical rotary member 4, the rotation velocity of the cylindrical rotary member 4 becomes maximum ②, as shown in FIG. 40(*c*). From this state, the loosening of the screw member 9 by the hammering is started. At this time of screw loosening, the driven shaft 6 rotated in the loosening direction via the hammering force transmission mechanism 5 consumes energy for loosening the screw member 9, so that when the first screw loosening is provided, the cylindrical rotary member 4 is decelerated ③ from the counterclockwise maximum velocity ②, as indicated by a upward-sloping line, as shown in FIG. 41(*c*) and FIG. 45. Thereafter, the cylindrical rotary member 4 rebounds ④ in the clockwise direction, as shown in FIG. 42(*c*).

A point of time at which the deceleration ③ is started from the maximum velocity ② is determined by detecting the state of rotation of the rotary detecting member 7 by use of the detecting sensors 8*a*, 8*b*, as shown in FIG. 45. Specifically, as the cylindrical rotary member 4 is accelerated in the free running, the widths of the pulse signals detected by the detecting sensors 8*a*, 8*b* gradually decreases, and at the moment at which the hammering boss 5*a* collides with the anvil block 5*b*, the widths of the pulse signals becomes minimum. Thereafter, during the time from after the start of deceleration of the cylindrical rotary member 4 to the end of hammering (the start of rebounding), the widths of the pulse signals in the counterclockwise direction increase gradually. These pulses of gradually decreasing widths and those of gradually increasing widths are output from the detecting sensors 8*a*, 8*b*. They are detected by the central processing part 13 as the counterclockwise pulse signals to judge the point of time at which the pulse widths are narrowed to minimum as the starting point of loosening of the screw member 9 by hammering (starting point of deceleration), as mentioned above.

By detecting this point of time, the generation of hammering for the screw loosening is detected.

Thus, the generation of hammering for the screw loosening is detected and further the loosening angle is detected. In this case, after the starting point of deceleration of the cylindrical rotary member 4 is detected, the rotation angle of the rotary detecting member 7 is detected by the detecting sensors 8*a*, 8*b* throughout the deceleration ③, in other words, during the period from the start of deceleration to the end of hammering. In other words, the screw loosening angle $\Delta K_1$ of the screw member 9 is determined from the number of pulses equivalent to the number of teeth of the rotary detecting member 7 passing through the detecting sensors 8*a*, 8*b* during the deceleration. Then, the cylindrical rotary member 4 rebounds ④ in the clockwise direction, as mentioned above.

Figure 43A:
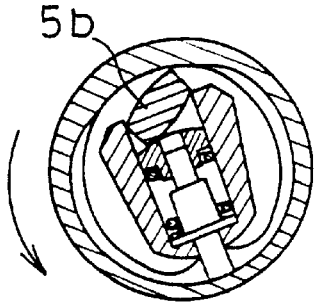
FIGS. 43(*a*)–(*c*) are illustrations illustrating the velocity of the hammering force transmission mechanism at the time of free running again.
Figure 43B:
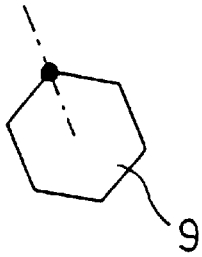
Figure 43C:
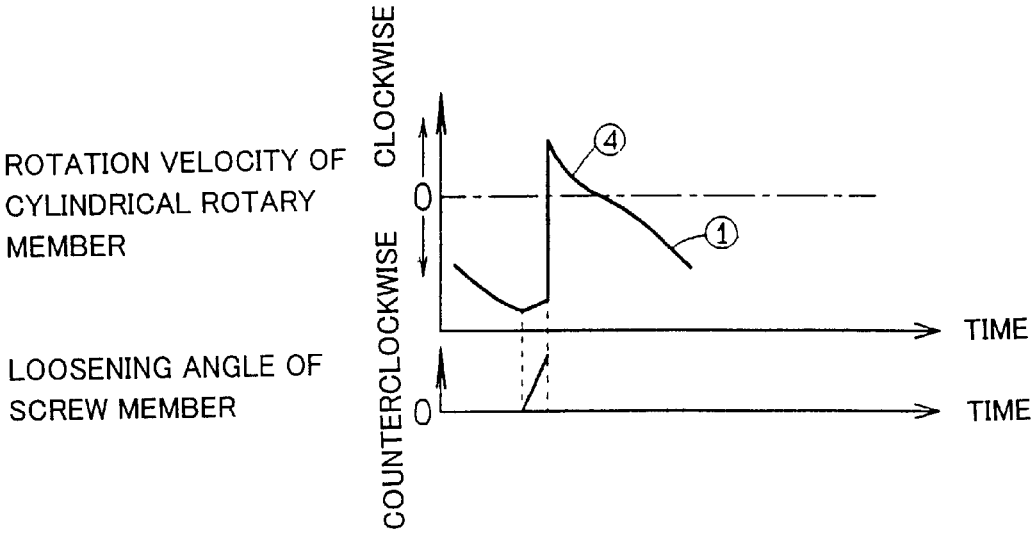
Figure 44A:
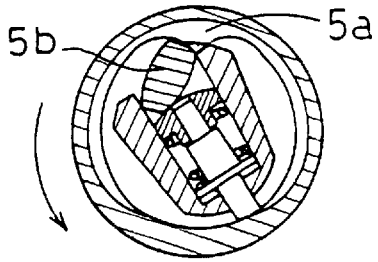
FIGS. 44(*a*)–(*c*) are illustrations illustrating the hammering force transmission mechanism at the time of loosening the screw member.
Figure 44B:
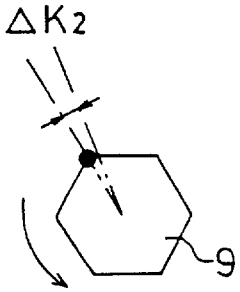
Figure 44C:
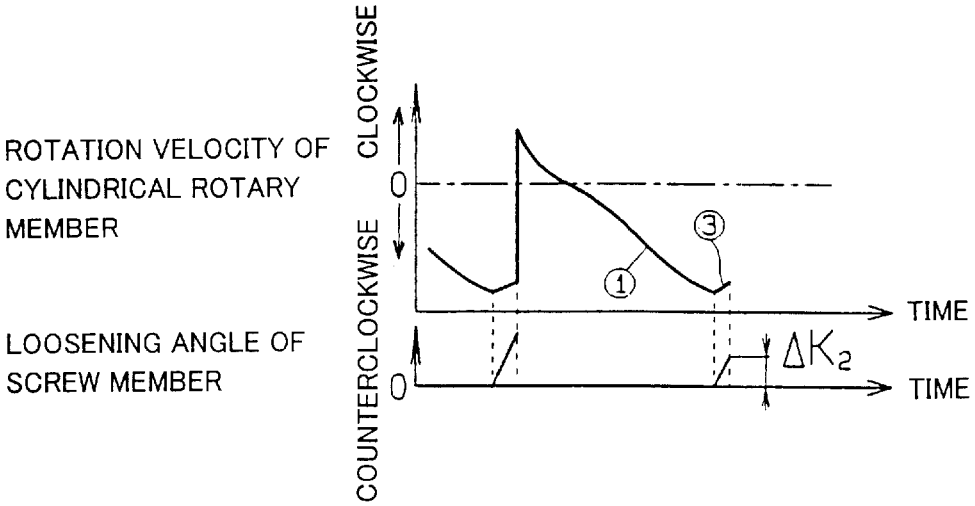

As shown in FIGS. 42(*a*)–(*c*), after the rebound ④ of the cylindrical rotary member 4 gradually decelerates to the stop, the cylindrical rotary member 4 runs freely ① again with acceleration in the counterclockwise direction by the torque from the air motor 2, as shown in FIGS. 43(*a*)–(*c*). Then, the hammering boss 5*a* is brought into collision with the anvil block 5*b*, from the moment of which the rotation velocity of the cylindrical rotary member 4 is decelerated ③, as shown in FIGS. 44(*a*)–(*c*), and the regeneration of hammering for the screw loosening is detected.

The rotation angle of the rotary detecting member 7 or the screw loosening angle $\Delta K_2$ of the screw member 9 during the deceleration ③ from the start of deceleration to the end of hammering is detected by the rotary detecting member 7 and the detecting sensors 8*a*, 8*b* in the same manner as that mentioned above.

Thereafter, every time when the cylindrical rotary member 4 is decelerated ③ by the hammering after the free running ①, the screw loosening angles $\Delta K$ of the screw member 9 formed during the deceleration ③ from the start of deceleration to the end of hammering are integrated in sequence by the central processing part 13 in the same manner. Then, when the integrated angle of the screw loosening angles reaches a preset screw loosening angle of the screw member 9, the rotation angle signal outputting part 14 outputs signals to the solenoid valve controlling part 16 through the completed screw loosening detecting part 15B, to stop the solenoid valve 19 via the output circuit 17. This operation can also be realized by use of a logical circuit or software.

The controlling method described above is a method of controlling the impact wrench so that it can be brought to a halt automatically after a screw member that cannot be loosened easily with a small torque is loosened at a preset screw loosening angle (e.g. an angle equivalent to 5 rotations after the first hammering is given).

When the screw member is loosened further, if necessary, the impact wrench may be operated again.

Described below is a controlling method used for a tightened screw member that can be loosened by hand after loosened with some large torque. In the controlling method, the impact wrench is so controlled that it can be brought to a halt at a point of time at which the screw member is rotated a predetermined number of times after loosened by generation of a certain number of hammering.

In this case, after a certain number of hammerings, the screw loosening torque becomes smaller than the operation torque of the impact wrench, so that after the hammering, the driven shaft 6 continues to rotate in the loosening direction without decreasing of the rotation velocity in the screw loosening direction to zero. If this state continues, then the bolt or nut may fall off, so that it is necessary to stop the operation of the impact wrench at a preset screw loosening angle (e.g. an angle equivalent to 5 additional rotations after the first hammering is given with no rebound).

For accomplishing this, it is necessary to detect the first hammering with no rebound. The first hammering with no rebound is intended to mean such a hammering that even when the cylindrical rotary member 4 runs freely for more than one rotation, the rotation velocity does not reduce to zero or the rotation direction is not reversed.

Figure 46:
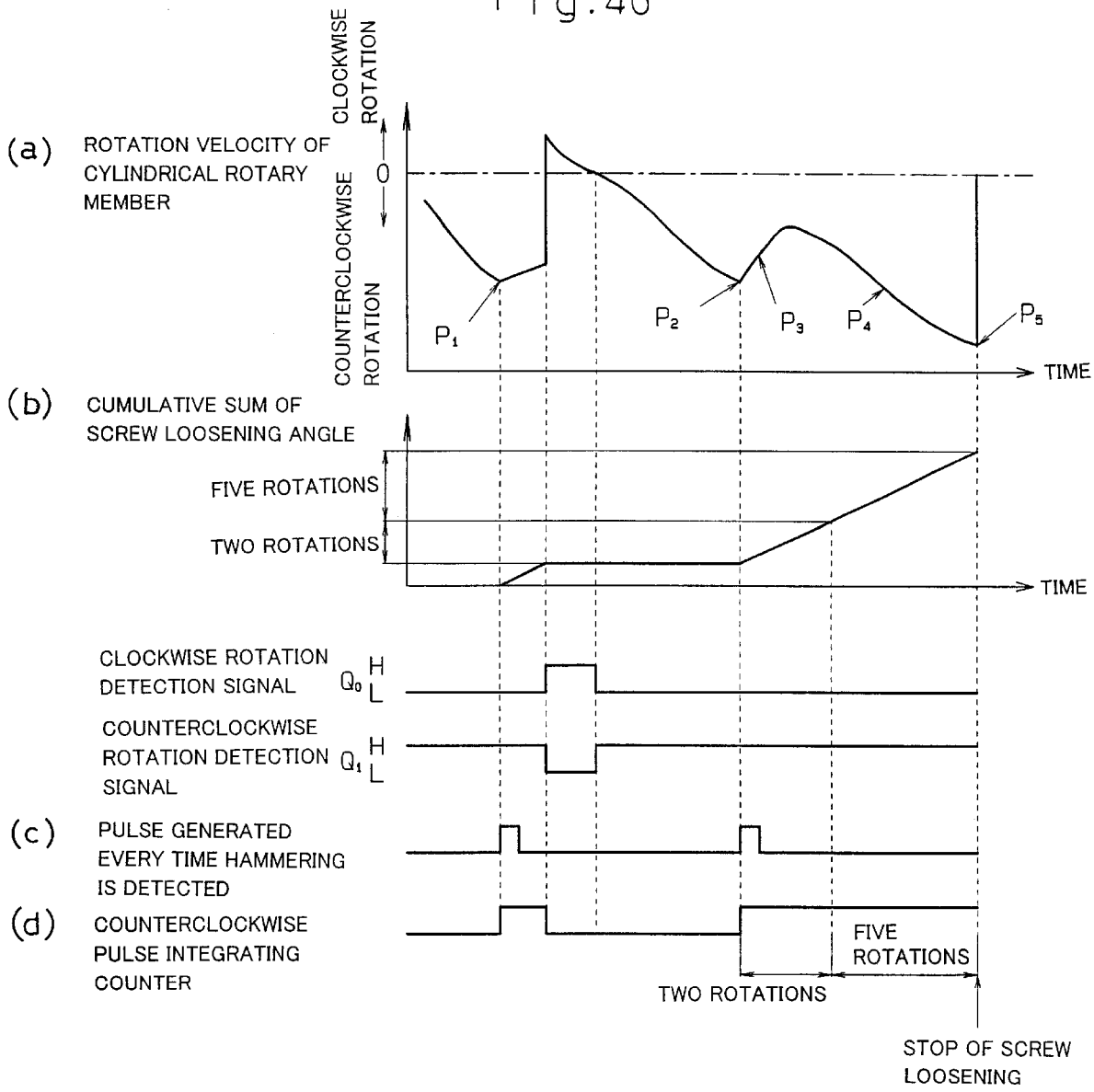
FIGS. 46(*a*)–(*c*) are illustrations of the screw loosening control in the impact wrench.

In that case, as shown in FIG. 46(*a*), after the first hammering with no rebound ($P_2$), the rotation velocity is decelerated ($P_3$), first, and then accelerated ($P_4$) again. FIG. 46(*b*) is a diagram plotting a cumulative total of screw loosening angle.

Thus, it is required for the detection of the first hammering with no rebound to detect that after the hammering, the rotation velocity does not reduce to zero, or the rotation direction is not reversed, in a 360-degree rotation of the cylindrical rotary member 4. In practice, because of some factors such as the wobbling, it is required to detect that after the hammering, the rotation direction is not reversed in two rotations (a 720-degree rotation).

This condition is sufficient for the cylindrical rotary member 4 designed to provide one hammering per rotation of the same. However, for example, for the cylindrical rotary member designed to provide two hammerings per rotation, the first hammering with no rebound means that even when the cylindrical rotary member 4 rotates at 180 degrees after the hammering, the rotation velocity does not reduce to zero, or the rotation direction is not reversed. If the rotation velocity does not reduce to zero, or the rotation direction is not reversed, in a 360-degree rotation of the cylindrical rotary member 4, then the hammering can be judged as the first hammering with no rebound even when the wobbling is taken into account. In the following, reference is given to the cylindrical rotary member 4 designed to provide one hammering per rotation of the same.

For this reason, there is provided a counter to generate the pulse every time the hammering is detected, as shown in FIG. 46(*c*), and also integrate the counterclockwise pulses by means of this generated pulse, the counter being structured to be reset by the signal $Q_0$ or $Q_1$ when the rotation direction is reversed, as shown in FIG. 46(*d*).

Further, the counter is structured to keep on counting without being reset, so as to judge the previous hammering as the first hammering with no rebound at a moment at which the counter has integrated the counterclockwise pulses corresponding to two rotations (a 720-degree rotation). With this constitution, the first hammering with no rebound can be detected.

Then, the counter keeps on integrating the counterclockwise pulses further. At the point of time ($P_5$) at which the counter integrates the pulses corresponding to 5 rotations (5×360°), signals are output from the rotation angle signal outputting part 14 to the solenoid valve controlling part 16 through the completed screw loosening detecting part 15B to stop the solenoid valve 19 via the output circuit 17. This constitution can be realized by use of a logic circuit or software.

Thus, the operation of the impact wrench is stopped at the point of time at which the integrated counterclockwise pulses reach a preset screw loosening angle, so that a possible problem that the bolt and nut are loosened too much and fall off is prevented.

Next, one of the impulse wrenches wherein the rebound is not produced at the hammering will be described with reference to FIG. 18, which is another example of the hand-held powered screw loosening tool used in the present invention. It is to be noted that the impulse wrench is a kind of the hand-held powered screw tightening tools, which is usable for both the screw tightening and screw loosening. When used for the screw loosening, it is presented in the form of one embodiment of the hand-held powered screw loosening tool.

Figure 47:
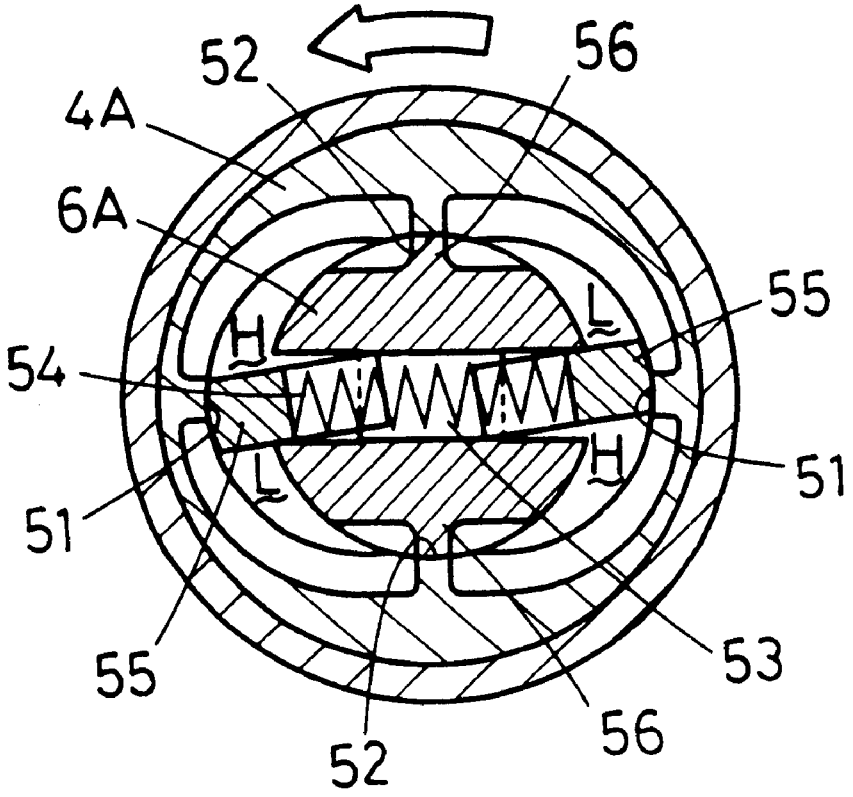
FIG. 47 is an illustration of the screw loosening control in the impulse wrench at the time of generation of impact.

First, the socket fitted to the front end of the driven shaft 6A is fitted to a screw member 9 to be loosened and a predetermined screw loosening angle is previously input to the completed screw loosening detecting part 15B. Thereafter, the solenoid valve 19 is opened and the impulse wrench switching valve is switched to the screw loosening side. Then, when the control lever 20 is pressed to feed compressed air to the impulse wrench, so as to rotate the air motor 2A in the screw loosening direction (in the counterclockwise direction for the right-hand screw member), the oil cylinder 4A is rotated in the screw loosening direction at an accelerated rate by a driving torque from the air motor 2A side. As shown in FIG. 47, after the blades 55 and the projected portions 56 are brought into close contact with the sealing surfaces 51, 52 in the oil-tight manner, respectively, the high pressure chamber H is produced to transmit the torque to the driven shaft 6A side with impact, so as to rotate the driven shaft 6A in the loosening direction by a certain angle. At this time, the oil cylinder 4A is decelerated, and the rotation angle of the oil cylinder 4A in the middle of the deceleration, in other words, the screw loosening angle of the screw member 9 formed by the driven shaft 6A, is detected by the rotary detecting member 7 and the detecting sensors 8*a*, 8*b*, as mentioned later.

In the middle of the deceleration of the oil cylinder 4A, the screw loosening is provided. The method of detecting and calculating the screwing angle, or the rotation angel of the screw member, during the deceleration will be described below.

Figure 48A:
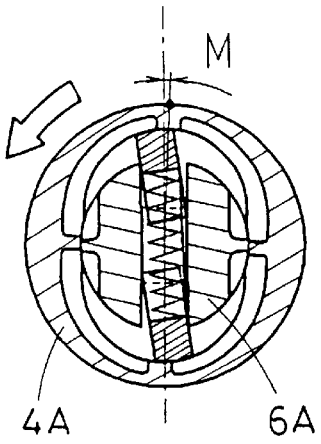
FIGS. 48(*a*) and (*b*) are illustrations of the screw loosening control in the impulse wrench at the time of screw loosening.
Figure 48B:
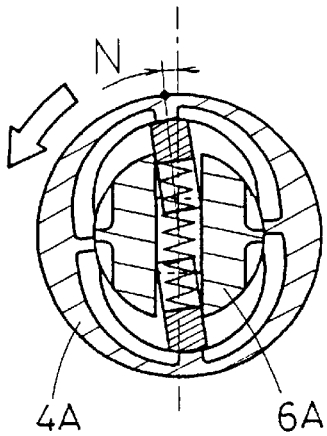

The oil-tight state is produced when the oil cylinder 4A inclines rearwards at a certain angle M to the driven shaft 6A, and the oil-tight state is released when the oil cylinder 4A inclines forward at a certain angle N thereto, as shown in FIGS. 48(*a*) and (*b*). These angles M, N are the angles determined in design of the impulse wrench, and the interrelation between these angles is formed even when the oil cylinder 4A and the driven shaft 6A rotate together in the middle of the oil-tight state, to loosen the screw member 9.

Figure 49:
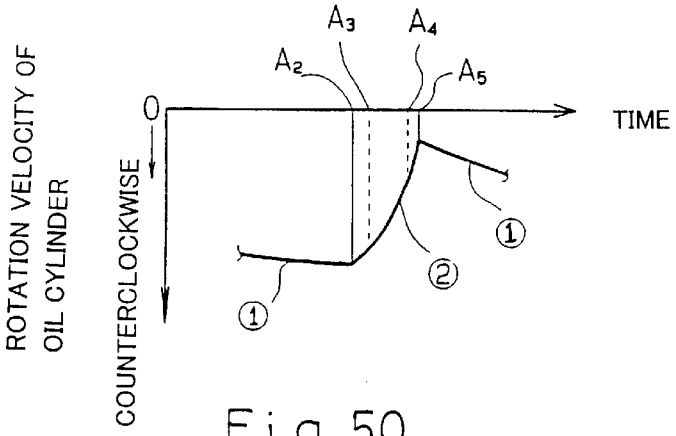
FIG. 49 is a plot of a rotation velocity of an oil cylinder in the screw loosening control in the impulse wrench.

Description on the rotation of the driven shaft 6A in the middle of the deceleration of the oil cylinder 4A will be given with reference to FIGS. 49 and 50.

At $A_2$, the oil-tight state is produced by the oil cylinder 4A, and the driven shaft 6A and the oil cylinder 4A starts decelerating. At this time, the driven shaft 6A is kept in its halt condition. From that point of time, the oil cylinder 4A starts compressing oil. When the oil cylinder rotates at the angle M to correspond in phase to the driven shaft 6A, first, and then rotates further at an angle $g_1$ to compress the oil, an impact torque exceeding the load torque of the driven shaft 6A is generated. From this point of time $A_3$, the oil cylinder 4A and the driven shaft 6A rotate together at an identical angle $\Delta G_1$, respectively, while keeping the angular phase difference $g_1$. A magnitude of the angular phase difference $g_1$ varies in accordance with the load torque of the driven shaft 6A side. The angle is large in an early stage of the loosening of the screw member 9, and it decreases as the loosening of the screw member 9 proceeds.

Figure 50:
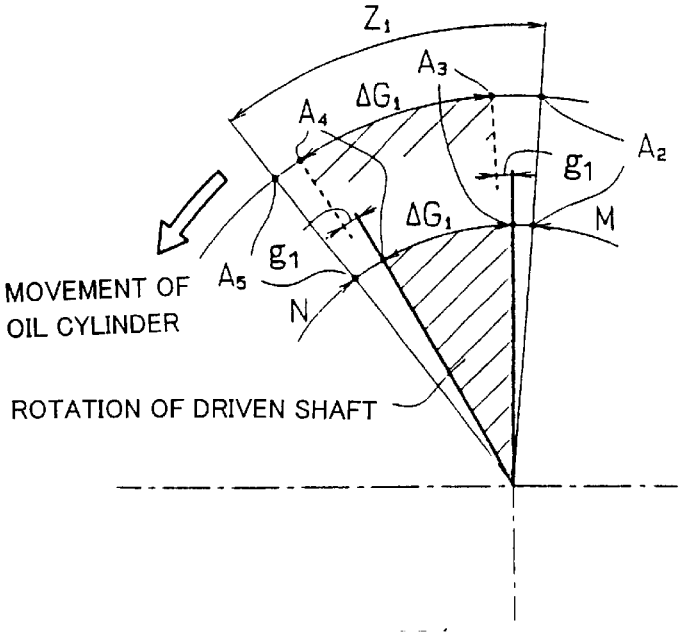
FIG. 50 is a diagram showing a rotational state of the driven shaft and the oil cylinder of the impulse wrench.

While the angular phase difference $g_1$ is represented by an angle formed with respect to the screw loosening direction (counterclockwise rotation angle) in FIG. 50, there may be cases where the angle $g_1$ is zero or its absolute value is a negative value smaller than M.

In other words, there may be cases where at the point of time when or before the oil cylinder 4A and the driven shaft 6A correspond in phase to each other after the oil-tight state is produced, the oil cylinder 4A and the driven shaft 6A rotate together.

At the point of time $A_4$ when the impact torque generated by the differential pressure between the high pressure chamber H and the low pressure chamber L produced in the interior of the oil chamber 4A comes to be relatively smaller than the load torque on the load side, the driven shaft 6A stops rotating and the oil cylinder 4A remains rotating with deceleration until a point of time $A_5$ at which the oil-tight state is released.

At the point of time $A_4$, the oil cylinder 4A is in the phase that is advanced by the angle $g_1$ over that of the driven shaft 6A. Accordingly, the oil cylinder 4A is just required to rotate at an angle $(N-g_1)$ until a point of time $A_5$ at which the oil-tight state is released. Thus, after rotating at an angle $(M+g_1)$ in the angle $Z_1$ ranging from the point of time $A_2$ to the point of time $A_5$ that can be detected by the above-mentioned method, the oil cylinder 4A is rotated together with the driven shaft 6A at the angle $\Delta G_1$. Thereafter, only the oil cylinder 4A is rotated further at the angle $(N-g_1)$.

The sum of these angles is the rotation angle $Z_1$ of the oil cylinder 4A ranging from the point of time $A_2$ to the point of time $A_5$. The angle $Z_1$ is the sum of the angles M, N and $\Delta G_1$, as given by Equation 3. As mentioned above, the angles M and N are values that can be determined in design. Where $\delta$ is the sum of these angles, the rotation angle of the driven shaft 6A from the point of time $A_2$ to the point of time $A_5$, in other words, the screw loosening angle $\Delta G_1$ of the screw member 9, can be determined by subtracting the sum of the angles $\delta$ from the rotation angle $Z_1$ of the oil cylinder 4A ranging from the point of time $A_2$ to the point of time $A_5$.

As the method of detecting the screw loosening angle of the screw member 9 defined by the driven shaft 6A by use of the rotary detecting member 7 and the detecting sensors 8*a*, 8*b* uses the basic technique identical to that previously described with reference to FIGS. 24(*a*)–30(*b*), the concrete description thereon is omitted. The controlling method described above is a method of controlling the impulse wrench so that it can be brought to a halt automatically after the screw member that cannot be loosened easily with a small torque is loosened at a preset screw loosening angle (e.g. an angle equivalent to 5 rotations after the first hammering is generated). When the screw member is loosened further, if necessary, the impulse wrench may be operated again.

Described below is a controlling method used for a tightened screw member that can be loosened by hand after loosened with some large torque. In the controlling method, the impulse wrench is controlled so that it can be brought to a halt automatically at a point of time at which the screw member is rotated at a screw loosening angle corresponding to a predetermined number of times after loosened by a certain number of hammering.

In this case, after a certain number of hammerings, the screw loosening torque becomes smaller than the operation torque of the impulse wrench, so that after the hammering, the driven shaft 6A keeps on rotating in the loosening direction without decelerating below a threshold rotation velocity in the screw loosening direction. If this state of rotation continues, then the bolt or nut will rotate until they fall. Accordingly, it is necessary to stop the operation of the impulse wrench at a preset screw loosening angle (e.g. at an angle equivalent to 5 additional rotations after the first hammering of not less than a threshold value).

For accomplishing this, it is necessary to detect the generation of the first hammering of not less than the threshold value. The first hammering of not less than the threshold value is intended to mean such a hammering that even when the oil cylinder 4A runs freely for more than one rotation, the rotation velocity is not reduced below the threshold value.

Figure 51:
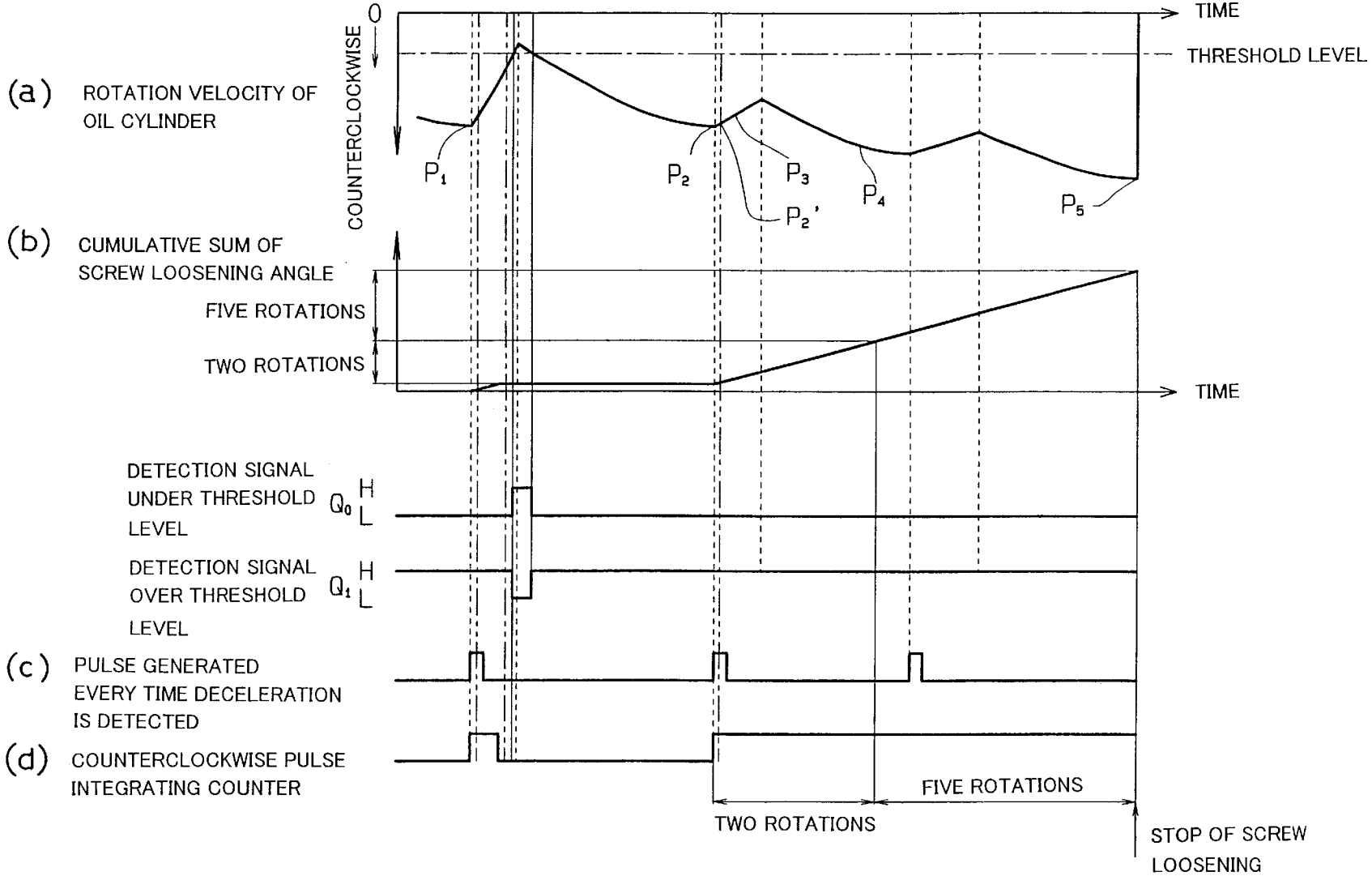
FIG. 51 is an illustration of the screw loosening control in the impulse wrench.

In that case, as shown in FIG. 51(*a*), after the first hammering ($P_2$) of not less than the threshold value, the rotation velocity is decelerated ($P_3$), first, and then accelerated ($P_4$) again. FIG. 51(*b*) is a diagram plotting a cumulative total of the screw loosening angle.

Thus, it is required for the detection of the first hammering of not less than the threshold value to detect that, after the hammering, the rotation velocity is not reduced below the threshold value in a 360-degree rotation of the oil cylinder 4A. In practice, because of some factors such as the wobbling, it is required to detect that after the hammering, the rotation velocity is not reduced below the threshold value in two rotations (a 720-degree rotation).

This condition is sufficient for the oil cylinder 4A designed to provide one hammering per rotation of the same. However, for example, for the oil cylinder 4A designed to provide two hammerings per rotation of the same, the first hammering of not less than the threshold value means that even when the oil cylinder 4A rotates at 180 degrees after the hammering, the rotation velocity is not reduced below the threshold value. If the rotation velocity is not reduced below the threshold value in a 360-degree rotation of the oil cylinder, then the hammering can be judged as the first hammering of not less than the threshold value, even when the wobbling is taken into account. In the following, reference is given to the oil cylinder 4A designed to provide one hammering per rotation of the same.

For this reason, as shown in FIG. 51(*c*), there is provided a counter to generate the pulses every time the deceleration starting point is detected and integrate the counterclockwise pulses by means of the generated pulses. The counter is structured to be reset by the signal $Q_0$ or $Q_1$ when the rotation velocity id reduced below the threshold value, as shown in FIG. 51(*d*).

Further, the counter is structured to keep on counting without being reset, so as to judge the previous hammering as the first hammering of not less than the threshold level at a point of time at which the counter has integrated the counterclockwise pulses corresponding to two rotations (a 720-degree rotation).

With this constitution, the first hammering of not less than the threshold value can be detected.

Then, the counter keeps on integrating the counterclockwise pulses further. At the point of time ($P_5$) at which the counter integrates the pulses corresponding to 5 rotations (5×360°), signals are output from the rotation angle signal outputting part 14 to the solenoid valve controlling part 16 through a completed screw loosening detecting part 15B to stop the solenoid valve 19 via the output circuit 17. This constitution can be realized by the use of a logic circuit or software.

Thus, the operation of the impulse wrench is stopped at the point of time at which the integrated counterclockwise pulses reach a preset screw loosening angle, so that a possible problem that the bolt and nut are loosened too much and fall off is prevented.

In FIGS. 51(*a*)–(*d*), the point of time $P_2$ is a point of time at which the oil cylinder 4A starts decelerating, and the point of time $P_2'$ is a point of time at which the driven shaft 6A starts rotating together with the oil cylinder 4A and from which after confirmation of the first hammering of not less than the threshold value, they keep on rotating together until the preset screw loosening angle.

In the period from the point of time $P_2$ to the point of time $P_2'$, the driven shaft 6A remains in a stationary state, and the rotation angle of only the oil cylinder 4A during the period is as small as less than 10°. From a standpoint of a degree of accuracy of the screw loosening angle, even when the screw member and the driven shaft 6A are rotating from the point of time of $P_2$, there presents no practical problem.

Figure 52:
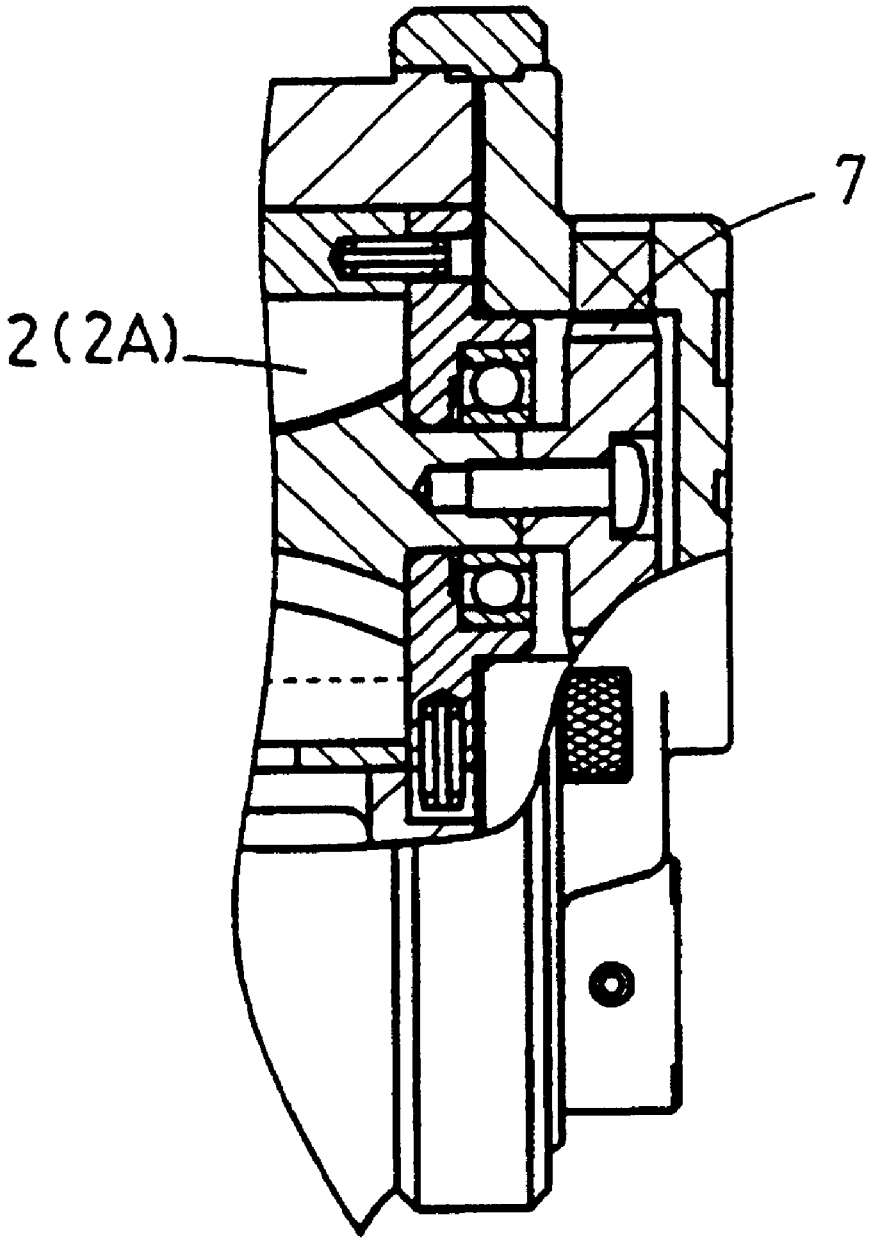
FIG. 52 is an illustration of another mounting form of rotary detecting member.

The rotary detecting member 7 in the impact wrench mentioned above may be fixedly mounted on the outer periphery of the cylindrical rotary member 4 or oil cylinder 4A as the rotary member, so as to be integral therewith, as shown in FIGS. 1 and 18. Alternatively, the rotary detecting member may be mounted on a shaft end portion of the air motor 2 or 2A, so as to be integral therewith, as shown in FIG. 52. Additionally, the rotary detecting member 7 may be mounted on a rotating shaft rotatable with the air motor at any position thereof between the air motor and the rotary member.

The detecting means and control means comprising the rotary detecting member 7, the detecting sensors 8*a*, 8*b*, the input circuit 10, the amplifying part 11, the waveform shaping part 12, the central processing part 13, the rotation angle signal outputting part 14, the completed screw tightening detecting part 15, the completed screw loosening detecting part 15B, the solenoid valve controlling part 16, the output circuit 17, and the solenoid valve 19 are applicable not only to the impact wrench and the impulse wrench as described above, but also to the impact wrenches disclosed by JP Patent Publication No. Sho 61-7908 and U.S. Pat. Nos. 2,285,638, 2,160,150, 3,661,217, 3,174,597, 3,428,137 and 3,552,499 and impact wrenches having similar clutch mechanisms. Further, the detecting means and controlling means are widely applicable to other types of impact wrenches. Accordingly, the detecting means and controlling means are applicable to the screw loosening control using those tools.

Figures 53A, 53B:
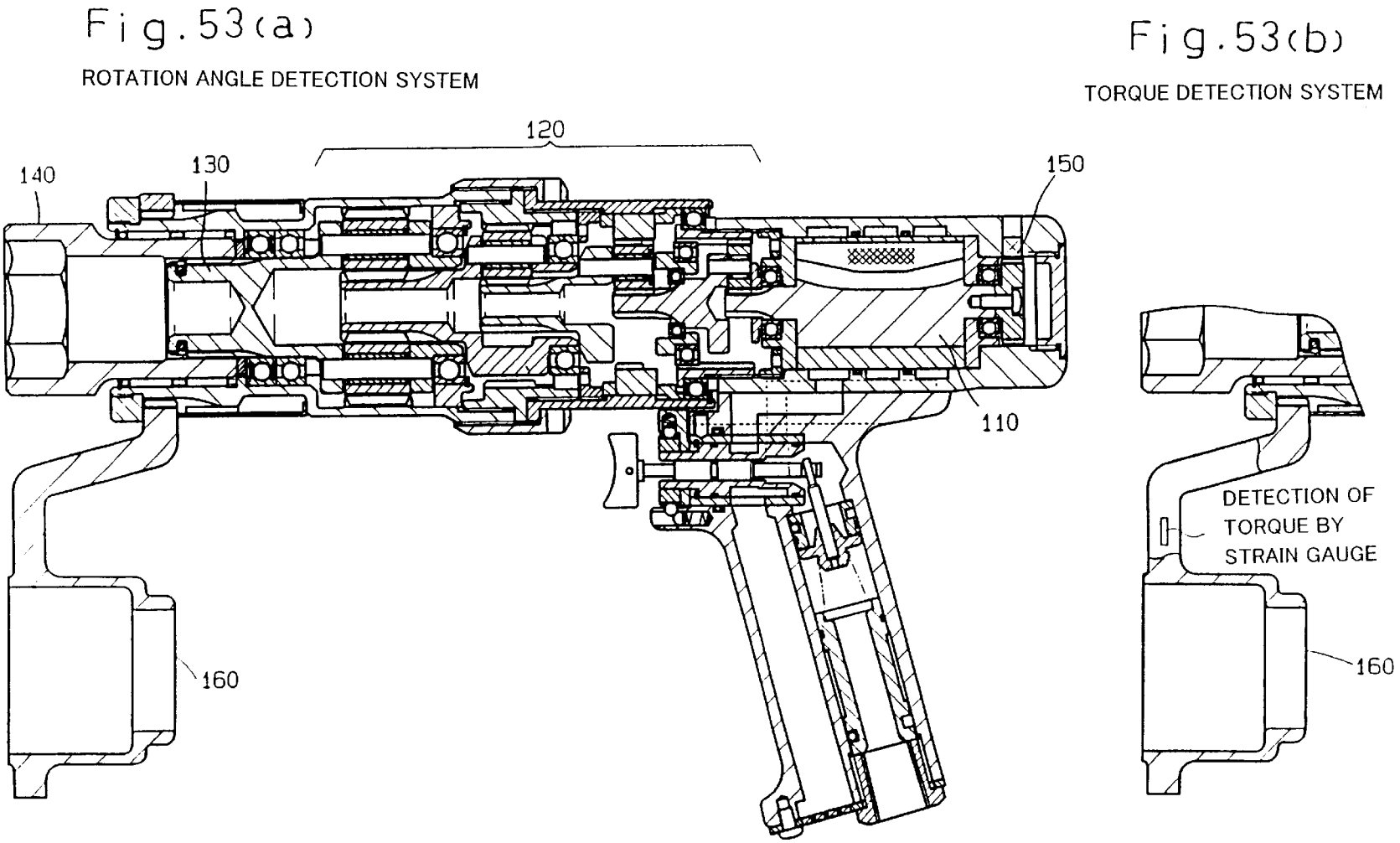
FIG. 53 is an illustration of a nut runner having a reaction force bearing mechanism.

In addition, they are applicable to the nut runner as the screw loosening tool for statically transmitting the torque, one example of which is illustrated in FIG. 53(*a*). In FIG. 53(*a*), the rotation generated at a motor 110 is decelerated by a planetary gear train 120 and also the torque is increased and transmitted to a driven shaft 130, so as to tighten or loosen the screw member fitted to the socket 140 rotatable together with the driven shaft 130.

The nut runner is one embodied form of the hand-held powered screw loosening tool. The motor 110 is one embodied form of the torque generating means. The planetary gear train 120 is one embodied form of the torque transmission mechanism.

Figure 55A:
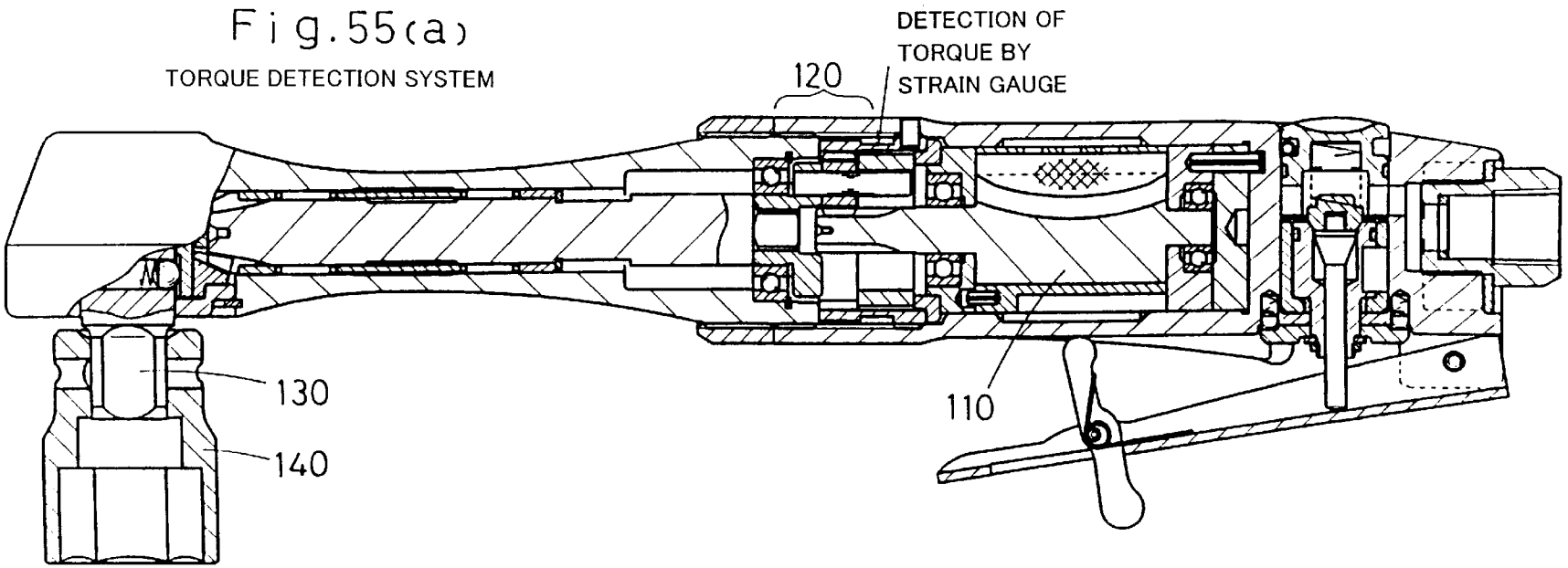
FIG. 55 is an illustration of a nut runner having no reaction force bearing mechanism.
Figure 55B:
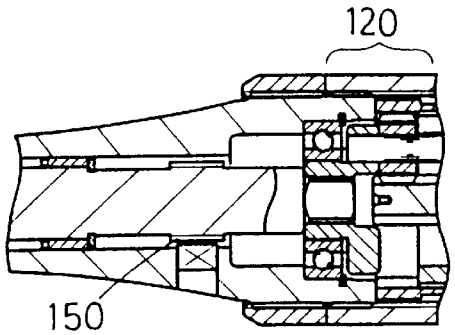

A pulse detecting part 150 represents one embodied form of the detecting means for detecting the rotation angle of the motor 110 and calculating the screw loosening angle on the basis of the detected angle. The pulse detecting part 150 may be provided to be integral with the motor 110, as shown in FIG. 53(*a*). Alternatively, it may be provided at an output side of the planetary gear train 120, as shown in FIG. 55(*b*). Further, it may be provided to be integral with the driven shaft 130.

In FIG. 53(*a*), (*b*), a reaction force bearing mechanism 160 for receiving the reaction generated when the driven shaft 130 is rotated at a high torque. The reaction force bearing mechanism 160 is for capping on a different hub nut from the targeted hub nut to bear the reaction force when the nut runner is used to tighten or loosen the screw member such as a hub nut of a car tire.

Figure 54:
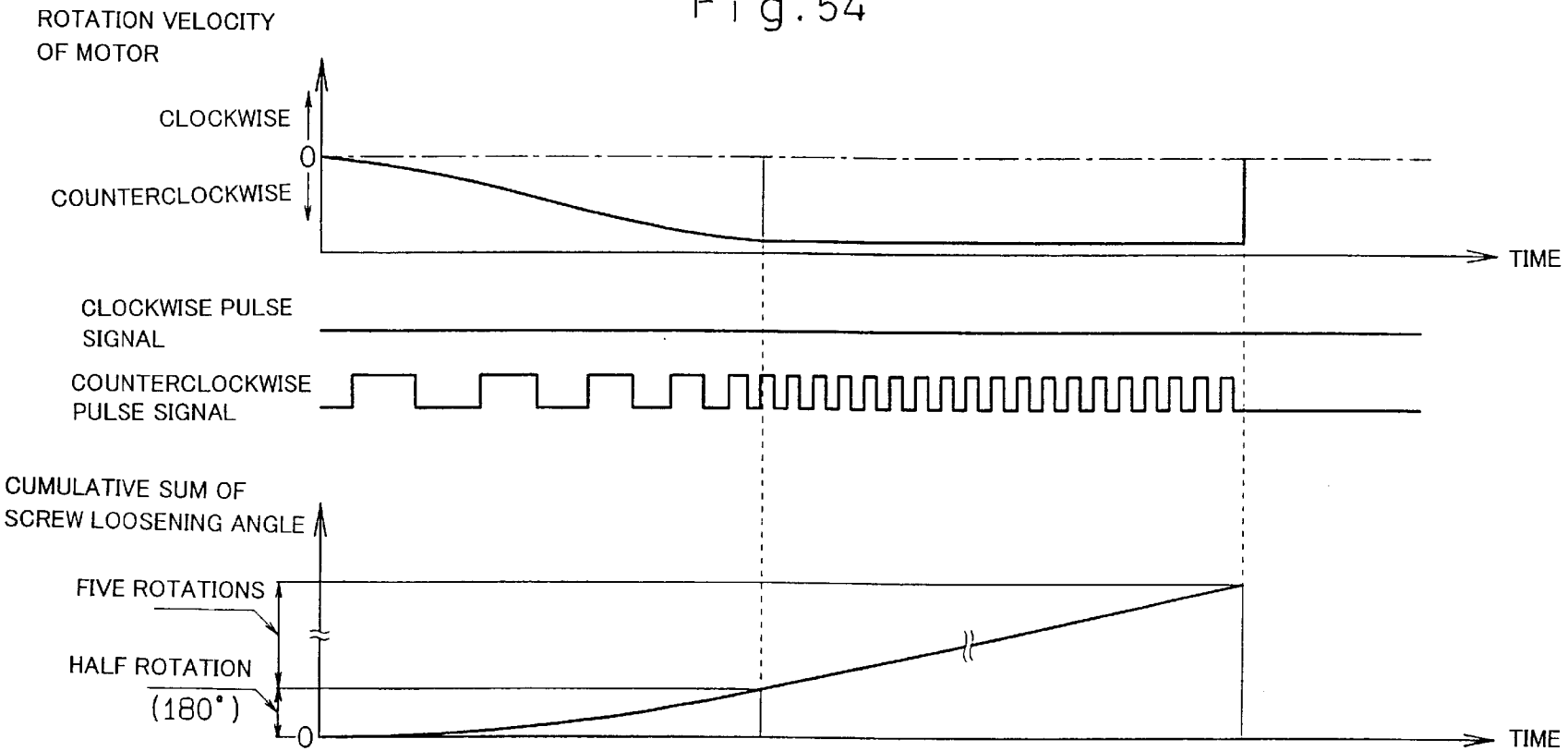
FIG. 54 is a plot of a relation between the operation of a motor and pulse signals.

Shown in FIG. 54 is a plot of a relation between the operation of the motor 110 integral with the pulse detecting part 150 and pulse signals in the nut runner of FIG. 53(*a*). In this type of nut runner, when a loosening control switch (not shown) is turned on, the screw member is loosened in, e.g., a ½ rotation (50 revolutions of the motor 110), after it begins to loosen (in a case of the driven shaft 130 designed to rotate once for every 100 rotations of the motor 110) and the motor 110 is increased in rotation velocity, first, and then is rotated at high velocity. When the cumulative total of the rotation angle reaches the preset number of rotations (e.g. 5 rotations of the screw member or 500 revolutions in terms of revolution of the motor 110), the nut runner is controllably stopped.

In a case of the nut runner with no reaction force bearing mechanism 160 as shown in FIG. 55(*b*), the number of rotations for screw loosening is set, taking some factors such as the wobbling into consideration.

In the detection of the rotation angle in FIGS. 53(*a*) and 55(*b*), after the loosening control switch is turned on, the number of pulses in the loosening direction from the pulse detecting part 150 begins to be accumulated. Then, the cumulative total number of pulses is converted to the rotation angle, so that when it reaches the preset rotation angle, the rotation is stopped. In the case where no loosening control is performed, the loosening control switch remains in OFF.

Figure 56:
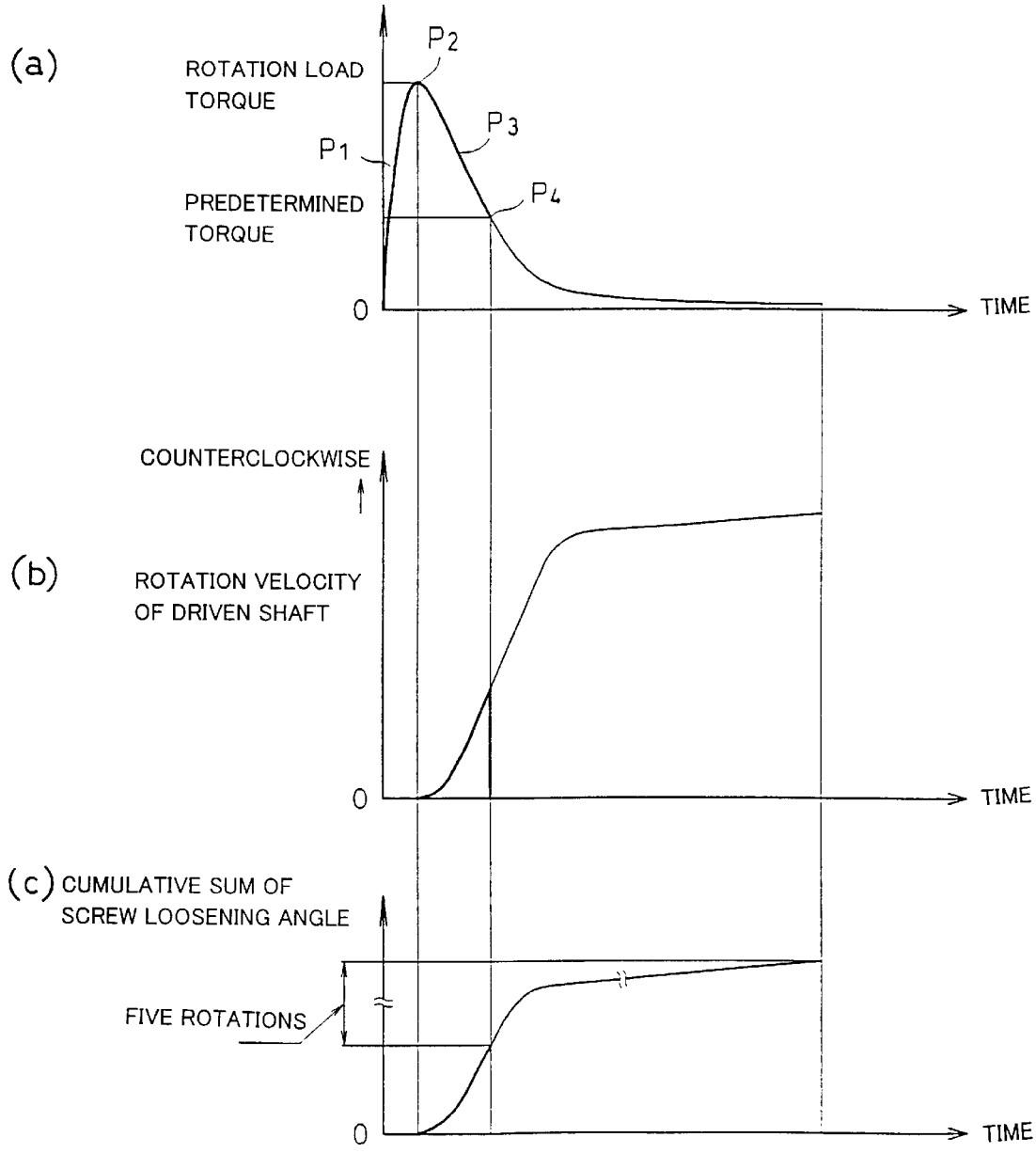
FIG. 56 is an illustration of the screw loosening control in the nut runner.

Referring now to FIGS. 56(*a*)–(*c*), description will be given on the method in which in the nut runner as the screw loosening tool, the rotative load torque for the driven shaft 130 to be rotated in the screw loosening direction is detected so that when the screw member is loosened to a predetermined torque, the rotation can be stopped.

In this method, the nut runner with a rotative load torque detecting device such as a strain gauge as shown in FIGS. 53(*b*) and 55(*a*) is used.

The rotative load torque detecting device is one embodied form of the torque detecting means.

In this embodied form, the socket 140 fitted to the front end of the driven shaft 130 is fitted to a screw to be loosened and the loosening control switch (not shown) is turned on. Thereafter, the control lever is operated to transmit the torque generated at the motor 110 to the driven shaft 130 through the planetary gear train 120. The torque of the motor 110 is increased by the planetary gear train 120 and operates in the screw loosening direction. In the early stage ($P_1$), the torque on the load side is larger than the output torque (rotative load torque) of the nut runner, so that the screw member is kept in its halt condition.

In this stage $P_1$, the output torque detected gradually increases from a value smaller than a preset torque and becomes equal to the preset torque for a while, and then increases further.

When the detected output torque is equal to the preset torque for a while, the motor 110 and the planetary gear train 120 are put in such a state that they keep on transmitting the torque to the driven shaft while the output torque is increasing. At a point of time ($P_2$) at which the output torque of the nut runner corresponds to the torque on the load side, the driven shaft 130 that moves together with the screw member starts rotating and the screw member begins to loosen, whereby the torque on the load side decreases and the output torque matching therewith also decreases ($P_3$). At a point of time ($P_4$) at which the output torque corresponding to the preset torque in the middle of the decrease of the output torque, the motor 110 or the planetary gear train 120 is stopped.

While the screw loosening may be stopped at the point of time ($P_4$) at which the output torque reaches the preset torque, another control may be adopted wherein the point of time $P_4$ is used as the starting point of screw loosening and the number of rotations is counted from that point of time, so that when the number of rotations reaches a preset number of rotations (e.g. 5 rotations), the motor or the planetary gear train is stopped. In this control, the nut runner having the rotative load torque detecting device and the rotation angle detecting device is used.

Figure 57:
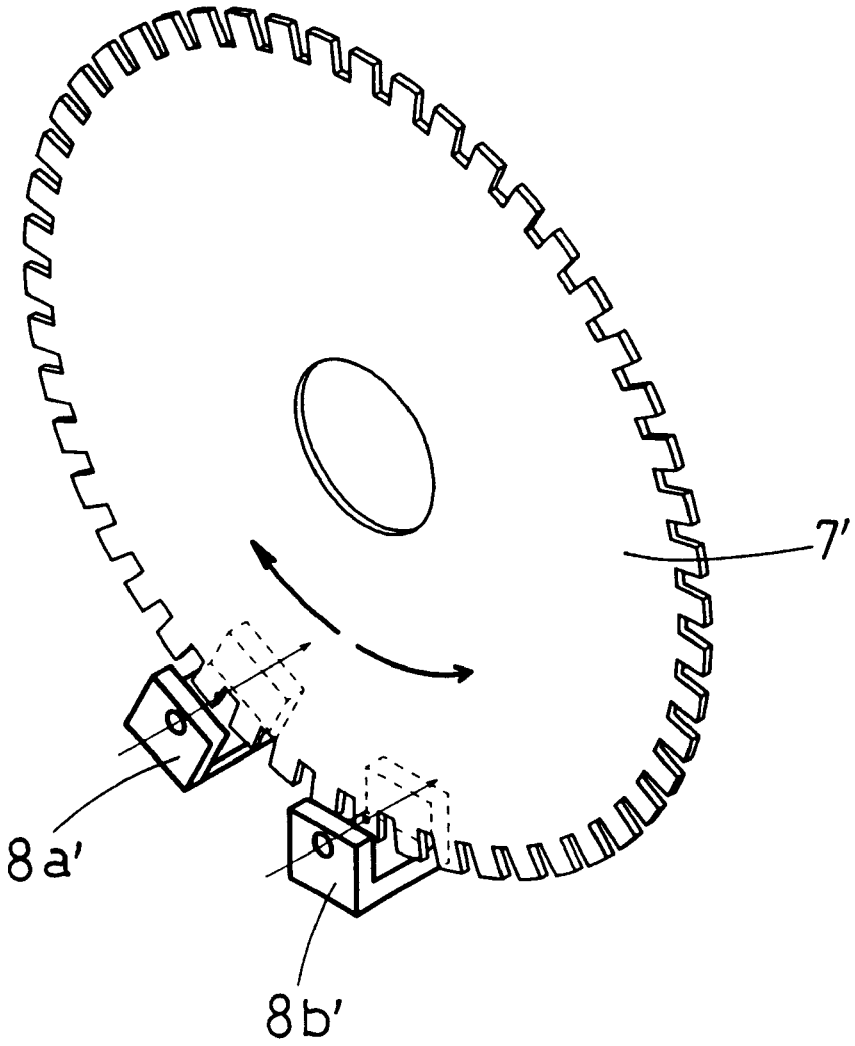
FIG. 57 is an illustration of another form of the pulse detecting part.

The combination of the rotary detecting member 7 and the detecting sensors 8*a*, 8*b*, or the pulse detecting part 150, which are embodied as the detecting means on the hand-held powered wrench or the hand-held powered screw loosening tool, are not limited to the constitution mentioned above. Instead, a rotary detecting member 7' comprising a disk having circumferentially regularly spaced slits or light reflex members and a pair of photo-sensors 8*a'* and 8*b'* to detecting the number of passing slits or the number of light reflexes, such as photo interrupters may be used, as shown in FIG. 57.

In place of the air motor, an electric motor, an internal combustion engine and the like may freely be used as the torque generating means.

The torque transmission mechanism is not limited to the hammering force transmission mechanism used in the impact wrenches with the clutch structures mentioned above. The forms of the torque transmission mechanisms used in the impulse wrench and the nut runner, respectively, may, of course, be used.

The method for controlling the hand-held powered screw loosening tool of the present invention can be used for the screw loosening control using the hand-held powered screw tightening tools including, for example, an impact wrench, an impulse wrench, a nut runner, an impact driver, a ratchet wrench, and a drill driver.

CAPABILITIES OF EXPLOITATION IN INDUSTRY

As mentioned above, according to the method for reading the rotation angle of the screw member of the present invention, the screw tightening angle can be determined by detecting the rotation angle formed throughout the deceleration or during a part of deceleration of the rotary member caused by the hammering, thus enabling the screw tightening force to be controlled to an adequate force corresponding to a preset screw tightening angle.

By virtue of this, the impact wrenches, such as a hand-held powered wrench, which have not been concerned with tightening accuracy because of the wobbling, despite of being in wide use, light-weight, highly efficient and high in performance, can get very accurate screw tightening control via the screwing angle.

According to the wobbling detecting method of the present invention, a quantity of wobbling generated in the screw tightening work with the hand-held powered wrench can be detected, thus enabling the quality of screw tightening work to be numerically evaluated.

According to the screw tightening evaluating method of the present invention, reliability of the screw tightening can be evaluated by comparing a wobbling angle with a preset allowable angle, such that an excessive wobbling is considered as having a low reliability in screw tightening and a small amount of wobbling is considered as having a high reliability in screw tightening.

According to the method of controlling the hand-held powered screw loosening tool of the present invention, a rotation angle of the driven shaft in the screw loosening direction in the screw loosening work is accumulated, so that when a sum total of accumulated rotation angle reaches a preset angle, the driven shaft can be controlled to stop rotating in the screw loosening direction, and as such can prevent the screw member from being excessively loosened and falling.

According to the present invention, there is provided detecting means to detect variation in rotation velocity of the rotary member and the rotation angle of the rotary member, to accumulate, on the basis of the variation in the rotation velocity and the rotation angle detected by the detecting means, the rotation angle formed throughout the deceleration or during a part of the deceleration of the rotary member in the screw loosening direction from the start of deceleration to the end of deceleration, so that when a sum of the accumulated rotation angle reaches a preset angle, the driven shaft is stopped rotating in the screw loosening direction, and as such can prevent the screw member from being excessively loosened.

According to the present invention, there is provided detecting means to detect variation in rotation velocity of the rotary member and the rotation angle of the rotary member, to detect generation of the hammering by use of the detecting means, so that in the case of a hand-held powered screw loosening tool wherein the rebound is generated after the end of deceleration, when the rotary member starts running freely again without rebounding after the generation of the hammering is detected or when the rotary member starts running freely again without its rotation velocity reducing to zero, the rotation of the driven shaft in the loosening direction can controllably be stopped when the rotary member rotates continuously at or over a predetermined preset screw loosening angle, while on the other hand, in the case of a hand-held powered screw loosening tool wherein the rebound is not generated after the end of deceleration, the rotation of the driven shaft in the loosening direction can controllably be stopped when the rotary member rotates continuously at or over a predetermined preset screw loosening angle without its rotation velocity in the loosening direction after the end of deceleration reducing below a threshold value after the generation of the hammering is detected, and as such can prevent the screw member from being excessively loosened.

According to the present invention, there is provided torque detecting means to detect rotative load torque for the driven shaft to be rotated in the screw loosening direction, so that when the rotative load torque detected by the torque detecting means is reduced below a preset torque, the driven shaft stops rotating in the screw loosening direction, and as such prevents the screw member from being excessively loosened.

What is claimed is:

1. A method for detecting a wobbling in a controlled tightening of a hand-held powered wrench comprising a rotary member which, after running freely, starts decelerating when it provides a hammering force to a driven shaft side and, after the end of deceleration, rebounds and runs freely again, wherein there is provided detecting means to detect variation in rotation velocity of the rotary member and a rotation angle of the same, wherein on the basis of the variation in the rotation velocity and the rotation angle detected by the detecting means, an angle obtained by subtracting a cumulative total of the rotation angle in the rebounding direction from a cumulative total of the rotation angle in the tightening direction is detected and accumulated as a total rotation angle (P) and a rotation angle formed at the hammering in the course of deceleration is detected as ΔH and accumulated, and a preset design angle Pd for hammering corresponding to the number of hammerings provided until the end of the tightening work is accumulated, and wherein a wobbling angle is calculated from the following Equation:

$$\text{A wobbling angle}=P-\text{a cumulative total of } Pd-\text{a cumulative total of } \Delta H,$$

where Pd is a design value of the powered wrench, indicating an angle corresponding to 360°/m for the case of the m number of hammerings per rotation of the rotary member.

2. A method for detecting a wobbling in a controlled tightening of a hand-held powered wrench comprising a rotary member which, after running freely, starts decelerating when it provides a hammering force to a driven shaft side and, after the end of deceleration, runs freely again without rebounding, wherein there is provided detecting means to detect variation in rotation velocity of the rotary member and a rotation angle of the same, wherein on the basis of the variation in the rotation velocity and the rotation angle in the tightening direction is detected and accumulated as a total rotation angle (P) and an angle obtained by subtracting a certain angle from a rotation angle formed throughout the deceleration is detected as ΔG and accumulated, and a preset design angle Pd for hammering corresponding to the number of hammerings provided until the end of a tightening work is accumulated, and wherein a wobbling angle is calculated from the following Equation:

$$\text{A wobbling angle}=P-\text{a cumulative total of } Pd-\text{a cumulative total of } \Delta G,$$

where Pd is a design value of the powered wrench, indicating an angle corresponding to 360°/m for the case of the m number of hammerings per rotation of the rotary member.

3. A method of evaluating reliability of a tightening by comparing a wobbling angle calculated by the wobbling detecting method of claim 1 with a preset allowable angle.

4. A method of evaluating reliability of a tightening by comparing a wobbling angle calculated by the wobbling detecting method of claim 2 with a preset allowable angle.

5. A method for reading a screwing angle of a hand-held powered wrench comprising a rotary member and a driven shaft side, wherein the rotary member, after rotating freely, starts decelerating when providing a hammering force to the driven shaft side and, after an end of deceleration, rebounds and rotates freely again, said method comprising:

accumulating a rotation angle formed during the deceleration of the rotary member in a tightening direction from the start of deceleration to the end of deceleration; and when a sum total of the accumulated rotation angle reaches a preset angle, controllably stopping tightening.

6. A method for reading a screwing angle of a hand-held powered wrench comprising a rotary member and a driven shaft side, wherein the rotary member, after rotating freely, starts decelerating when providing a hammering force to the driven shaft side and, after an end of deceleration, rotates freely again, said method comprising:

accumulating an angle obtained by subtracting a certain angle from a rotation angle formed during the deceleration of the rotary member in a tightening direction from the start of deceleration to the end of deceleration; and when a sum total of the accumulated angle reaches a preset angle, controllably stopping tightening.

7. A method for detecting wobbling in a controlled tightening of a hand-held powered wrench comprising a rotary member and a driven shaft side, wherein the rotary member, after rotating freely, starts decelerating when providing a hammering force to the driven shaft side and, after an end of deceleration, rebounds and rotates freely again, said method comprising:

detecting variation in rotation velocity of the rotary member and a rotation angle of the rotary member via detecting means;

detecting and accumulating a total rotation angle (P) by subtracting a cumulative total of the rotation angle of the rotary member in a rebounding direction from a cumulative total of the rotation angle of the rotary member in a tightening direction based on the variation in the rotation velocity and the rotation angle detected by the detecting means;

detecting and accumulating a rotation angle (ΔH) formed while hammering, during deceleration, based on the variation in the rotation velocity and the rotation angle detected by the detecting means;

accumulating a preset design angle (Pd) for hammering corresponding to a number of hammerings provided until an end of the tightening based on the variation in the rotation velocity and the rotation angle detected by the detecting means; and calculating a wobbling angle from the following Equation:

the wobbling angle=*P*−a cumulative total of *Pd*−a cumulative total of Δ*H*, wherein Pd is a design value of the powered wrench, indicating an angle corresponding to 360°/m for a case of m number of hammerings per rotation of the rotary member.

8. A method for detecting wobbling in a controlled tightening of a hand-held powered wrench comprising a rotary member and a driven shaft side, wherein the rotary member, after rotating freely, starts decelerating when providing a hammering force to the driven shaft side and, after the end of deceleration, rotates freely again without rebounding, said method comprising:

detecting variation in rotation velocity of the rotary member and a rotation angle of the rotary member via detecting means, detecting and accumulating a cumulative total of the rotation angle of the rotary member in a tightening direction as a total rotation angle (P) based on the variation in the rotation velocity and the rotation angle detected by the detecting means;

detecting and accumulating an angle (ΔG) by subtracting a certain angle from a rotation angle formed throughout deceleration based on the variation in the rotation velocity and the rotation angle detected by the detecting means;

accumulating a preset design angle (Pd) for hammering corresponding to a number of hammerings provided until an end of the tightening based on the variation in the rotation velocity and the rotation angle detected by the detecting means; and calculating a wobbling angle from the following Equation:

the wobbling angle=*P*−a cumulative total of *Pd*−a cumulative total of Δ*G*, wherein Pd is a design value of the hand-held powered wrench, indicating an angle corresponding to 360°/m for a case of m number of hammerings per rotation of the rotary member.

9. A method of evaluating reliability of a tightening, said method comprising comparing the wobbling angle calculated by the wobbling detecting method of claim 7 with a preset allowable angle.

10. A method for controlling a hand-held powered screw loosening tool comprising a rotary member and a driven shaft side, wherein the rotary member, after rotating freely in a screw loosening direction, starts decelerating when providing a hammering force to the driven shaft side and, after an end of deceleration, rotating freely again in the screw loosening direction after or without rebounding, said method comprising:

accumulating a rotation angle of the driven shaft in the screw loosening direction while loosening a screw; and when a sum total of the accumulated rotation angle reaches a preset angle, controllably stopping the rotation of the driven shaft in the screw loosening direction.

11. A method for controlling a hand-held powered screw loosening tool comprising a rotary member and a driven shaft side having a driven shaft, wherein the rotary member, after rotating freely in a screw loosening direction, starts decelerating when providing a hammering force to the driven shaft side and, after an end of deceleration, starts rotating freely again in the screw loosening direction after or without rebounding, said method comprising:

detecting variation in rotation velocity of the rotary member and a rotation angle of the rotary member via detecting means;

accumulating one of the rotation angle of the rotary member in the screw loosening direction formed during the deceleration from the start to the end thereof and an angle obtained by subtracting a certain angle from the rotation angle formed during the deceleration of the rotary member, based on the variation in the rotation velocity and the rotation angle detected by the detecting means; and when a sum total of the accumulated angle reaches a preset angle, controllably stopping the rotation of the driven shaft in the screw loosening direction.

12. A method for controlling a hand-held powered screw loosening tool comprising a rotary member and a driven shaft side having a driven shaft, wherein the rotary member, after rotating freely in a screw loosening direction, starts decelerating when providing a hammering force to the driven shaft side and, after an end of deceleration, rotates freely again in the screw loosening direction after rebounding, said method comprising:

detecting variation in rotation velocity of the rotary member and a rotation angle of the rotary member via detecting means;

detecting hammering with the detecting means; and when the rotary member starts rotating freely again without rebounding after the hammering is detected or when the rotary member starts rotating freely again without the rotation velocity of the rotary member being reducing to zero, controllably stopping a rotation of the driven shaft in the screw loosening direction when the rotary member rotates continuously at or over a predetermined preset screw loosening angle.

13. A method for controlling a hand-held powered screw loosening tool comprising a rotary member and a driven shaft side having a driven shaft, wherein the rotary member, after rotating freely in a screw loosening direction, starts decelerating when providing a hammering force to the driven shaft side and, after an end of deceleration, rotates freely again in the screw loosening direction without rebounding, said method comprising:

detecting variation in rotation velocity of the rotary member and a rotation angle of the rotary member via detecting means;

detecting hammering with the detecting means; and when the rotary member rotates continuously at or over a predetermined preset screw loosening angle without the rotation velocity of the rotary member in the loosening direction after the end of deceleration being reduce below a threshold level after the generation of the hammering is detected, controllably stopping a rotation of the driven shaft in the screw loosening direction.

14. A method for controlling a hand-held powered screw loosening tool wherein a torque generated is applied to a driven shaft through a torque transmission mechanism to rotate the driven shaft in a screw loosening direction, so as to loosen a screw member, wherein said method comprises:

detecting a rotative load torque for the driven shaft to be rotated in the screw loosening direction via torque detecting means; and when the rotative load torque detected by the torque detecting means becomes equal to or below a predetermined torque, controllably stopping the rotation of the driven shaft in the loosening direction.

15. A method of evaluating a tightening, said method comprising comparing the wobbling angle calculated by the wobbling detecting method of claim 8 with a preset allowable angle.

* * * * *

UNITED STATES PATENT AND TRADEMARK OFFICE

CERTIFICATE OF CORRECTION

PATENT NO. : 6,546,815 B2
DATED : April 15, 2003
INVENTOR(S) : Masakazu Yamada et al.

It is certified that error appears in the above-identified patent and that said Letters Patent is hereby corrected as shown below:

Title page,
Item [22], PCT Filed: change "March 13, 2001" to -- March 13, 2000 --.

Signed and Sealed this

Seventh Day of October, 2003

JAMES E. ROGAN
*Director of the United States Patent and Trademark Office*